US012140396B2

(12) United States Patent
Roberts et al.

(10) Patent No.: US 12,140,396 B2
(45) Date of Patent: Nov. 12, 2024

(54) DRUM MAGAZINE ASSEMBLY AND METHODS

(71) Applicant: Magpul Industries Corp., Austin, TX (US)

(72) Inventors: Timothy Eric Roberts, Broomfield, CO (US); Michael T. Mayberry, Denver, CO (US); Brian L. Nakayama, Arvada, CO (US); Richard M. Fitzpatrick, West Lake Hills, TX (US); Eric Nakayama, Broomfield, CO (US); William Bradley Bennett, Lafayette, CO (US)

(73) Assignee: Magpul Industries Corp., Austin, TX (US)

( * ) Notice: Subject to any disclaimer, the term of this patent is extended or adjusted under 35 U.S.C. 154(b) by 0 days.

(21) Appl. No.: 18/143,585

(22) Filed: May 4, 2023

(65) Prior Publication Data

US 2023/0304758 A1 Sep. 28, 2023

Related U.S. Application Data

(63) Continuation of application No. 17/369,608, filed on Jul. 7, 2021, now Pat. No. 11,680,763, which is a (Continued)

(51) Int. Cl.

| | |
|---|---|
| ***F41A 9/75*** | (2006.01) |
| ***F41A 9/65*** | (2006.01) |
| ***F41A 9/70*** | (2006.01) |

(52) U.S. Cl.

CPC *F41A 9/75* (2013.01); *F41A 9/65* (2013.01); *F41A 9/70* (2013.01)

(58) Field of Classification Search

CPC ..... F41A 9/70; F41A 9/75; F41A 9/65; F41A 9/60; F42B 12/74; F42B 33/067

(Continued)

(56) References Cited

U.S. PATENT DOCUMENTS

| | | | |
|---|---|---|---|
| 118,916 | A | 9/1871 | Elliot |
| 627,850 | A | 6/1899 | Hobart |

(Continued)

FOREIGN PATENT DOCUMENTS

| | | | |
|---|---|---|---|
| BE | 1018257 | A4 | 8/2010 |
| CN | 86105123 | A | 6/1987 |

(Continued)

OTHER PUBLICATIONS

"1022 50 Round Drum", Black Dog Machine LLC., 5 pages, online available at <http://blackdogmachinellc.net/drum-10-22-50rd.aspx>, Known as early as Nov. 2015.

(Continued)

*Primary Examiner* — John Cooper

(74) *Attorney, Agent, or Firm* — Neugeboren O'Dowd PC

(57) ABSTRACT

A magazine assembly for a firearm and a related method are disclosed. The assembly has a magazine housing defining a track, and a follower assembly. The magazine housing is configured to constrain a cartridge as the cartridge is moved within the magazine assembly such that majority of a proximal surface area of the cartridge does not contact the magazine housing, and a distal tip of the cartridge does not contact the magazine housing.

19 Claims, 49 Drawing Sheets

Related U.S. Application Data continuation of application No. 16/811,835, filed on Mar. 6, 2020, now Pat. No. 11,085,718, which is a continuation of application No. 16/200,978, filed on Nov. 27, 2018, now Pat. No. 10,677,550, which is a continuation-in-part of application No. 15/354,492, filed on Nov. 17, 2016, now Pat. No. 10,184,741, which is a continuation of application No. 14/882,151, filed on Oct. 13, 2015, now Pat. No. 9,528,784.

(60) Provisional application No. 62/063,546, filed on Oct. 14, 2014.

(58) Field of Classification Search
USPC ..... 89/33.25, 33.2, 33.17, 33.16, 33.14, 89/33.02; 42/49.02
See application file for complete search history.

(56) References Cited

U.S. PATENT DOCUMENTS

| | | | | |
|---|---|---|---|---|
| 681,151 | A | 8/1901 | Theodore | |
| 1,042,837 | A | 10/1912 | Tatarek | |
| 1,333,498 | A | 3/1920 | Lang | |
| 1,337,893 | A | 4/1920 | Farquhar et al. | |
| 1,451,339 | A | 4/1923 | Arthur | |
| 1,588,888 | A | 6/1926 | Haubroe et al. | |
| 1,747,546 | A | 2/1930 | Franktisek | |
| 1,811,093 | A | 6/1931 | Neal | |
| 2,064,888 | A | 12/1936 | Dickinson | |
| 2,321,720 | A | 6/1943 | Whittaker | |
| 2,407,461 | A | 9/1946 | Josef | |
| 2,426,517 | A | 8/1947 | Mcwhorter | |
| 2,448,081 | A | 8/1948 | Conway | |
| 2,489,428 | A | 11/1949 | Mariner | |
| 3,239,959 | A | 3/1966 | Sefried et al. | |
| 3,303,741 | A | 2/1967 | Mauritz | |
| 3,399,480 | A | 9/1968 | Rowe | |
| 3,507,186 | A | 4/1970 | Cermak et al. | |
| 4,005,633 | A | 2/1977 | Kirkpatrick | |
| 4,034,644 | A | 7/1977 | Hupp et al. | |
| 4,138,923 | A | 2/1979 | Brosseau et al. | |
| 4,332,097 | A | 6/1982 | Taylor, Jr. | |
| 4,384,508 | A * | 5/1983 | Sullivan | F41A 9/73 89/33.02 |
| 4,413,546 | A * | 11/1983 | Taylor, Jr. | F41A 9/73 89/33.02 |
| 4,445,418 | A * | 5/1984 | Sullivan | F41A 9/73 89/33.02 |
| 4,509,401 | A | 4/1985 | Pollock | |
| 4,524,672 | A | 6/1985 | Balsavage | |
| 4,524,673 | A | 6/1985 | Golden | |
| 4,658,700 | A * | 4/1987 | Sullivan | F41A 9/37 89/33.02 |
| 4,689,907 | A * | 9/1987 | Gwinn, Jr. | F41A 9/73 89/33.02 |
| 4,708,049 | A | 11/1987 | Durant et al. | |
| 4,926,742 | A * | 5/1990 | Ma | F41A 9/75 89/33.02 |
| 4,930,400 | A | 6/1990 | Brandl et al. | |
| 4,970,818 | A | 11/1990 | Vecchieschi | |
| 5,056,252 | A | 10/1991 | Velezis | |
| 5,111,729 | A | 5/1992 | Tassie | |
| 5,309,660 | A | 5/1994 | Blackamore | |
| 5,456,153 | A * | 10/1995 | Bentley | F41A 9/73 89/33.17 |
| 5,502,913 | A | 4/1996 | Jackson | |
| 5,561,258 | A * | 10/1996 | Bentley | F41A 9/75 89/33.02 |
| 5,905,224 | A * | 5/1999 | Jordan | F41A 9/75 89/33.02 |
| 6,502,495 | B1 | 1/2003 | Beary | |
| 7,441,491 | B2 | 10/2008 | Snow | |
| D627,850 | S | 11/2010 | Rich | |
| 7,942,091 | B2 * | 5/2011 | Winge | F41A 9/74 89/33.02 |
| 8,037,800 | B2 | 10/2011 | Snow | |
| 8,117,956 | B2 | 2/2012 | Emde | |
| 8,156,675 | B2 | 4/2012 | Heath | |
| 8,196,327 | B2 | 6/2012 | Rich | |
| 8,220,377 | B2 | 7/2012 | Quetschke et al. | |
| 8,347,774 | B2 | 1/2013 | Rich | |
| 8,387,296 | B2 | 3/2013 | Overstreet et al. | |
| 8,387,607 | B2 | 3/2013 | Christopher et al. | |
| D681,151 | S | 4/2013 | Fitzpatrick et al. | |
| 8,448,558 | B2 | 5/2013 | Asichak et al. | |
| 8,484,875 | B2 | 7/2013 | Heath | |
| 8,733,224 | B2 | 5/2014 | Asichak et al. | |
| 8,745,912 | B2 | 6/2014 | Heath | |
| 8,919,022 | B2 * | 12/2014 | Chewning | F41A 9/75 89/33.02 |
| 8,943,727 | B2 | 2/2015 | Russell | |
| 8,966,801 | B1 | 3/2015 | Bentley | |
| 9,528,784 | B2 * | 12/2016 | Roberts | F41A 9/70 |
| 10,184,741 | B2 * | 1/2019 | Roberts | F41A 9/75 |
| 10,677,550 | B2 * | 6/2020 | Roberts | F41A 9/70 |
| 11,085,718 | B2 * | 8/2021 | Roberts | F41A 9/65 |
| 11,680,763 | B2 | 6/2023 | Roberts et al. | |
| 2007/0107592 | A1 * | 5/2007 | Snow | F41A 9/68 89/33.02 |
| 2011/0078937 | A1 | 4/2011 | Rich | |
| 2011/0079132 | A1 | 4/2011 | Rich | |
| 2011/0107901 | A1 | 5/2011 | Asichak et al. | |
| 2012/0117840 | A1 * | 5/2012 | Chewning | F41A 9/70 42/49.01 |
| 2014/0076137 | A1 * | 3/2014 | Lasichak | F41A 9/70 89/33.02 |
| 2014/0096671 | A1 * | 4/2014 | Jiang | F41A 9/73 89/33.02 |
| 2014/0250752 | A1 | 9/2014 | Heath | |
| 2015/0300761 | A1 | 10/2015 | Delury et al. | |
| 2016/0102931 | A1 | 4/2016 | Roberts et al. | |
| 2017/0067706 | A1 | 3/2017 | Roberts et al. | |
| 2019/0086172 | A1 | 3/2019 | Roberts et al. | |
| 2020/0378704 | A1 | 12/2020 | Roberts et al. | |
| 2021/0341241 | A1 | 11/2021 | Roberts et al. | |

FOREIGN PATENT DOCUMENTS

| | | | |
|---|---|---|---|
| CN | 87 2 12106 | U | 7/1988 |
| CN | 101660886 | A | 3/2010 |
| CN | 201837306 | U | 5/2011 |
| CN | 204478918 | U | 7/2015 |
| CZ | 19479 | U1 | 4/2009 |
| EP | 0 210 713 | A1 | 2/1987 |
| EP | 1 967 810 | A2 | 9/2008 |
| EP | 1 967 810 | A3 | 4/2013 |
| KR | 1019810002378 | | 9/1987 |
| KR | 1019870700252 | | 5/1991 |
| KR | 10-1271650 | B1 | 6/2013 |
| KR | 1015012540000 | B1 | 3/2015 |
| WO | 2011/056236 | A2 | 5/2011 |
| WO | 2011/155971 | A1 | 12/2011 |
| WO | 2014/035032 | A1 | 3/2014 |
| WO | 2016/061122 | A2 | 4/2016 |

OTHER PUBLICATIONS

"50 Round Drum HK91 G3 and PTR", Heckler & Koch, 3 pages, online available at <http://www.hkparts.net/shop/pc/50-Round-Drum-For-HK-91-G3-PTR-Rifles-p1283.htm>, Known as early as Nov. 2015.

"90 Rounder", MWG Company, 3 pages, online available at <http://www.mwgco.com/ar-15_accessories/category/90_Rounder.html>, Known as early as Nov. 2015.

"AK 47 Drum Magazine", Cheaper Than Dirt, 3 pages, online available at <http://www.cheaperthandirt.com/Search.aspx?site=AllProducts&num=15&q=AK+47+Drum+Magazine>, Known as early as Nov. 2015.

(56) References Cited

OTHER PUBLICATIONS

"AK-47: How to Load a Drum Mag", NSZ85, Youtube, 3 pages, online available at <https://www.youtube.com/watch?v=9L0vjEDDFI0>, Known as early as Nov. 2015.
"Atchisson Assault Shotgun", Wikipedia, 6 pages, online available at <https://en.wikipedia.org/wiki/Atchisson_Assault_Shotgun>, Known as early as Nov. 2015.
"Beta C-Mag Scar 17", The Beta Company, 2 pages, online available at <http://www.betaco.com/>, Known as early as Nov. 2015.
"C-Mag System G36", The Beta Company, 3 pages, online avilable at <http://www.betaco.com/cmag_product_details.asp?product=3>, Known as early Jan. 2016.
"C-Mag System HK33/53", The Beta Company, 3 pages, online available at <http://www.betaco.com/cmag_product_details.asp?product=6>, Known as early as Jan. 2016.
"Home of the American 180", E&L Manufacturing, 4 pages, online available at <http://www.elmfg.com/am180/accessor/drumlexan.html>, Known as early as Nov. 2015.
"How to Load a 75RD AK Drum Magazine", Taofledermaus, Youtube, 3 pages, online available at <https://www.youtube.com/watch?v=ccowTSP-odE>, Known as early as Nov. 2015.
"How to Load a Romanian AK47 75 Round Drum Mag", Pokitisme, Youtube, 3 pages, online avilable at <https://www.youtube.com/watch?v=4Eus7Lh1P-c>, Known as early as Nov. 2015.
"Lewis Automatic Machine Gun", All World Wars, 45 pages, online available at <http://www.allworldwars.com/Lewis-Automatic-Machine-Gun-1916.html>, Known as early as Nov. 2015.
"Mag AK-47 Drum Magazine 75 Round 7.62x39 Steel Pre-Ban Romanian", Cheaper Than Dirt, 4 pages, online available at <http://www.cheaperthandirt.com/product/MAG-032>, Known as early as Nov. 2015.
"Military Surplus Magazine Ak-47 7.62x39mm 75-Round Drum Steel Gray", Midway USA Inc., 11 pages, online available at <http://www.midwayusa.com/product/148497/military-surplus--nagazine-ak-47-762x39mm-75-round-drum-steel-gray>,Known as early as Nov. 2015.
"MWG 50 Rounder Ruger, 10/22 Magazine", MWG Company, 3 pages, online available at <http://www.mwgco.com/ar-15_accessories/product/MWG-022-050.html>, Known as early as Nov. 2015.
"PPSH-41", Wikipedia, 14 pages, online available at <https://en.Wikipedia.org/wiki/PPSh-41>, Known as early as Nov. 2015.
"ProMag Drum Magazine Ak-47 7.62x39mm 73-Round Polymer Black", Midway USA Inc., 11 pages, online available at <http://www.midwayusa.com/product/968932/promag-drum-magazine-ak-47-762x39mm-73-round-polymer-black?cm_vc=subv1968932>, Known as early as Nov. 2015.
"SAI-A6 Saiga* 12-Guage (20)Rd Polymer Drum Magazine", Promag Industries, 4 pages, online available at <https://promagindustries.com/saiga/111-saiga-12-gauge-20rd-polymer-drum-magazine.html>, Known as early as Nov. 2015.
"Saw-MagTM", Armatac Industries Inc., 4 pages, online available at <http://www.armatac.com/products/>, Known as early as Nov. 2015.
"SGM Tactical Glock Drum Magazine 9mm Luger 50 Rounds Polymer Black SGMTG1750D", Cheaper Than Dirt, 5 pages, online available at <http://www.cheaperthandirt.mm/product/2-MGSGMTG1750D>, Known as early as Nov. 2015.
"Sidewinder VenomTM Magazines", Adaptavie Tactical, 3 pages, online available at <http://www.adaptivetactical.com/products/venom-10rndrotary-magazine.php>, Known as early as Nov. 2015.
"T14KT 100 Round Drum Magazine", Auto-Ordance, 2 pages, online available at <https://www.auto-ordnance.com/Long-Gun-Magazines/Thompson-T14KT-100-Round-Drum-Magazine.asp>, Known as early as Nov. 2015.
"Type 95 and 97 (Qbb-95 and Qbb-97) Light Machine Guns (China)", World Guns, 8 pages, online avilable at <http://worid.guns.ru/machine/ch/type-95-Img-e.html>, Known as early as Nov. 2015.
"X-15 Ar 15 High Capacity Magazine", X Products, 9 pages, online available at <http://www.xproducts.com/high-quality-extremely-durable-fully-encased-alloy-50-round-drum--Magazine-for-the-ar15-ar-15>, Known as early as Nov. 2015.
European Search Report received for European Patent Application Serial No. EP19182510 dated Oct. 3, 2019, 7 pages.
Extended European Search Report received for European Patent Application Serial No. 15850706.1 dated Feb. 7, 2018, 11 pages.
Final Office Action received for U.S. Appl. No. 15/354,492, dated Sep. 11, 2018, 41 pages.
First Office Action received for Chinese Patent Application Serial No. 201711271837.X dated May 22, 2019, 14 pages.
International Preliminary Report on Patentability received for International PCT Application Serial No. PCT/US2015/055361 dated Jun. 18, 2017, 9 pages.
International Search Report and Written Opinion received for International PCT Application Serial No. PCT/US15/55361 dated Apr. 21, 2016, 14 pages.
Non Final Office Action received for U.S. Appl. No. 14/882,151 dated Apr. 13, 2016, 26 pages.
Non-Final Office Action received for U.S. Appl. No. 15/354,492, dated Mar. 7, 2018, 47 pages.
Non-Final Office Action received for U.S. Appl. No. 16/811,835 dated Dec. 23, 2020, 40 pages.
Non-Final Office Action received for U.S. Appl. No. 17/369,608, dated Oct. 3, 2022, 56 pages.
Notice of Allowance received for U.S. Appl. No. 14/882,151 dated Oct. 4, 2016, 28 pages.
Notice of Allowance received for U.S. Appl. No. 15/354,492 dated Oct. 30, 2018, 37 pages.
Notice of Allowance received for U.S. Appl. No. 16/200,978 dated Feb. 3, 2020, 50 pages.
Notice of Allowance received for U.S. Appl. No. 16/811,835 dated Apr. 7, 2021, 33 pages.
Notice of Allowance received for U.S. Appl. No. 17/369,608 dated Feb. 15, 2023, 39 pages.
Notice of Ground for Rejection received for Korean Patent Application Serial No. 1020177006021 dated Apr. 14, 2018, 14 pages.
Office Action received for Chinese Patent Application Serial No. 201580024249.9 dated May 27, 2017, 9 pages (Original Copy only).
Office Action received for Russian Patent Application Serial No. 2016129530 dated Apr. 25, 2018, 7 pages (Original Copy only).
Partial Supplementary European Search Report received for European Patent Application Serial No. 15850706.1 dated Sep. 20, 2017, 8 pages.
Requirement for Restriction received for U.S. Appl. No. 14/882,151, dated Dec. 4, 2015, 5 pages.
Requirement for Restriction received for U.S. Appl. No. 14/882,151, dated Jul. 22, 2016, 6 pages.
Requirement for Restriction received for U.S. Appl. No. 14/882,151, dated Mar. 17, 2016, 5 pages.
Requirement for Restriction received for U.S. Appl. No. 15/354,492, dated Dec. 27, 2017, 7 pages.
Response filed on Jul. 19, 2017 for Office Action of Chinese Patent Application Serial No. 201580024249.9 Mail received dated May 27, 2017, 10 pages.
Response filed on Jun. 14, 2018 for Korean Patent Application Serial No. 1020177006021, 131 pages (Original Copy only).
Response filed on Mar. 28, 2018 for Communication Pursuant to Rule 70(2) EPC of European Patent Application Serial No. 15850706.1 Mail received dated Feb. 23, 2018, 13 pages.
Response filed on Mar. 31, 2021 for Office Action of U.S. Appl. No. 16/811,835 Mail received dated Dec. 23, 2020, 8 pages.
Response filed on May 5, 2016 for Non Final Office Action of U.S. Appl. No. 14/882,151 Mail received dated Apr. 13, 2016, 14 pages.

* cited by examiner

DRUM MAGAZINE ASSEMBLY AND METHODS

CROSS-REFERENCE TO RELATED APPLICATIONS

This application is a continuation of U.S. patent application Ser. No. 17/369,608 filed Jul. 7, 2021 and entitled "DRUM MAGAZINE ASSEMBLY AND METHODS," pending, which is a continuation of U.S. patent application Ser. No. 16/811,835 filed Mar. 6, 2020 and entitled "DRUM MAGAZINE ASSEMBLY AND METHODS," and issued as U.S. Pat. No. 11,085,718 on Aug. 10, 2021, which is a continuation of U.S. patent application Ser. No. 16/200,978 filed Nov. 27, 2018 and entitled "DRUM MAGAZINE ASSEMBLY AND METHODS" and issued as U.S. Pat. No. 10,677,550 on Jun. 9, 2020, which is a continuation of U.S. patent application Ser. No. 15/354,492 filed Nov. 17, 2016 entitled "DRUM MAGAZINE ASSEMBLY AND METHODS" and issued as U.S. Pat. No. 10,184,741 on Jan. 22, 2019, which is a continuation of U.S. patent application Ser. No. 14/882,151 filed Oct. 13, 2015 entitled "DRUM MAGAZINE ASSEMBLY AND METHODS" and issued as U.S. Pat. No. 9,528,784 on Dec. 27, 2016, which claims priority to U.S. Provisional Application No. 62/063,546 filed Oct. 14, 2014 and entitled "DRUM MAGAZINE ASSEMBLY AND METHODS," the entire disclosures of which are hereby incorporated by reference for all proper purposes.

COPYRIGHT

A portion of the disclosure of this patent document contains material that is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates to firearms, and, more specifically, magazines for firearms.

BACKGROUND OF THE INVENTION

Ammunition magazines, and, more particularly, drum magazines, are well known in the art of firearms. An open end, which is the feed portion or feed end, is the portion that interfaces directly with a weapon and is generally attached by way of a feed tower to a drum body. The drum body stores loaded cartridges in a generally spiraled or winding configuration for movement towards the feed tower and feed end. Inside the drum body of some designs, a torsional spring and follower assembly are implemented to guide loaded cartridges towards the feed portion. In use, when one cartridge is expended, the compressed spring releases and pushes the follower and associated ammunition through the winding track and towards the feed end, and the next cartridge is thereby readied. To allow for loading of a drum magazine onto a weapon designed for accepting a stick-type, box magazine, the follower assembly and feed described above provide a kinetic chain for translating torsional force into a linear force when cartridges are moved from the drum body to the feed tower.

In other designs, a compression spring, as opposed to a torsional spring, guides loaded cartridges through a curved track towards a feed portion. In these designs, the track is necessarily limited to a large radius of curvature, resulting in a bulky magazine, as well as an exacerbation of frictional forces due to non-optimal cartridge stacking, and reduction in reliability.

In still other designs, winding of the spring is necessary after loading, meaning the user carries a significant burden with respect to loading and storage. For example, in some designs, after loading, the user must remember to use a main winding key to wind a spring, such as about ten turns, even noting the number of turns as well as remember to not over-wind the spring. Yet, if the user under-winds the spring, the cartridges may not feed correctly, requiring further winding by the user, potentially while in the field. Further, if the user plans to place a loaded drum magazine in storage, the user must remember to wind the spring only partially to prevent setting, and then again remember to fully wind just prior to use. These are just a few examples of the challenges faced by users of these designs.

Prior drum magazines have been manufactured in many different configurations and of different materials. As one example, in currently-available feed towers and drum magazine assemblies, as the magazine approaches the maximum loading capacity, the friction of the cartridges inside the drum does not allow for the spring force to resist the natural tendency of the first cartridge to nose-dive, thus adversely affecting chambering reliability. This diving of the distal tip of a first cartridge may be particularly exacerbated when frictional forces between other cartridges in the magazine and the magazine itself are excessive; that is, the relative strength of the torsional spring relative to the cartridge to be loaded is further reduced. In other examples, friction between the drum magazine and the loaded cartridges can cause jamming or delayed responses as the cartridges are moved through the drum magazine, thus reducing the reliability of the magazine and weapon and adversely affecting the feed rate responsiveness—i.e. the response rate of feeding to the rate of fire.

In still other examples, currently available drum magazines require the use of a "third hand" for loading. Specifically, two hands are required to actually load the magazine, meaning the user must prop the magazine against a wall, table, surface, other firm object, or the user's body, using the user's torso, elbow, leg, etc., to have both hands available for loading. In still other examples, inserting a loaded magazine into a weapon having a closed bolt may cause damage to the cartridges, or prevent the magazine from being inserted correctly, thereby causing misfeeds and/or complete loss or dropping of the magazine from the weapon.

As another example, currently-available magazines exhibit an excessive tolerance in the spacing between the front and rear portions. Although the excessive tolerance is sometimes unintentional, it is often necessary in currently-available designs. For example, and using the .223 Remington cartridge as just one example, manufacturers of currently-available designs must allow for an overall variance in the cartridge length of 0.095 inches, or 2.413 millimeters, which results in less than ideal cartridge travel within the magazine, including excessive friction and indirectly causing excessive noise and rattling while in the field.

Moreover, when a weapon using currently-available designs is fired, the recoil causes the loaded cartridges to hit the front of the magazine. Over time, the front of the magazine begins to develop small craters in the same localized spots. These craters tend to exacerbate the friction between the cartridges and the track, because cartridges must not only overcome inherent friction in the system as designed, but also dig each and every bullet tip of each cartridge out of a corresponding crater. The craters may be even further exacerbated by the use of relatively hard tips, such as in enhanced penetrating or armor-piercing ammunition, as well as the excessive tolerance described above.

Although present magazines and feed towers are functional to varying degrees and reliability, it is desirable to provide a device and/or method with improved reliability, as well as other new and innovative features.

SUMMARY OF THE INVENTION

Exemplary embodiments of the present invention that are shown in the drawings are summarized below. These and other embodiments are more fully described in the Detailed Description section. It is to be understood, however, that there is no intention to limit the invention to the forms described in this Summary of the Invention or in the Detailed Description. One skilled in the art can recognize that there are numerous modifications, equivalents and alternative constructions that fall within the spirit and scope of the invention as expressed in the claims.

In one example, a magazine assembly for a firearm has a magazine housing defining a track, and a follower assembly. The exemplary magazine housing is configured to constrain a cartridge as the cartridge is moved within the magazine assembly such that majority of a proximal surface area of the cartridge does not contact the magazine housing, and a distal tip of the cartridge does not contact the magazine housing.

In another example, a method of constraining a cartridge in a magazine assembly for a firearm includes constraining the cartridge such that (a) a majority of a proximal surface area of the cartridge does not contact a magazine housing; and (b) a distal tip of the cartridge does not contact the magazine housing.

As previously stated, the above-described embodiments and implementations are for illustration purposes only. Numerous other embodiments, implementations, and details of the invention are easily recognized by those of skill in the art from the following descriptions and claims.

BRIEF DESCRIPTION OF THE DRAWINGS

Various objects and advantages and a more complete understanding of the present invention are apparent and more readily appreciated by reference to the following detailed description and to the appended claims when taken in conjunction with the accompanying drawings wherein:

DETAILED DESCRIPTION

Figure 1:
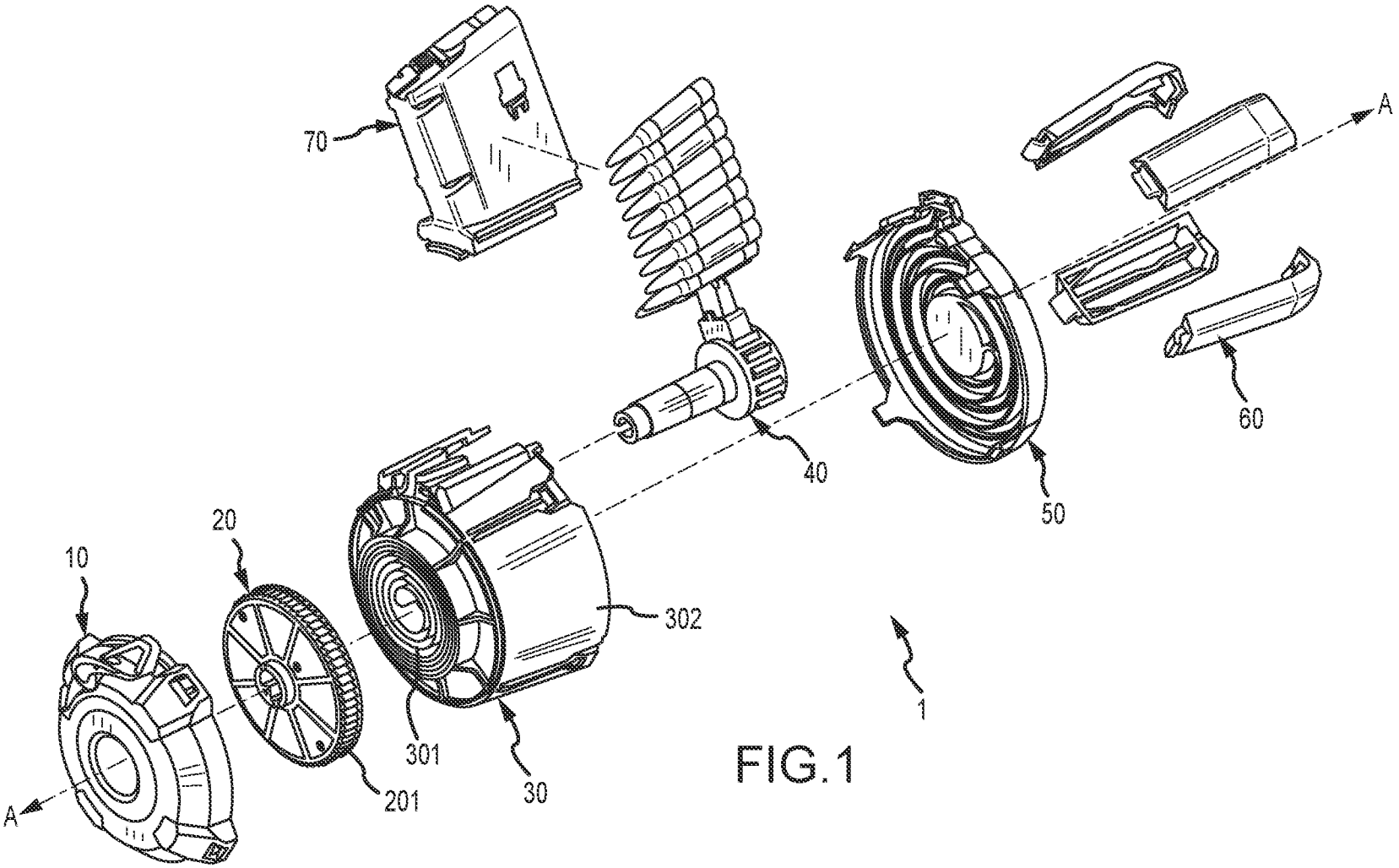
FIG. 1 is an exploded view of a drum magazine assembly according to one embodiment.

Referring now to the drawings, where like or similar elements are designated with identical reference numerals throughout the several views, and referring in particular to FIG. 1, it illustrates an exploded view of an exemplary drum magazine assembly 1 according to one embodiment. The exemplary drum magazine assembly 1 has a front cover assembly 10, a wheel 20, a drum body and spring assembly 30, a follower assembly 40, a rear cover 50, and retainer clips 60.

For the purpose of this document, the terms "front" and "distal" shall refer to a side or direction associated with a direction of intended fire; for example, in FIG. 1, the front or distal side is towards the left. When referencing pivoting or rotating components, the term "distal" shall refer to a section of the component that is distant from the pivot point, while the term "proximal" shall refer to a section of the component approaching the pivot point. For example, the teeth 201 are at a distal region of the wheel 20. Similarly, the terms "back", "rear", or "proximal" shall be associated with the intended bracing of a weapon, or the intended pivot point of a pivoting or rotating component. Further, the term "exemplary" is used herein to mean "serving as an example, instance, or illustration." Any embodiment described herein as "exemplary" is not necessarily to be construed as preferred or advantageous over other embodiments. Moreover, for the purpose of this document, the term "cartridge" should be understood to include generally ammunition that is magazine-fed, such as, for example, shotgun cartridges, grenade cartridges, and any other ammunition packaging a bullet or shot, a propellant substance and a primer within a case that is made to fit within a firing chamber of a firearm.

Figure 2:
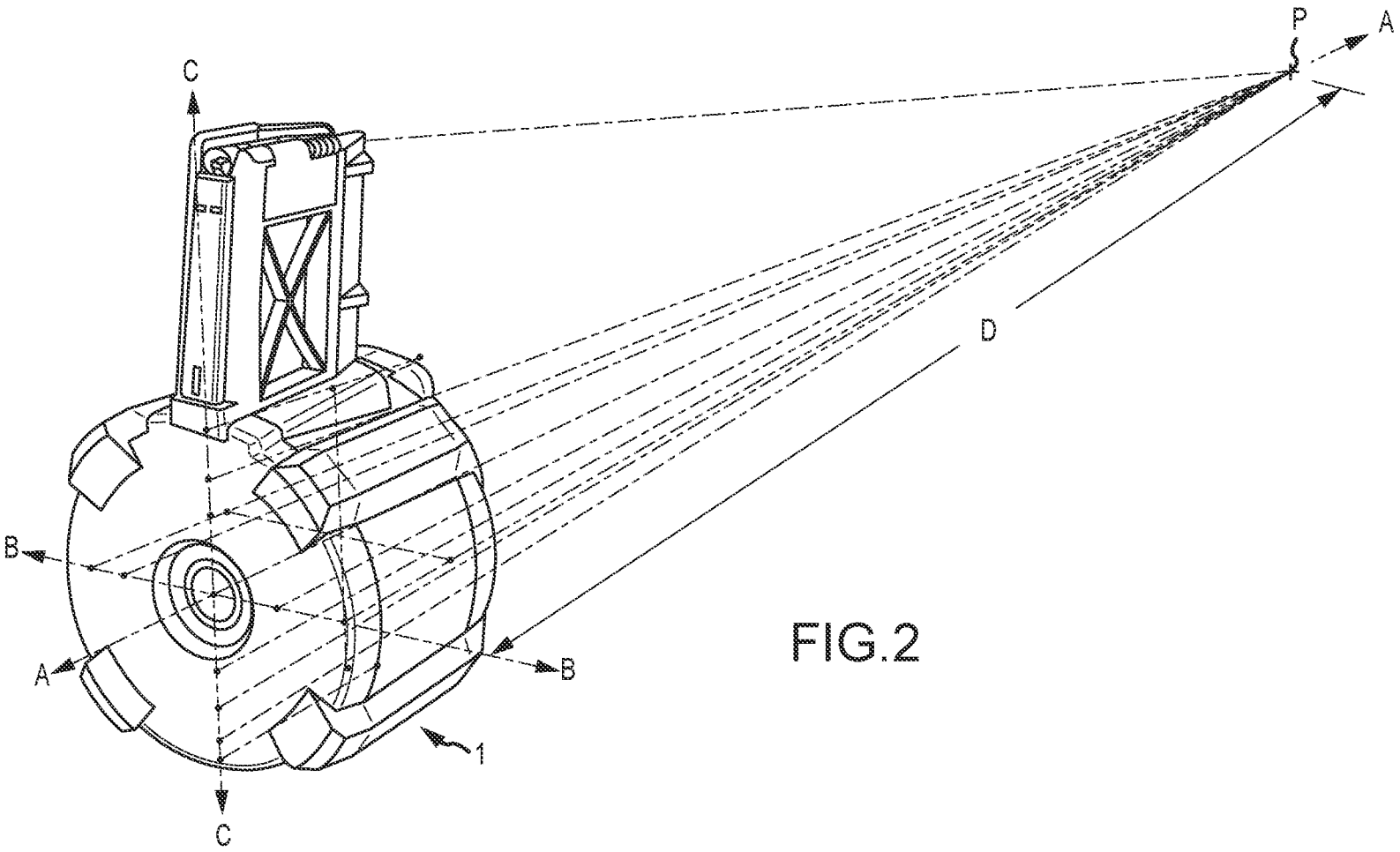
FIG. 2 is a perspective view of the drum magazine assembly in FIG. 1.

As should be apparent from FIG. 1 and FIG. 2, which illustrate an exploded view and a perspective view, respectively, of a drum magazine assembly 1 a feed tower assembly 70 may be coupled to a drum body 302, and retained by a front cover 10. A rear cover 50 may be connected to the drum body assembly 30 and retained thereon by retaining clips 60.

In some embodiments, the drum magazine assembly 1 may be configured to hold 50 to 100 or more cartridges, such as in a single-stack design having a generally spiraled stack configuration inside the drum body 302. It should also be understood that the maximum loading capacity of the drum magazine assembly 1 is dependent on the caliber of ammunition used. For larger sized cartridges, for example, and without limitation, the drum magazine assembly 1 may be configured to hold as little as 35 cartridges at maximum loading capacity. In still other embodiments, the drum magazine assembly 1 may be configured to hold as little as 10 cartridges at maximum loading capacity. These capacities should be considered exemplary only.

Returning to FIG. 1, the drum magazine 1 may have a viewing window on the rear cover 50, with the viewing window extending substantially from a central portion of the rear cover 50 to a distal portion of the rear cover 50. In some embodiments, the viewing window need not necessarily include a transparent cover; instead, the viewing window may comprise an elongated opening in the rear cover 50, or a series of openings which may or may not be covered with a transparent material and/or semi-transparent material. As another example, the rear cover 50 may be manufactured of a transparent or semi-transparent material.

Figure 10A:
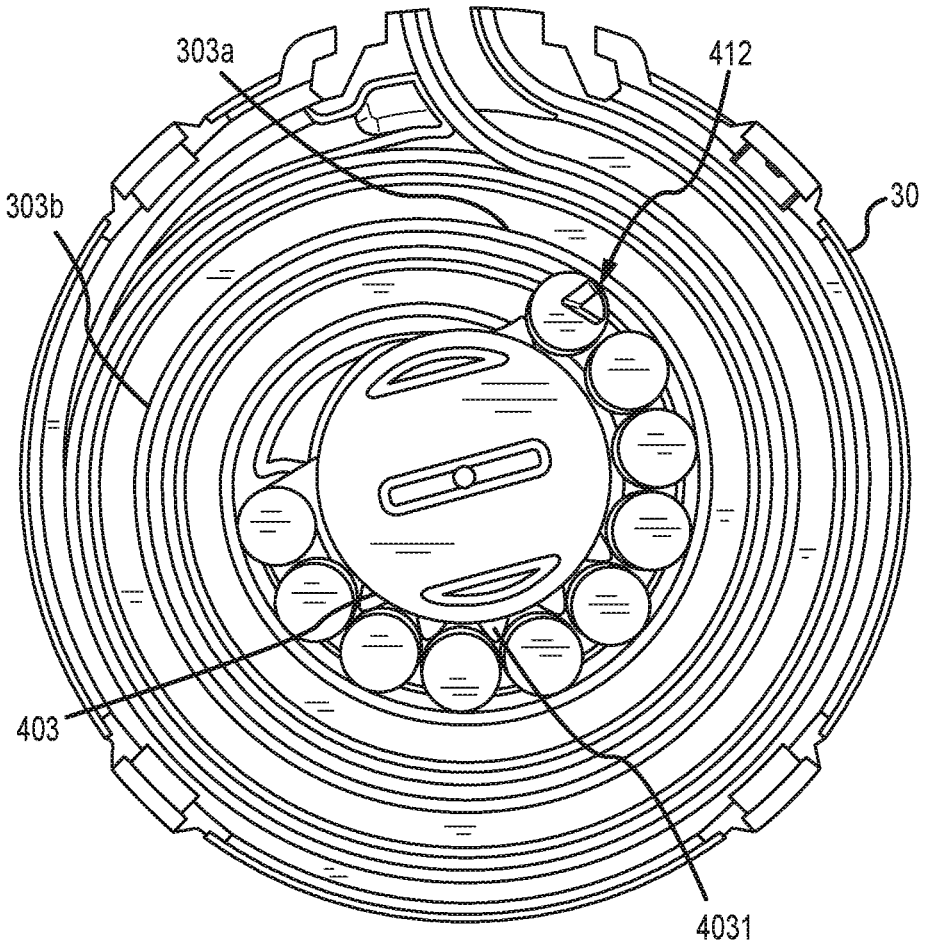
FIGS. 10A-10B are back and back section views illustrating details of the interface between a follower assembly and a drum body according to an embodiment.

For the purpose of this disclosure, the terms "spiral" and "generally spiraled", when used in reference to the stack configuration and/or the winding of the spiral track 303 illustrated in FIG. 10A, are not meant to limit the description to a perfect or near-perfect spiral, or curve that winds around a fixed point at a continuously increasing or decreasing distance. Instead, the terms "spiral" and "generally spiraled" may be used to reference a configuration wherein the track 303 winds around a fixed point at a discontinuously changing distance, as illustrated in FIG. 10A. More specifically, portions 303*a* of the track 303 may be approximately in a straight line, while other portions 303*b* of the track 303 may more closely approximate a concentric circular winding. In still other embodiments, some portions of the track 303 may be approximately in a straight line, while other portions of the track may more closely approximate a true spiral. Taken together, in combination or separately, therefore, the terms "spiral" and "generally spiraled" are meant to include any feature generally winding about a fixed point at a continuously and/or discontinuously increasing distance.

The various components of the drum magazine assembly 1 may be manufactured of suitable polymeric materials, high-strength synthetic materials, composites, ceramics, various metals including aluminum, stainless steel or alloys, or any other material suitable for the intended use with a firearm, and the components may have one or more surface finishes suitable to minimizing friction between certain moving parts, which will be discussed in further detail below, as well as an external profile suitable for handling.

Turning now to FIG. 2, it can be seen that the drum magazine assembly 1 may be designed such that a focal point of each cartridge substantially converges at a single point P at a distance D from the drum magazine assembly 1. For the purpose of this application, substantial convergence should be understood to mean bringing the convergence within reasonable manufacturing tolerances. This substantial convergence allows for more optimal stacking of the cartridges, thus distributing forces across each cartridge case, and improving stack consistency and feeding. Moreover, the substantial convergence allows the cartridges to pass more smoothly through the drum magazine assembly 1 to the loading chamber as compared to a drum assembly not having the substantially converging focal point. It should be noted that the point P is defined by the conical apex of the multiple cartridges, or the length of taper of each cartridge case; that is, the distance D would be greater for cartridges designed with a slight taper than for cartridges designed with a more extreme taper.

Also shown in FIGS. 1-2 is a first pivot axis A of an embodiment. As will be more apparent with brief reference to FIG. 8B and FIG. 1, axis A is approximately defined by the spindle 403 of the follower assembly 40. The wheel 20 and arm 106 may also be configured to pivot about axis A.

Figure 3:
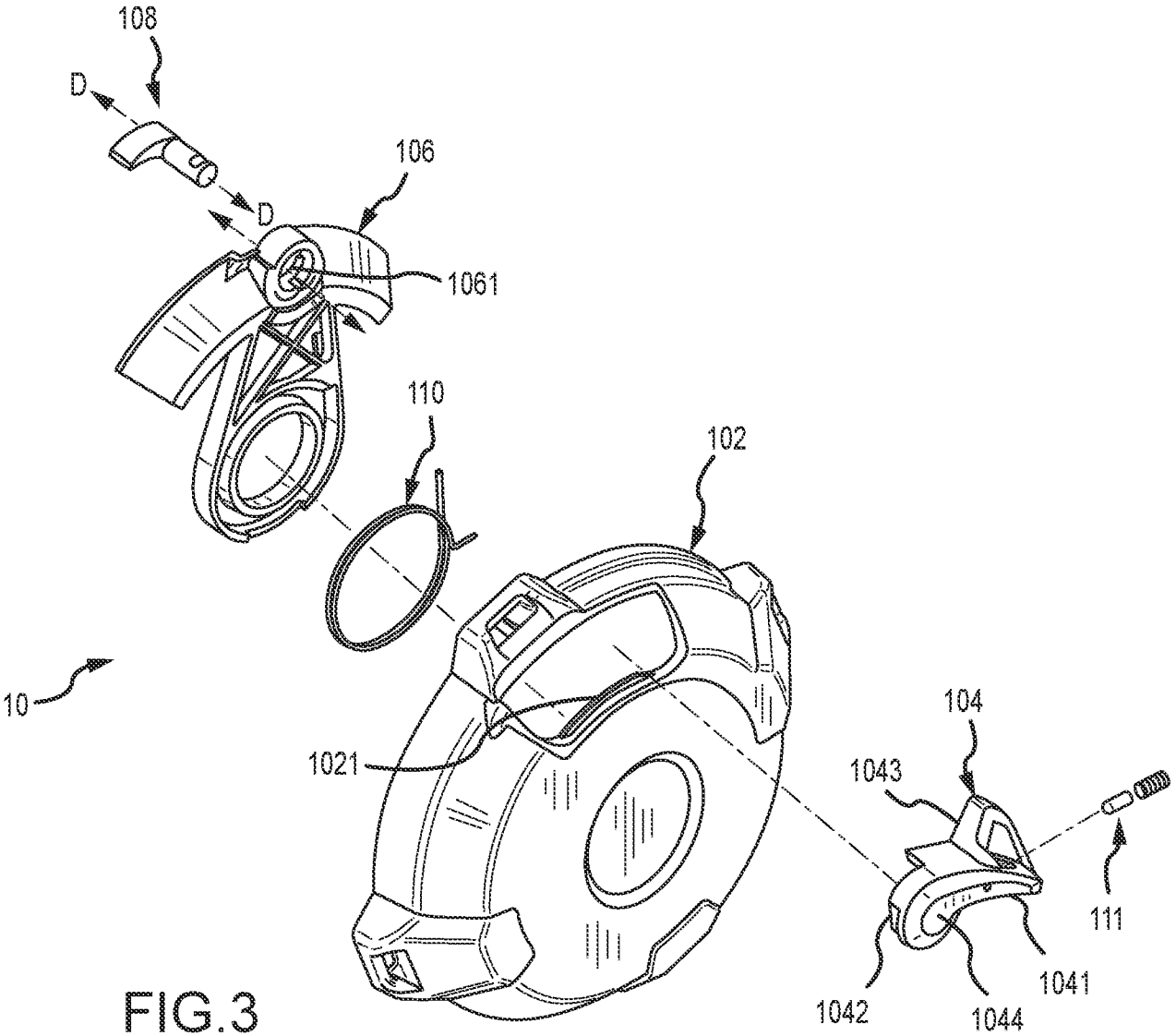
FIG. 3 is an exploded view of a front cover assembly according to an embodiment.
Figure 4B:
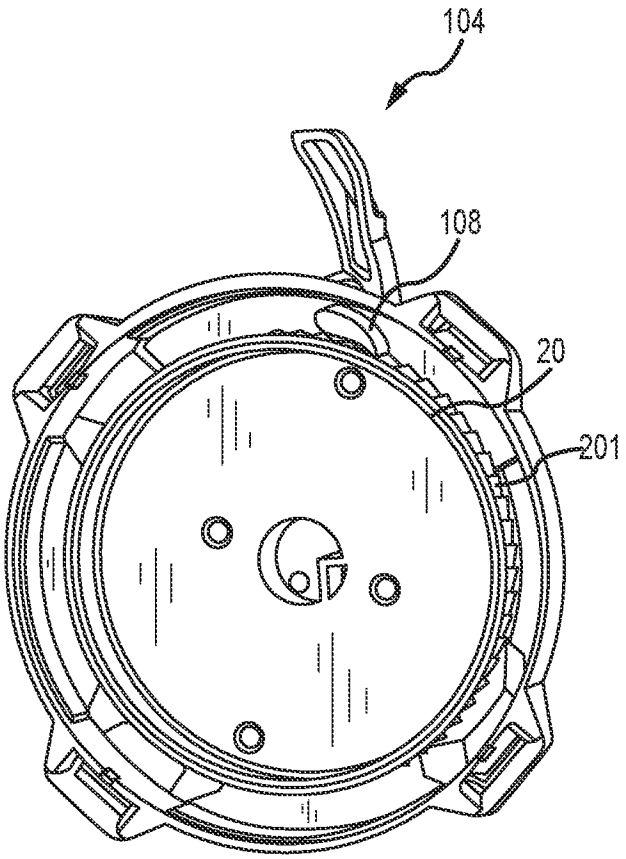
FIG. 4B is a back view of the wheel and front cover assembly according to an embodiment.
Figure 4A:
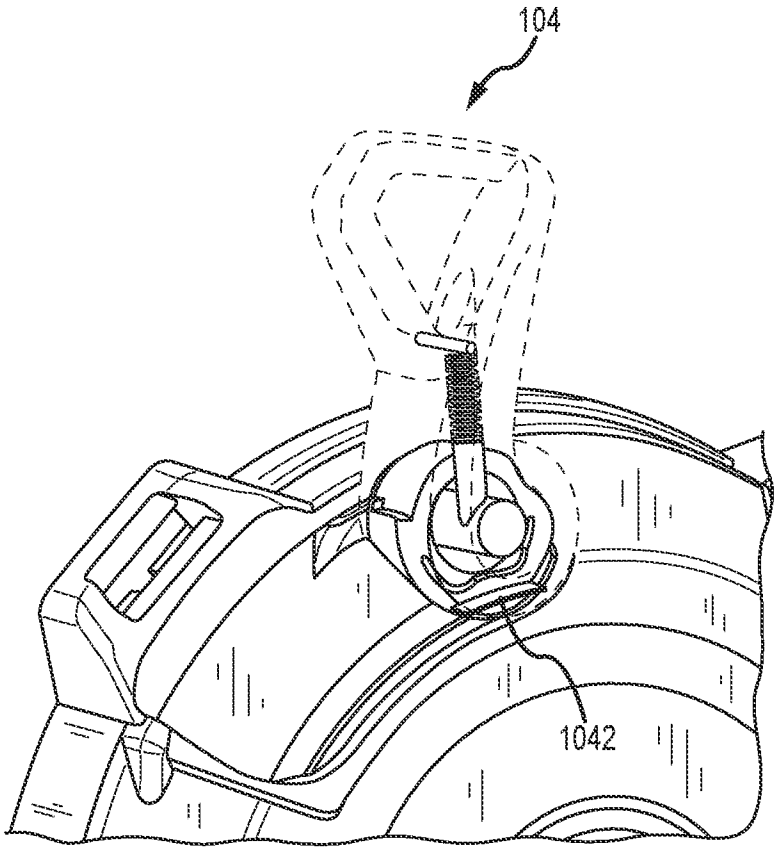
FIG. 4A is a perspective view showing an interface between a lever and front cover assembly according to an embodiment.

Turning now to FIG. 3, the front cover assembly 10 is now discussed. The front cover assembly 10 may have a front cover 102, a lever 104, an arm 106, and a pawl 108. A return spring 110 may also be included in the front cover assembly 10. The front cover assembly 10 may provide several functions. First, the front cover 102 may provide the wheel 20 and the interface between the wheel and other moving components some protection from excessive impacts or other rough handling while in use. The front cover assembly 10 including an advancing mechanism or arm 106 and lever 104 assembly may also provide for an increased moment arm for the user, as compared to turning the wheel 20 without the front cover assembly 10. However, it should be understood that the drum magazine assembly 1 is a fully functional assembly even when the front cover assembly 10 is not present; that is, a user could turn the wheel 20 by hand to insert cartridges.

Nonetheless, the front cover assembly 10 may be included to provide an advancing mechanism, which may include a lever 104, an arm 106, and a pawl 108 assembly configured to enable a user to retract a spring 301 while loading cartridges. More specifically, an advancing mechanism or process may include the components and steps required to extend or rotate a lever 104 to increase a moment arm, turn a wheel 20, load cartridges, and release a lever 104 while returning. Rotating the lever 104 also adds the advantage that one can hold the lever 104, and thus reduce spring pressure, while loading cartridges. The arm return spring 110 may be provided to ensure the arm 106 is returned to and/or remains biased towards a starting position after each advancing motion. The advancing mechanism may be configured to advance the wheel 20 such that one or more cartridges may be loaded after advancing the wheel 20. With the advancing mechanism, the magazine can be more easily loaded without having to release spring tension due to the loading process. Therefore, the spring 301 does not have to be wound after loading, thus improving cartridge feed consistency, weapon reliability, and safety. The spring 301 is also configured such that an outermost end is fixed relative to the drum body 302, while the innermost end rotates. It should also be understood that for the purpose of this document, the term "advance" may include both linear and rotational movement. For example, advancing a wheel includes rotating the wheel, while advancing a follower assembly may include causing a follower assembly to travel in a generally spiraled path such as through a spiral track or in a generally straight path, such as through a feed tower.

Continuing with FIG. 3, with brief references to FIGS. 4A-6C, the lever 104 is generally positioned near the outer diameter of the front cover 102, and is configured cause a pawl 108 to selectively engage the wheel 20. In turn, the wheel 20 may engage the spindle 403 of the follower assembly 40, seen in FIG. 8B, to retract the spring and follower assembly 40 for loading cartridges. The advancing mechanism including a pawl 108 and lever 104 generally increases the moment arm applied to the spindle 403 when the lever 104 is used, thus improving the ease of use of the drum magazine assembly 1.

Figure 6A:
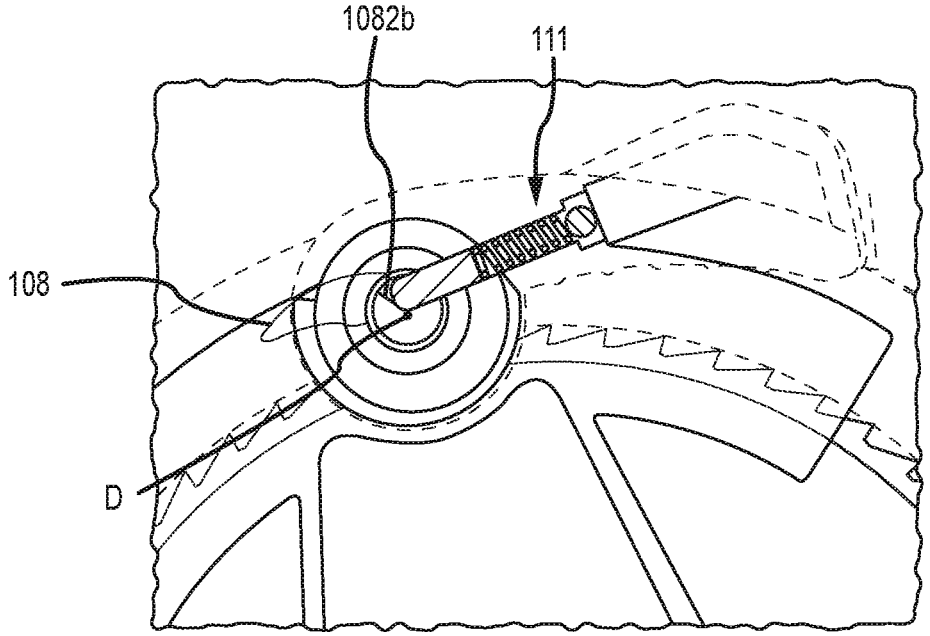
FIG. 6A is a section view of the drum magazine assembly showing an interface between the lever and pawl according to an embodiment.
Figure 6B:
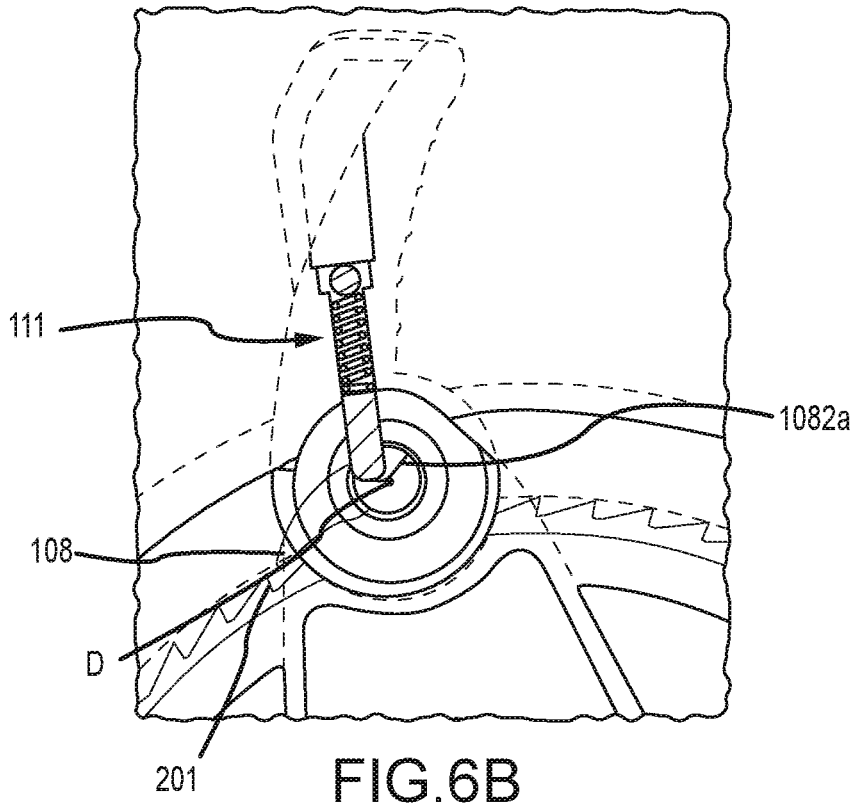
FIG. 6B is another section view of the interface shown in FIG. 6A.

The lever 104 itself may have a grip 1041 attached to a pivot body 1044; the lever 104 may also have an advancement lock feature having a clearance groove 1042 in the pivot body 1044, and/or a lever lock 1043. The pivot body 1044 is configured to rotate about axis D, shown in FIG. 3, such as within a passage 1061 of the arm 106, and to cause the pawl 108 to engage the wheel 20 for retracting the spring; this interface will be discussed further below. The grip 1041 is configured to allow a user to grasp and rotate the lever 104 relative to the arm 106. With this motion, the lever 104 is moved from a biased closed position as shown in FIG. 6A to an open position, as shown in FIG. 6B. Moving the lever 104 to the open position increases the length of the moment arm, and hence the torque to be applied, to the spindle 403. It should be understood that, although movement is shown in the figures as being achieved using a rotating mechanism, movement can be achieved in some embodiments using a telescoping motion.

The advancement lock feature, including the groove 1042 and locking ridge 1021, may be provided to increase reliability in the use of the magazine. Specifically, when the lever 104 is in the biased closed position, as in FIG. 6A, the groove 1042 is rotated away from a locking ridge 1021 in the front cover 102, causing the pivot body 1044 to abut the locking ridge 1021 should one attempt to operate the lever 104 when the lever 104 is closed.

As can be further seen in FIGS. 6A-6B, the pawl 108 is configured to rotate about axis D between a free position, shown in FIG. 6A, and an advance position, shown in FIG. 6B. When in the advance position, the pawl 108 is configured to engage a tooth 201 at the distal region of the wheel 20. Placing the teeth 201 at the distal region, and more specifically at the distal face, as opposed to a face perpendicular to axis A, of the wheel 20 improves the transfer of advancing forces between the pawl 108 and the wheel 20, as well as the reliability and life of the wheel 20 itself. The teeth 201 may be directional, as shown in FIGS. 6A-6B, to allow an engagement only in a desired direction. The pawl 108 may be biased towards the free position when the lever 104 is in the closed position, and the pawl 108 may be biased to the advance position when the lever 104 is in the open position.

Figure 5B:
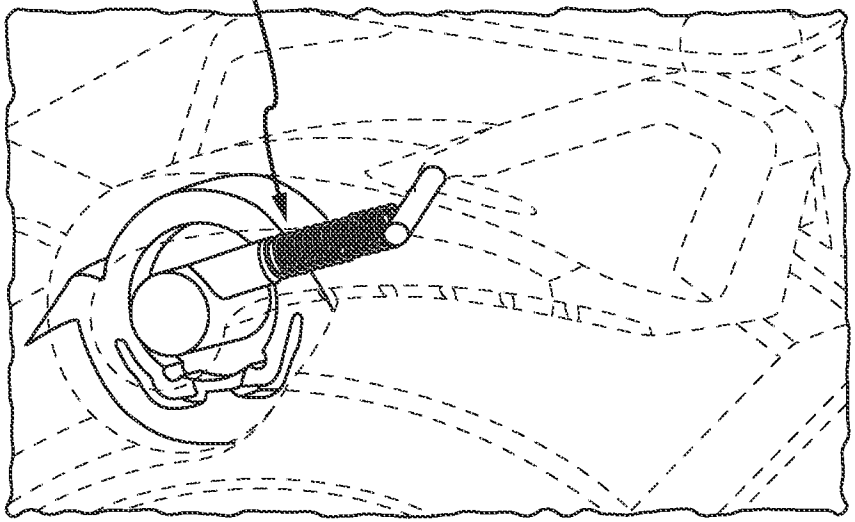
FIG. 5B is a perspective internal view illustrating a pawl pin assembly according to an embodiment.
Figure 5A:
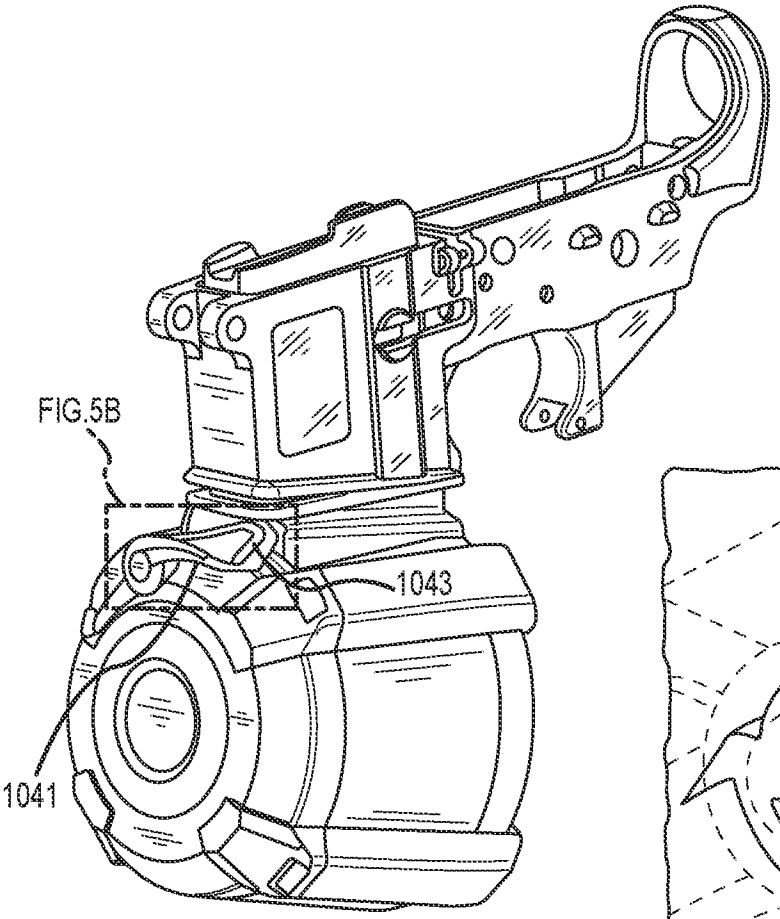
FIG. 5A is a rear perspective view of a drum magazine assembly inserted in a weapon component.

Turning briefly to FIG. 5, it can be seen that the lever lock 1043 may be configured to prevent the lever 104 from being opened when the drum magazine assembly 1 is installed in a weapon. This lever lock 1043 prevents accidental activation of the lever 104, especially when the magazine 1 is being used as a weapon-stabilizing support, or is being used in an environment in which branches, debris, load bearing equipment, or the operator could inadvertently entangle or push on the lever 104.

Returning to FIG. 3, the lever lock 1043 of the lever 104 may be configured to operate with a variety of weapons. Further, although the lever lock 1043 is depicted as having a particular profile or shape, it is contemplated that the lever lock 1043 include any shape suitable for the purpose of preventing the lever 104 from being opened when the magazine assembly 1 is installed in a weapon. As just one example, the lever lock 1043 depicted in FIG. 3 does not have the same profile as the lever lock 1043 depicted in FIG. 5, yet the function is the same. As another example, the lever lock 1043 could comprise a latch safety, catch, or any other feature, as an alternative to, or in addition to, a blocking mechanism, to prevent the lever 104 from being activated when the magazine 1 is used.

Returning now to FIGS. 4A and 4B, the pawl 108 is now discussed in more detail. As previously discussed, the lever 104 is configured to rotate the pawl 108. When the lever 104 is in the closed position, the pawl 108 is blocked from engaging the wheel 20. When the lever 104 is opened, the pawl 108 may be caused to rotate until it contacts the wheel 20. In some embodiments, opening the lever 104 allows the pawl 108 to rotate until it contacts the wheel 20 through a biasing spring force. More specifically, both the lever 104 and the pawl 108 are configured to rotate about a second axis D, with axis D being defined relative to a distal portion of the arm 106, which may be a passage 1061 of the arm 106.

Figure 6C:
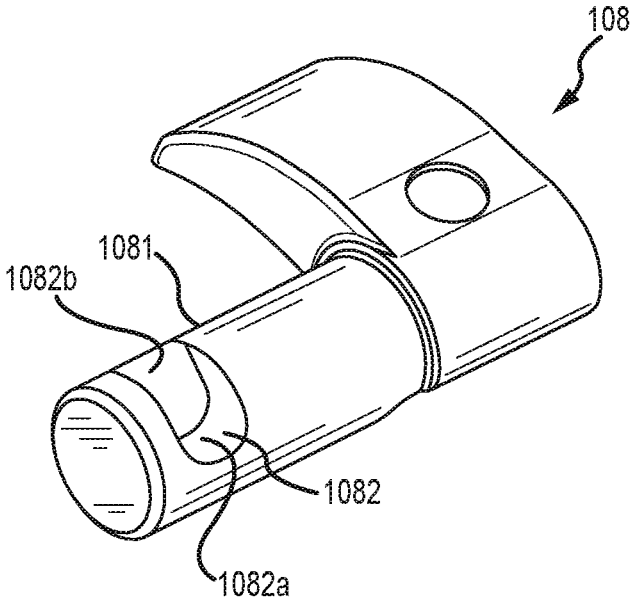
FIG. 6C is a perspective view of the pawl shown in FIGS. 6A-6B.

As seen in FIG. 6A-6C, the pawl 108 may have a shaft 1081 configured to pass through or partially through the passage 1061 of the arm 106. The pawl 108 can be engaged by the lever 104 at a notch 1082 in the shaft 1081. Specifically, a pawl pin assembly 111 having a pin and a biasing spring and positioned within the lever 104 may bottom out on a first side 1082*a* of the notch 1082, thus causing the pawl 108 to rotate away from the wheel 20 when the lever 104 is in the closed position. When the lever 104 is opened, the pawl pin assembly 111 is configured to push against the other side 1082*b* of the notch 1082, thus allowing the pawl to advance over the teeth of the wheel 20, or engage the teeth 201 in a ratcheting configuration. Due to a spring assembly, the pawl pin assembly 111 causes the pawl 108 to be biased against the wheel 20 when the lever 104 is in the open position, thus ensuring the pawl 108 engages the teeth 201 of the wheel 20 when the lever 104 is being operated.

Figure 7A:
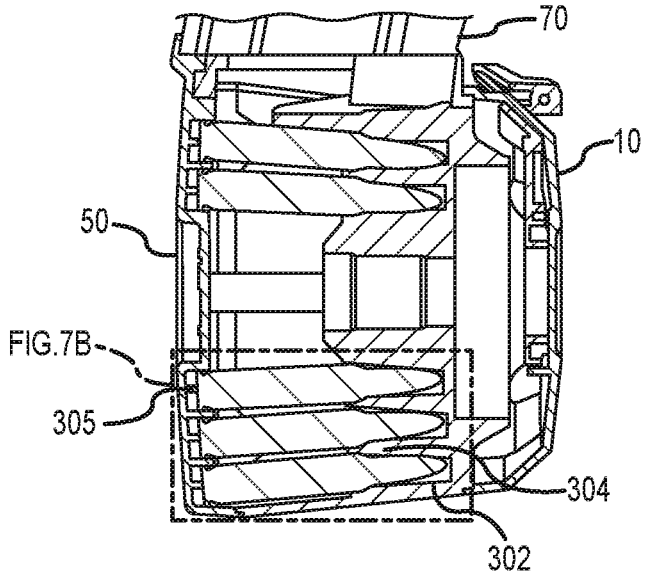
FIG. 7A is a side section view of a drum magazine assembly according to an embodiment.
Figure 7B:
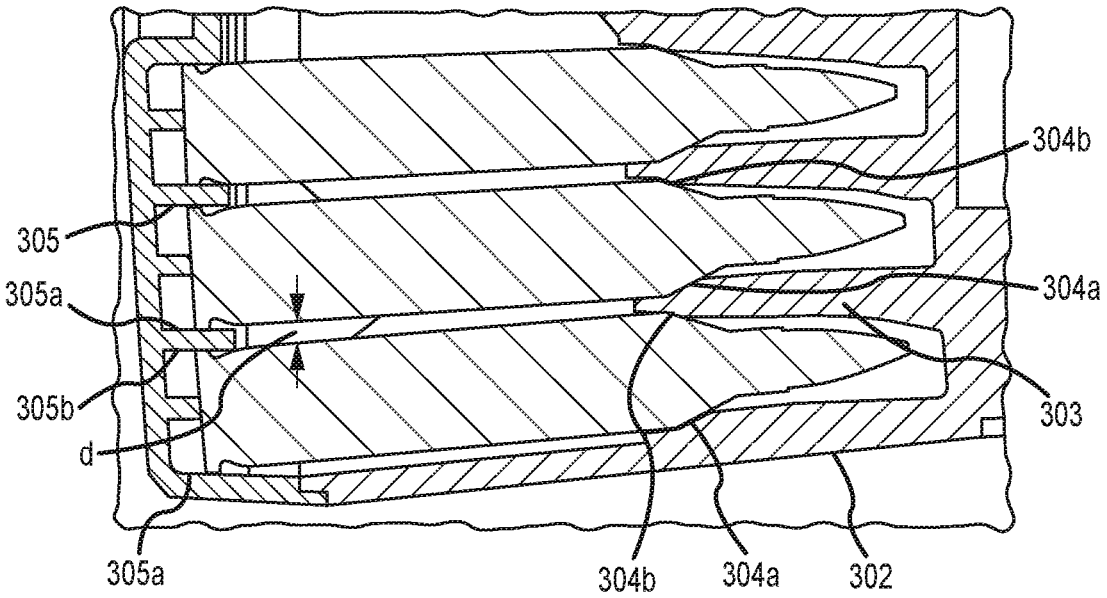
FIG. 7B is a detailed view of components in the embodiment in FIG. 7A.
Figure 7C:
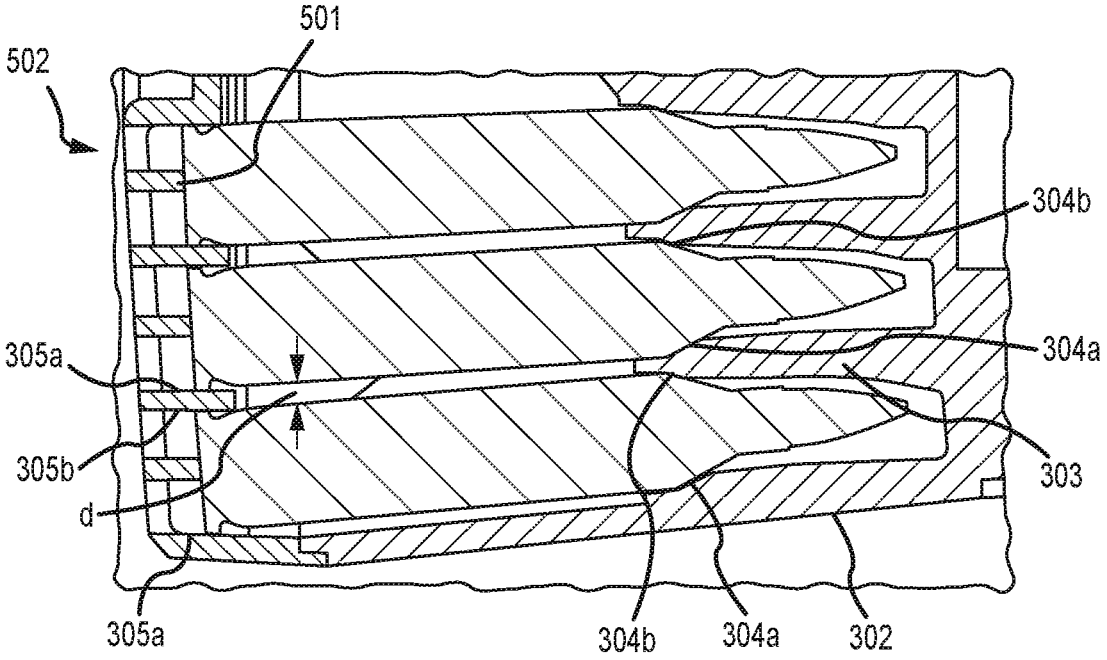
FIG. 7C is a detailed view of an alternative embodiments of the components in FIG. 7A.

Turning now to FIGS. 7A-7C, the drum body and spring assembly 30, and interface between the cartridges and the drum magazine assembly 1, are now discussed in more detail. As previously mentioned, the drum body 302 and the drum magazine assembly 1 may be configured such that a focal point of each cartridge, regardless of where the cartridges are located in the drum magazine assembly 1, substantially converges at a single point P at a distance D from the drum magazine assembly 1. This is achieved in part by including a curvature to the rear cover 50, as well as a curvature to the spiral track 303. The curvature in the spiral track 303 may be in conjunction with an abutment 304.

The abutment 304 may be configured to provide an abutment for the respective cases of the cartridges as they travel through the spiral track 303, as seen in FIGS. 7A-7C. Specifically, the abutment 304 is configured to abut a portion of a cartridge case, such as the necked-down portion of a cartridge case when necked-down style cartridges are used (as shown). It should be understood, however, that even where necked-down cartridges are not used, the abutment 304 may still be employed to abut a portion of a cartridge case, such as at a crimped portion of a case, or a rim of a cartridge case, or at any other ledge or shoulder feature consistently found in currently-available or future cartridge cases. That is, the abutment 304 is to be understood as abutting a portion of the case, not the tip or bullet, of a cartridge. Configuring the abutment 304 to abut the distal portion of the cartridge case provides a significant advantage. As previously discussed in the background of this document, it was noted that the tolerance in the overall length of a .223 Remington cartridge is 0.095 inches. However, the tolerance in the distance between the cartridge case head and the shoulder datum is just 0.007 inches. Therefore, configuring the abutment 304 to abut a portion of a cartridge case, instead of the bullet tip allows the magazine assembly 1 to be manufactured to a much tighter tolerance—well over an order of magnitude difference tighter—so that cartridges are allowed to travel through the track smoothly, without jamming and with less friction, thus improving the overall reliability of the weapon. It should be understood that the use of a .223 Remington cartridge is by way of example only, without limitation. Moreover, the discussion above relates to cartridges generally, because the cartridge case is used to control positioning of the cartridge in the weapon chamber, as well as headspace, and is manufactured to a tighter tolerance than the overall length.

Continuing with FIGS. 7A-7C, the abutment 304 may be configured such with an outer chamfer 304*a* and an inner chamfer 304*b*, with the inner chamfer 304*b* not necessarily providing an equal contact surface area as compared to the outer chamfer 304*a*. That is, the abutment 304 may account for the curvature of the spiral track 303, both to prevent the distal end of the cartridges from touching the front of the drum body 302 and to ensure the focal point P of all cartridges is maintained at about the same distance d as the cartridges travel through the drum magazine assembly 1.

Moreover, in some embodiments, the length and angle of the outer chamfer 304*a* may change between an innermost portion of the spiral track 303 and an outermost portion of the spiral track 303. Similarly, the length and angle of the inner chamfer 304*b* may change between an innermost portion of the spiral track 303 and an outermost portion of the spiral track 303. This change in length and angle of the respective chamfers 304*a*, 304*b* may assist in maintaining the focal point P of the cartridges at about the same distance D as the cartridges travel through the drum magazine assembly 1, and, in turn, reduce friction as the cartridges travel.

Continuing with FIGS. 7A-7C, it can be seen that the spiral track 303 may include a proximal abutment mechanism, which may have an outer abutting side 305*a*, an inner abutting side 305*b*, and a track ridge 501. Like with the abutment 304, the proximal abutment mechanism may be configured to prevent the majority of surface area of the proximal end of the cartridges from touching the rear cover 50. The proximal abutment mechanism including abutting sides 305*a*, 305*b* and track ridge 501 may further be configured to assist in controlling the focal point P of each cartridge as it travels through the spiral track 303.

As seen in FIG. 7C, the track ridge 501 further allows the rear cover 50 to be manufactured with a viewing window that does not include a transparent cover, because cartridges passing through the spiral track cannot get hung up at the viewing window. This provides the further advantage that the magazine assembly 1 has a mechanism for directing debris into non-critical areas, such as between track ridge 501 and abutting sides 305*a*, 305*b*, instead of increasing undesirable friction between cartridges or the follower assembly 40 and the drum body assembly 30.

Figure 8A:
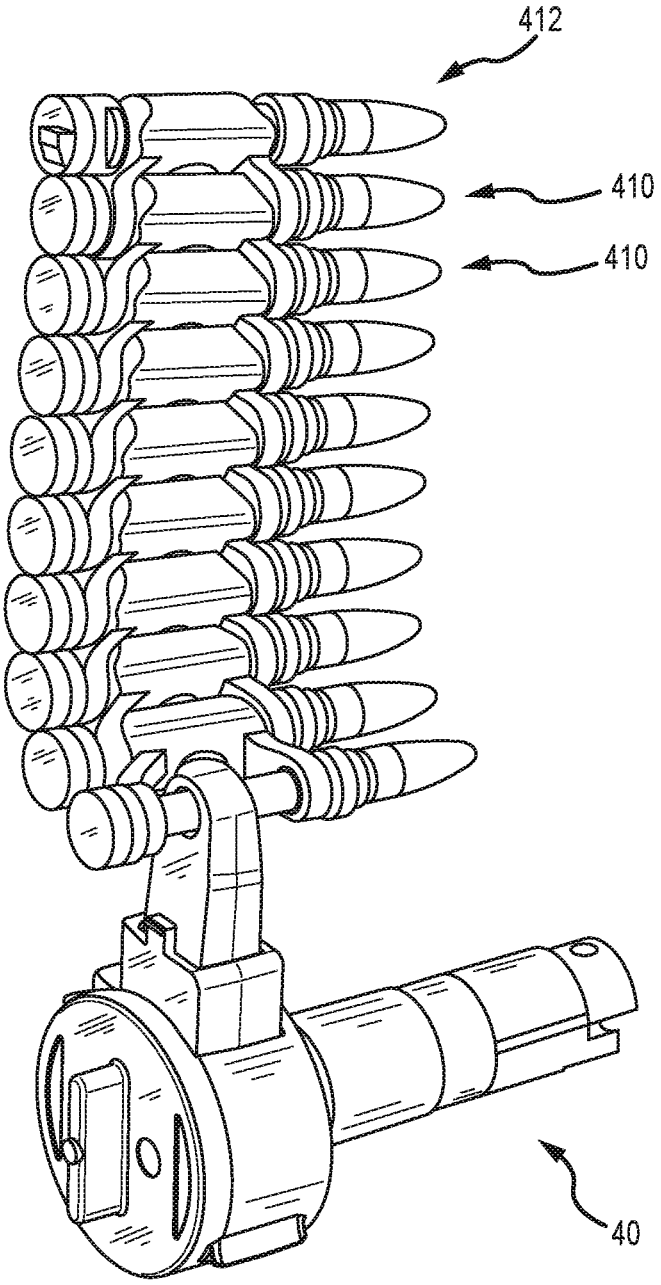
FIGS. 8A-8B are views of a follower assembly assembled and exploded, according to an embodiment.
Figure 8B:
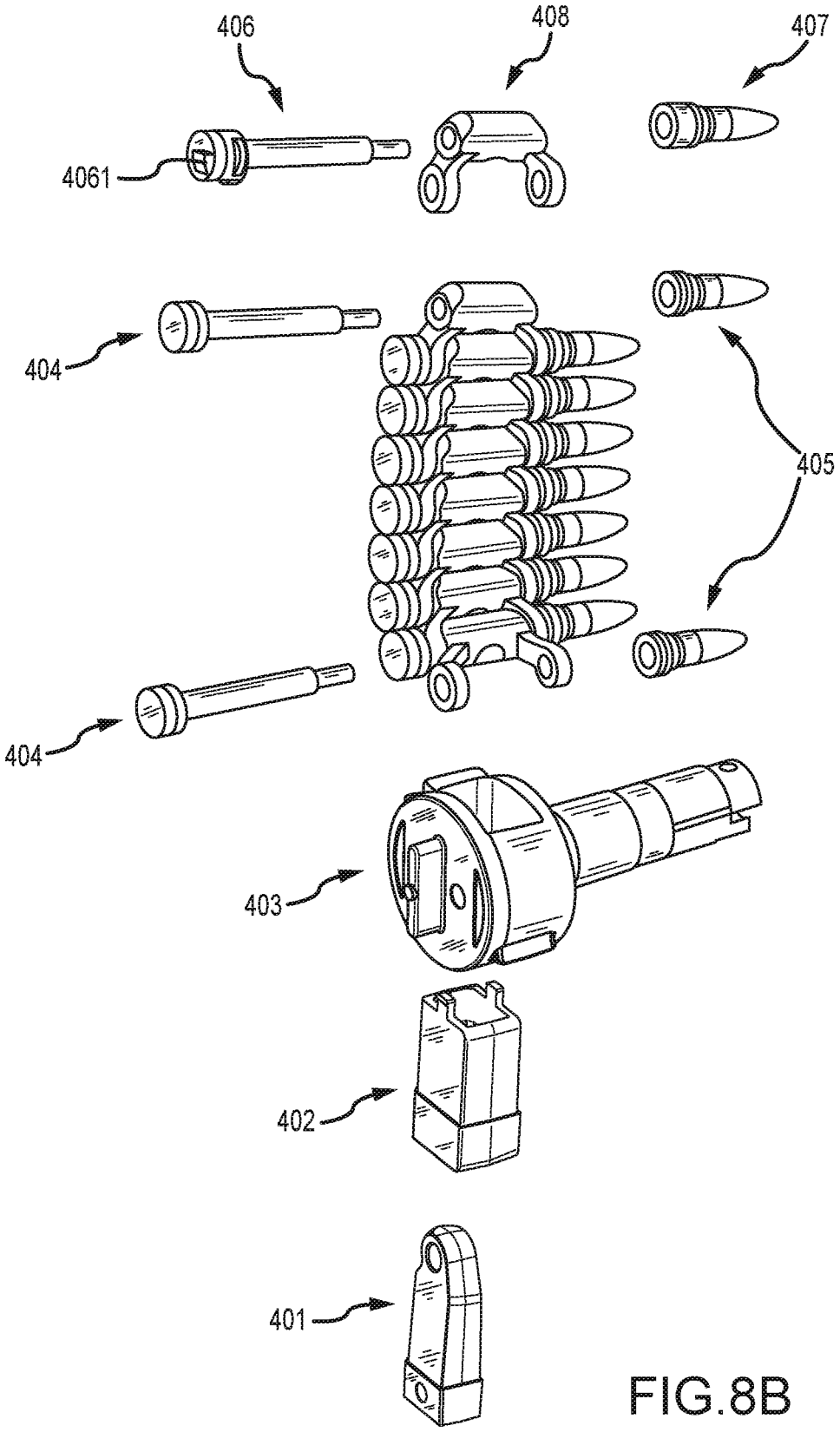

Turning now to FIGS. 8A and 8B, the follower assembly 40 is discussed in detail. The follower assembly 40 may have an inner spindle slider 401, an outer spindle slider 402 a spindle 403, a plurality of follower dummy rollers 404, a plurality of follower dummies 405, a leading follower dummy roller 406, a leading follower dummy 407, and a plurality of follower links 408, or links 408 for short. For ease of reference, the term dummy cartridge 410 may be used in this document to reference a combination of a follower dummy roller 404 and a follower dummy 405. The terms first dummy cartridge 412 or leading dummy cartridge 412 may be used to reference the combination of the leading follower dummy roller 406 and the leading follower dummy 407.

In some embodiments, one or more of the follower dummy rollers 404 may rotate relative to the respective follower dummies 405, which may also rotate relative to the spiral track 303. That is, a front portion of a dummy cartridge 410 may rotate relative to a rear portion of a dummy cartridge 410. Similarly, a front portion of a leading dummy cartridge 412 may rotate relative to a rear portion of a leading dummy cartridge 412. Allowing the front and rear portions of dummy cartridges 410, 412 to rotate relative to each other as they pass through the spiral track 303 further minimizes the frictional forces between the follower assembly 40 and the drum body assembly 30.

The follower assembly 40 may include a sufficient number of dummy cartridges 410 so as to ensure that, when fully extended, the feed tower assembly 70 is approximately filled with the dummy cartridges 410 including the first dummy cartridge 412. Filling the feed tower assembly 70 with the dummy cartridges 410 allows the torsional spring 301 to apply a linear force on the cartridge stack through the feed tower, eliminating the need for a mechanical pusher arm. As will be understood by those skilled in the art, the overall purpose of the follower assembly 40 is to maintain loaded cartridges or the first dummy cartridge 412 biased towards a feed lip of the feed tower assembly 70. Each crank action of the lever 104 causes the follower assembly 40 to retract enough to allow at least one cartridge to be loaded. However, the follower assembly 40 may retract enough to allow two or more cartridges to be loaded. Particularly when the follower assembly 40 is near a fully extended position, more cartridges may be loaded after a single advancing motion. When the follower assembly 40 is or moves closer to a fully retracted position, fewer cartridges may be inserted. Upon release of the lever 104, the follower assembly 40 resumes the bias towards the feed lip.

In the present disclosure, and as seen in FIGS. 8-9, the plurality of dummy cartridges 410, 412 are linked by a plurality of links 408, such that each dummy cartridge 410 is allowed to rotate within each link 408 independently of the other dummy cartridges 410 and the first dummy cartridge 412. This independent rolling reduces sliding friction substantially as the dummy cartridges of the follower assembly 40 wind through the spiral track 303.

To achieve this independent rotation, all spring force is carried by the stacked follower links 408 in a kinetic chain, to allow independent rotation of the dummy cartridges 410, thereby minimizing sliding friction. It should be noted that the first dummy cartridge 412 may be keyed to not rotate, so as to enable a bolt catch function to be provided, which will be discussed in subsequent portions of this disclosure. Naturally, if a bolt catch function is not desired, the first dummy cartridge 412 may be configured to rotate just like the remaining dummy cartridges. It is also noted that it is not a requirement that the entire first dummy cartridge 412 not rotate. That is, the leading follower dummy 407 may be configured to rotate relative to the leading follower dummy roller 406, so as to minimize friction while still retaining a bolt catch function. The last dummy cartridge 410, that is, the dummy cartridge 410 closest to the spindle 403 when the follower assembly is installed in the magazine assembly 1, is configured to allow the inner spindle slider 401 to move along an axis of the dummy cartridge 410, or the follower dummy roller 404, so as to compensate for changes in the position of the dummy cartridges 410 relative to the plane define by axes B-C or a rear portion of the drum magazine assembly 1, illustrated in FIG. 2.

Figure 9B:
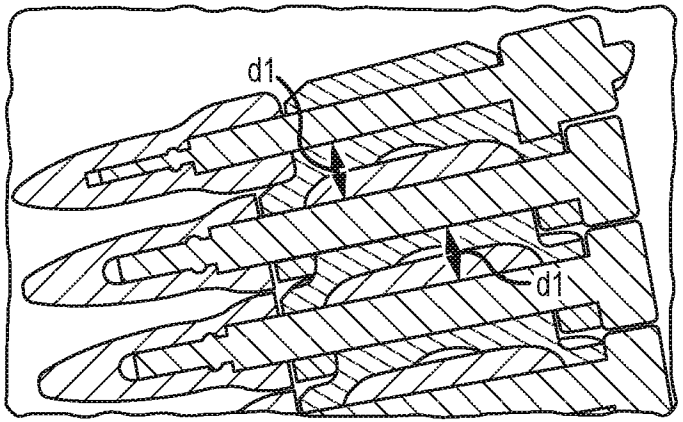
FIGS. 9A-9C are side and back section views illustrating details of the follower assembly in FIGS. 8A-8B.
Figure 9A:
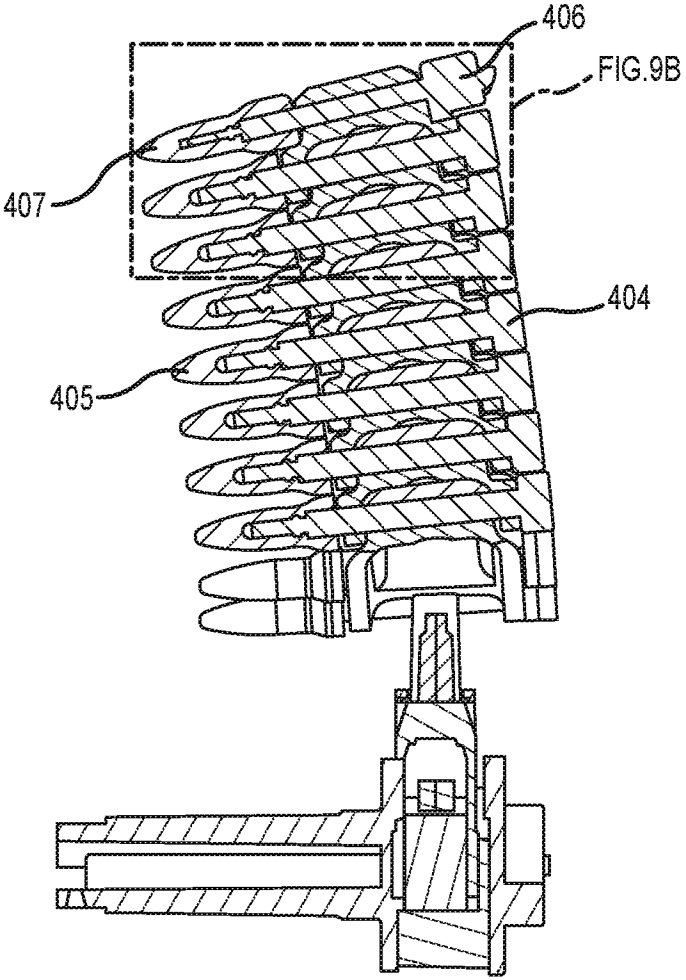

Continuing with FIGS. 9A-9B, the follower dummy rollers 404, follower dummies 405, leading follower dummy roller 406, and leading follower dummy 407 may be configured to maintain a focal point at a point P (see e.g. FIG. 2) at a distance D. A constant separation distance dl may also be maintained.

Figure 9C:
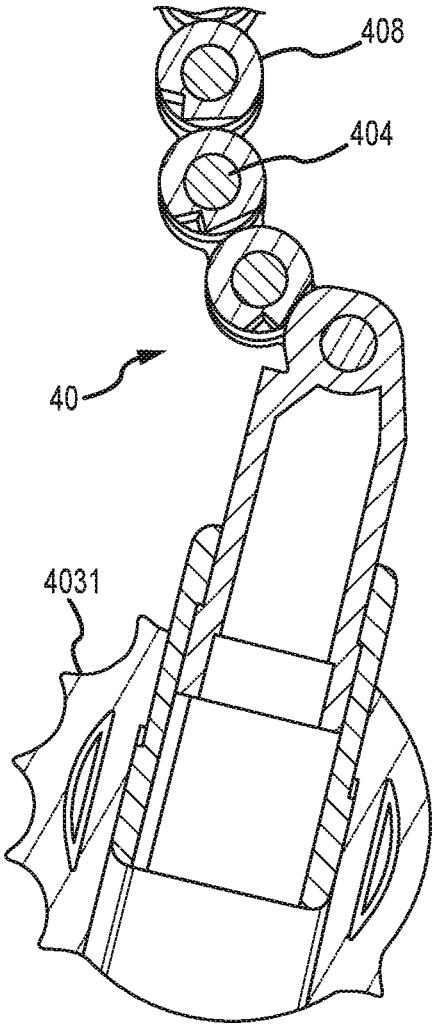
Figure 10B:
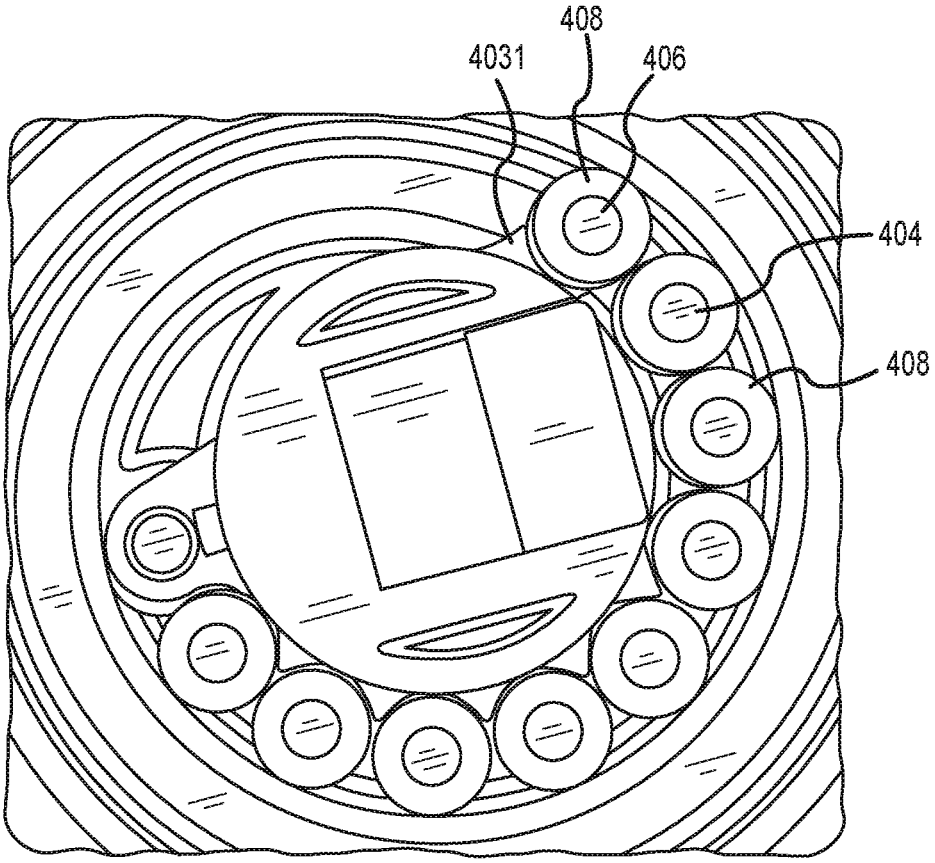

Turning now to FIGS. 9C and 10A-10B, it can be seen that the spindle 403 may include a plurality of spindle teeth 4031. The spindle teeth 4031 may nest in recesses between some or all of the follower links 408 when the follower assembly 40 is in a retracted state, thus providing greater contact area with each of the links 408, and improving the travel of the follower assembly 40 at the early point of travel. It is noted here that the spindle teeth 4031 engage the links 408, not the follower dummy rollers 404, to allow rotation of the follower dummies 410, 412. This arrangement minimizes friction while traveling through the spiral track 303 while not adding components to the kinetic chain. The spindle teeth 4031 also assist in overcoming the frictional forces between the follower assembly 40 and the drum body assembly 30 when the follower assembly 40 is in the retracted state with a tightened curvature in the center of the drum magazine 1, where friction is at its greatest. More succinctly, the spindle teeth 4031 minimize the response time between engagement of the spring 301 and movement of the most distant cartridge.

Figure 11:
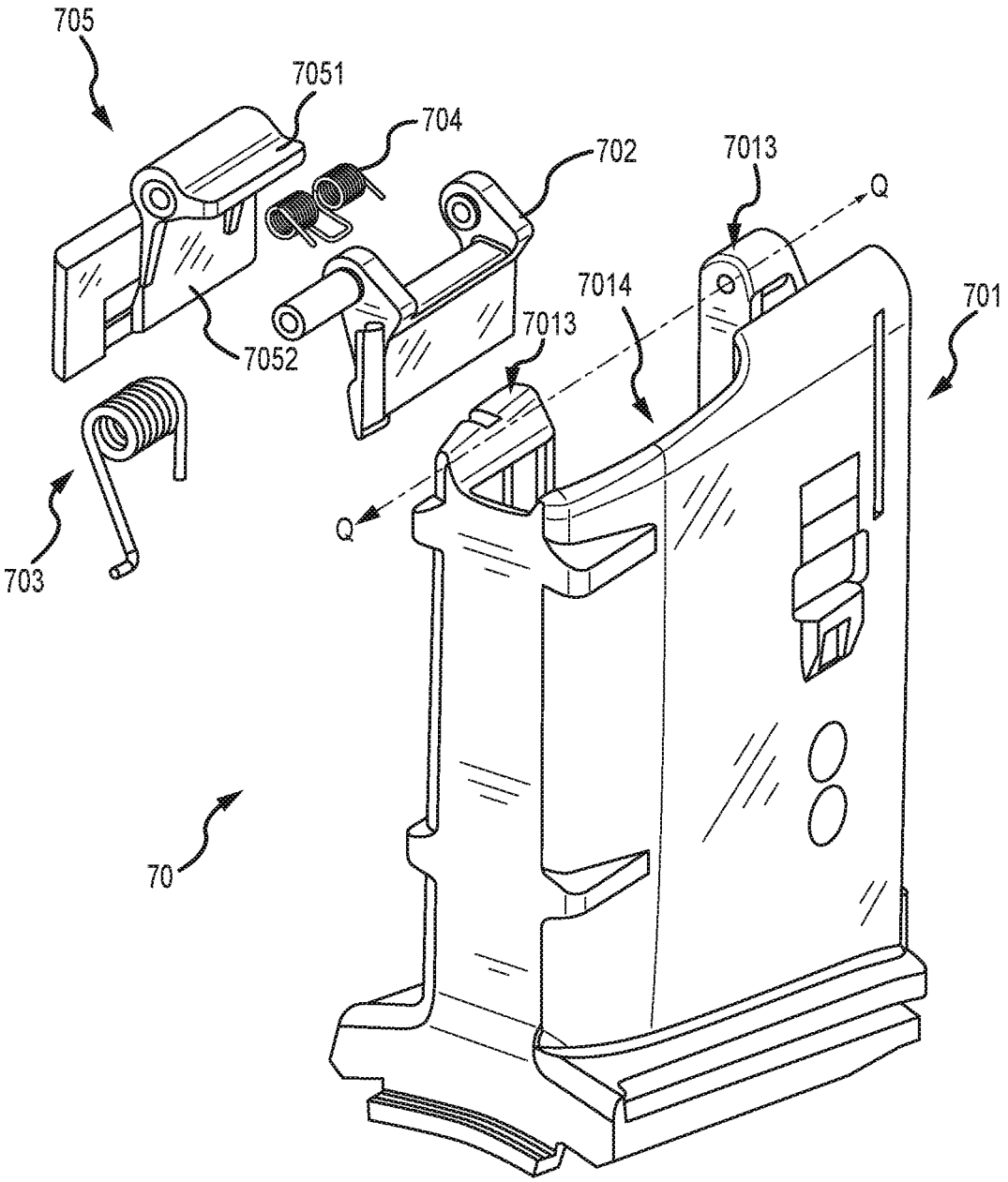
FIG. 11 is an exploded view of a feed tower assembly according to an embodiment.

Turning now to FIG. 11, the feed tower assembly is discussed in detail. The feed tower assembly 70 has a feed tower 701, a cartridge guide 702, a cartridge guide spring 703, a cartridge gate spring 704, and a cartridge gate 705. As seen, the cartridge gate 705 includes a gate tab 7051 and a gate lock 7052. In some embodiments, the feed tower assembly 70 does not cause the focal points of cartridges to converge substantially at a single point. Instead, because the feed tower assembly 70 has external constraints that do not allow single point convergence stacking, a best-fit stacking orientation for the stack is integrated. Specifically, the focal points approach substantial convergence at a single point.

Figure 12B:
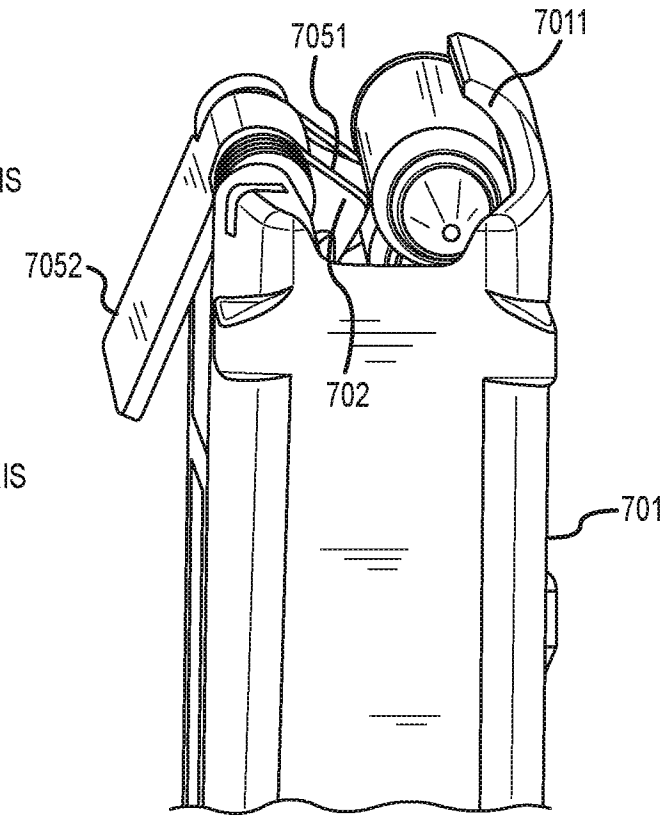
FIGS. 12A-12C are perspective, front, and section views of the feed tower assembly in FIG. 11.
Figure 12A:
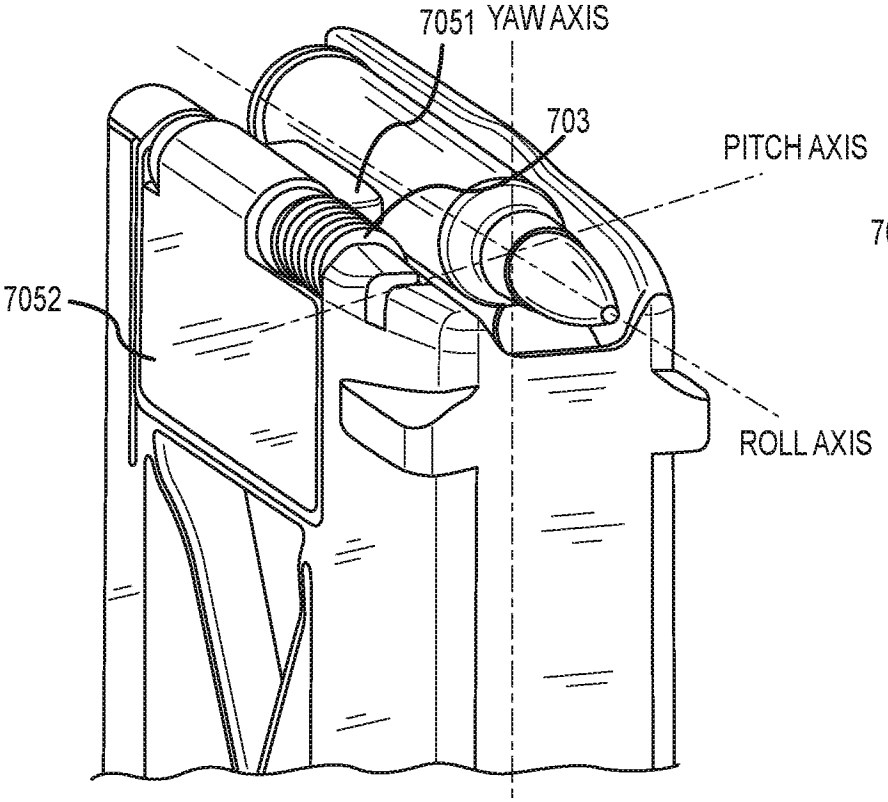
Figure 12C:
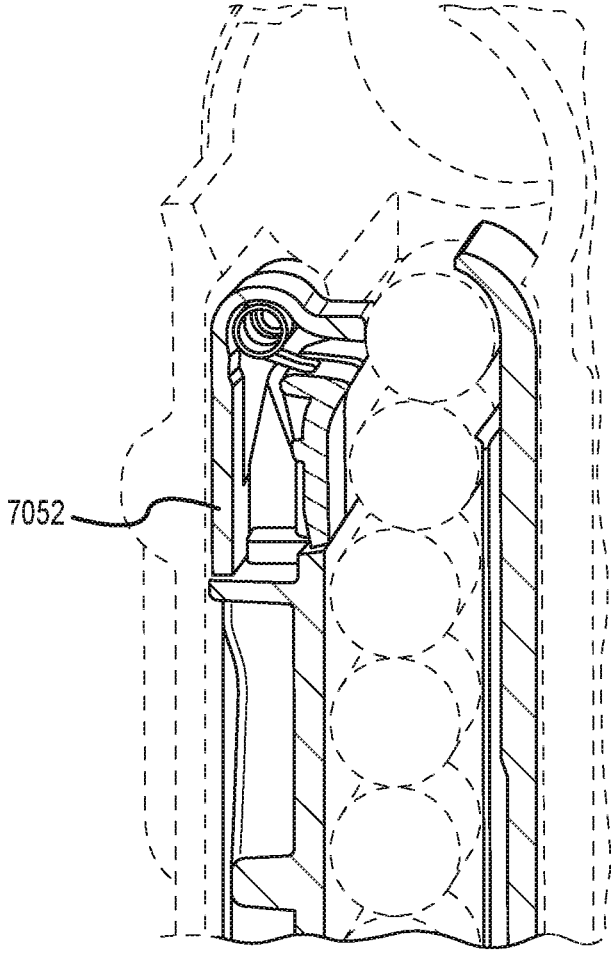

Operation of the gate tab 7051 and gate lock 7052 can be better understood with reference to FIGS. 12A-12C. As seen in FIG. 12A, after one or more cartridges are inserted in the feed tower assembly 70, the gate tab 7051 serves as a movable restrictor, which serves as a feed lip, to prevent the cartridges from escaping or being pushed out by the follower assembly 40. Specifically, the gate tab 7051 ensures that, once loaded, cartridges may only escape if they are either stripped forward by hand or the bolt carrier of a weapon. It should also be noted that the cartridge gate spring 704 of one embodiment, shown in FIG. 11, maintains the cartridge gate 705 biased towards the rest position shown in FIG. 12A.

In FIG. 12B, it can be seen that, as cartridges are inserted, overcoming the opposing forces of the cartridge gate spring 704, the gate tab 7051 is deflected out of the way, to allow the cartridges to be inserted. After the cartridges are inserted, the follower assembly 40 maintains the leading follower dummy/roller 406, 407 biased towards the feed lip 7011 of the feed tower 701.

In FIG. 12C, the feed tower assembly 70 is shown installed on a weapon. As can be seen, loading onto the weapon prevents the cartridge gate 705 from being deflected out of the rest position by blocking the gate lock 7052.

Returning now to FIG. 11, it should be understood that the feed tower 701 may include a cartridge gate mount 7013 for retaining the cartridge gate 705. The cartridge gate mount 7013 is configured to pivotally retain the cartridge gate 705 such that the cartridge gate 705 may pivot about a pivot axis Q.

Figure 13B:
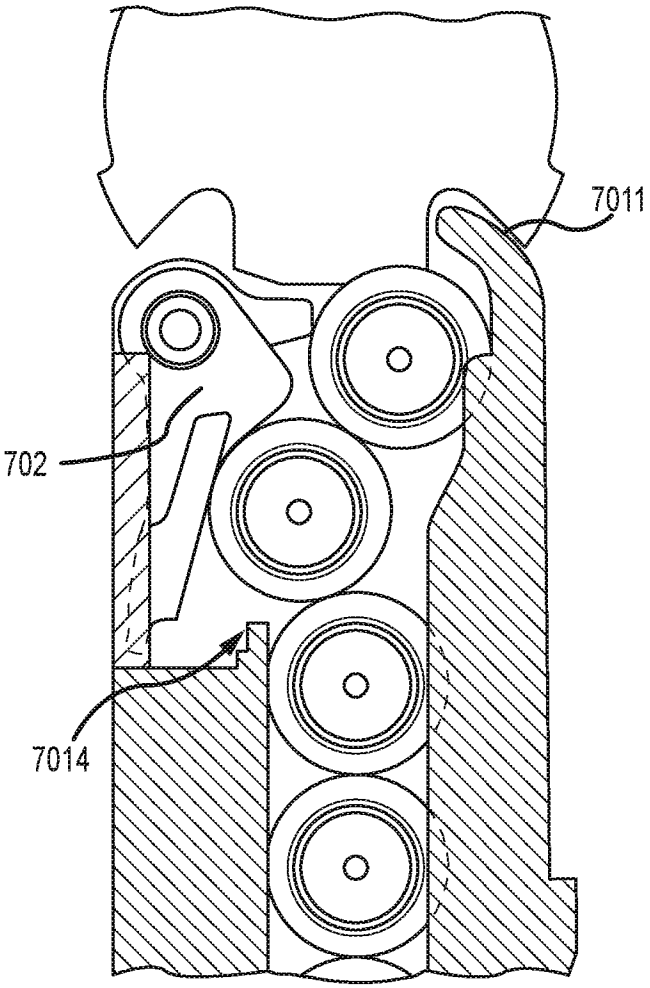
FIGS. 13A-13B are partial front section views of the feed tower assembly in FIG. 11 illustrating operation of a cartridge guide.
Figure 13A:
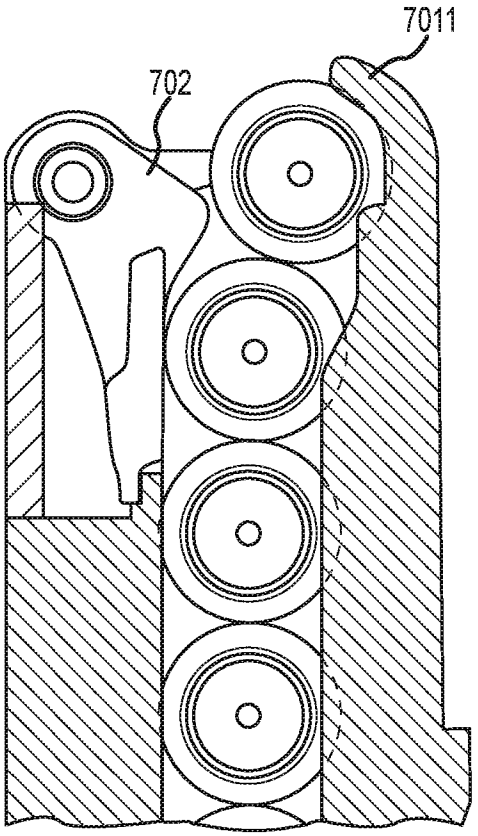

Turning now to FIGS. 13A and 13B, the operation of the cartridge guide 702 is now discussed. In FIG. 13A, for example, it can be seen that the cartridge guide 702 is configured to function as a passive wall or guide as cartridges are pushed towards the feed lip 7011, to maintain the cartridges in a position biased against the opposing wall of the feed tower 701 and the feed lip 7011.

In FIG. 13B, the operation of the cartridge guide 702 is shown when the drum magazine assembly 1 is loaded on a weapon having a closed bolt. To allow insertion into a weapon with a closed bolt, the cartridge guide 702 is configured to allow the first or leading cartridge to displace away from the feed lip 7011, and, simultaneously, the second cartridge is displaced against the cartridge guide 702, causing the cartridge guide 702 to swing away from the preferred line of travel of the cartridges to provide a recess for the second cartridge. The cartridge guide spring 703, shown in FIG. 11, is configured to maintain the cartridge guide 702 biased such that cartridges are prevented from inappropriate shifting during normal travel through the spiral track 303 and feed tower 701, and, after the first cartridge exits the feed tower 701, the second cartridge is displaced back into the appropriate line of travel through the feed tower 701. See also FIG. 29 and the portions of this disclosure associated therewith for a more complete understanding of various embodiments of the feed tower assembly 70.

The feed tower 701 may also include a cartridge guide mount, and, as is depicted in FIG. 11, the cartridge guide mount may be the same feature as the cartridge gate mount 7013, specifically, a mount suitable for pivotally retaining the cartridge guide 702 for rotation about pivot axis Q.

Figure 14B:
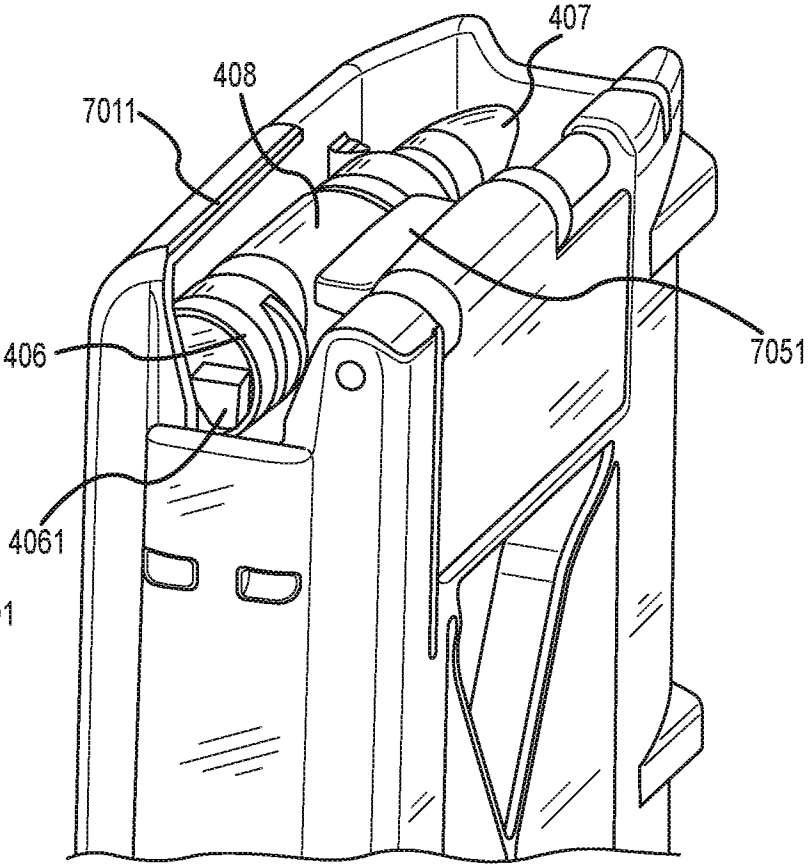
FIGS. 14A-14B are perspective views of the feed tower assembly in FIG. 11 illustrating operation of a bolt catch engagement feature.
Figure 14A:
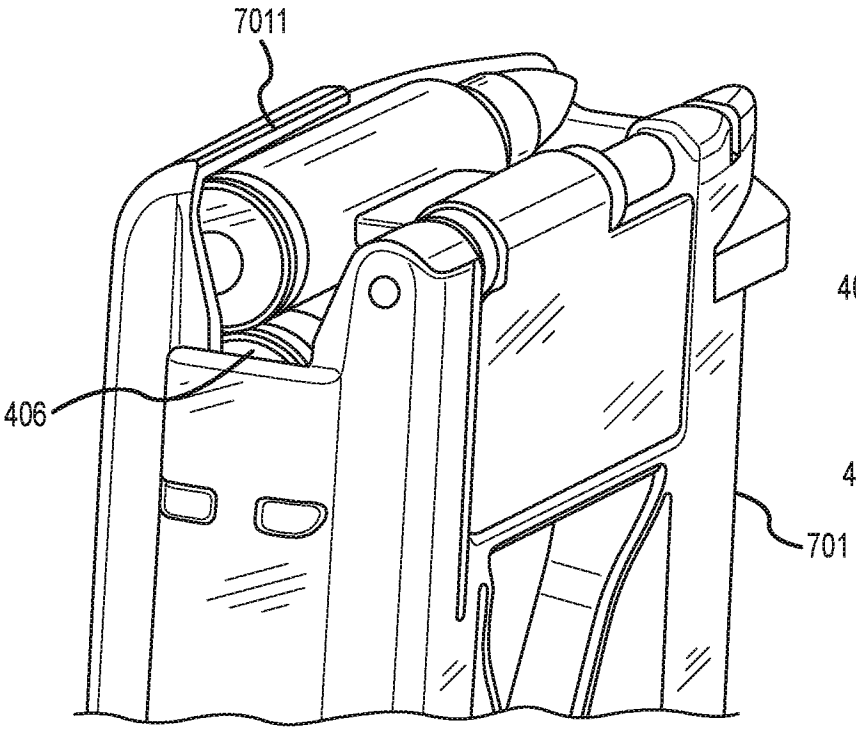

The feed tower 701 may further include a recess 7014. The recess 7014, illustrated most clearly in FIGS. 11 and 13B, is configured to seat a cartridge in or towards a wall of the feed tower 701 when a loaded magazine assembly 1 is inserted in a weapon having a closed bolt. Turning now to FIGS. 14A and 14B, a bolt catch feature is now discussed. As previously mentioned in this disclosure, the leading follower dummy roller 406 may be configured to provide a bolt catch engagement feature for a lock back function. In FIG. 14A, the feed tower assembly 70 is shown at a point in time in which a final cartridge is ready to be chambered in a weapon, and the leading follower dummy roller 406 is beginning to appear near the feed lip 7011. After the final cartridge is chambered or otherwise removed, the leading follower dummy roller 406 is pushed up slightly by the spring 301; however, a tab 4061 or other bolt catch engagement feature is configured to engage a bolt catch in the weapon to lock the bolt to a rearward position after the last cartridge is fired, thus simplifying the magazine change and decreasing the time needed to be ready for further firing after the magazine change. The tab 4061 may comprise a shelf feature for engagement. It should also be understood that, although the tab 4061 is shown in a particular configuration with a non-rotating leading follower dummy, it may be configured to operate with a rotating follower dummy, depending on the style of weapon used. For example, a circular tab 4061 or other shaped tab 4061 may be provided to engage a bolt catch in certain weapons.

Figure 15:
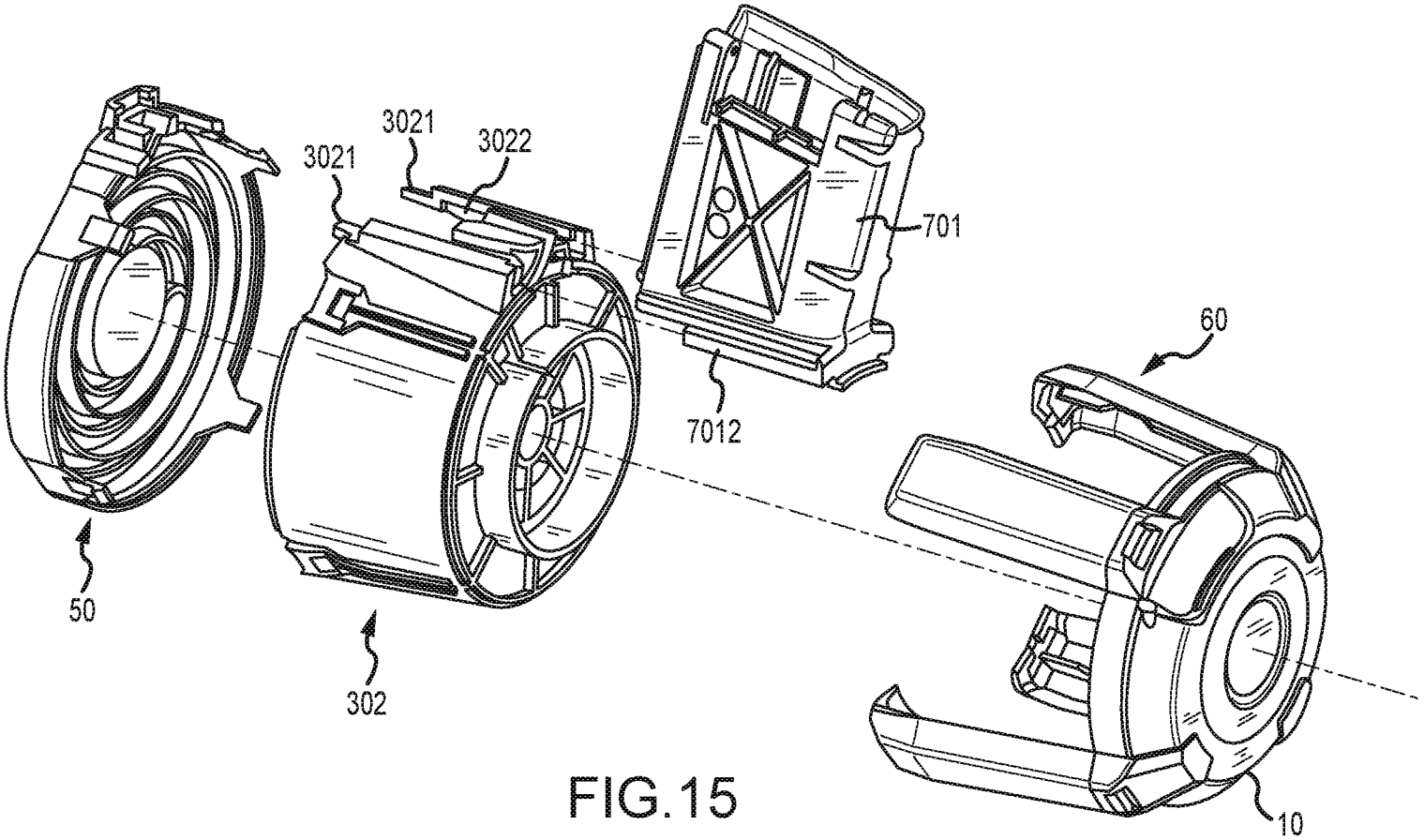
FIG. 15 is an exploded view of an interface between the feed tower and the drum body according to some embodiments.
Figure 16:
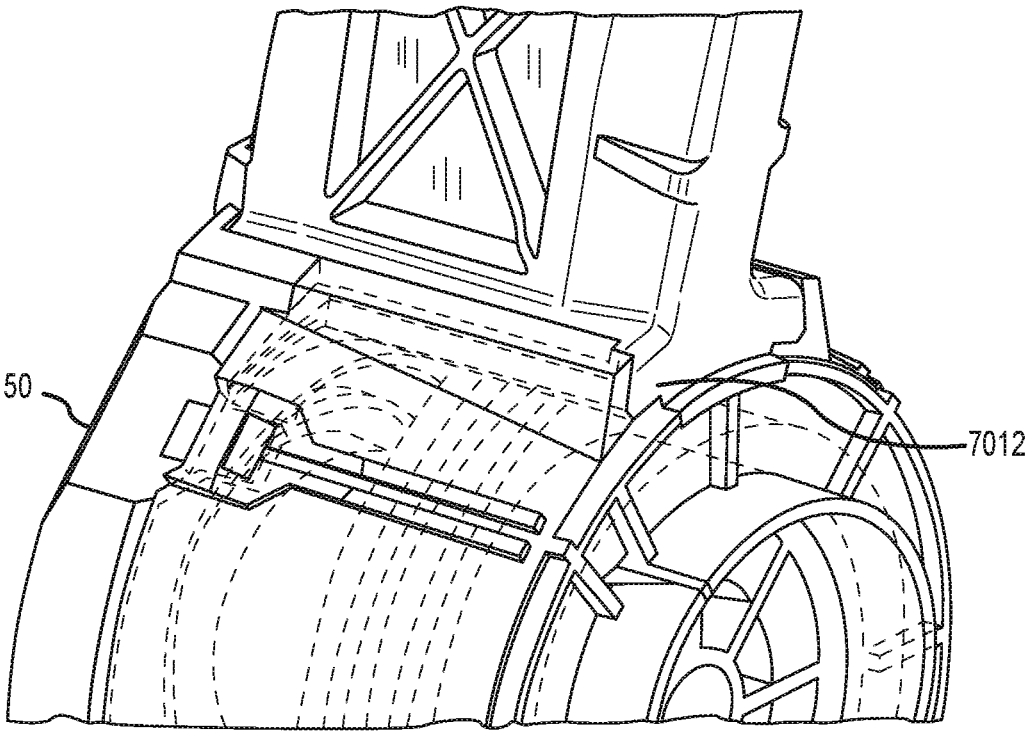
FIG. 16 is a front perspective view showing further details of the interface illustrated in FIG. 15.
Figure 17:
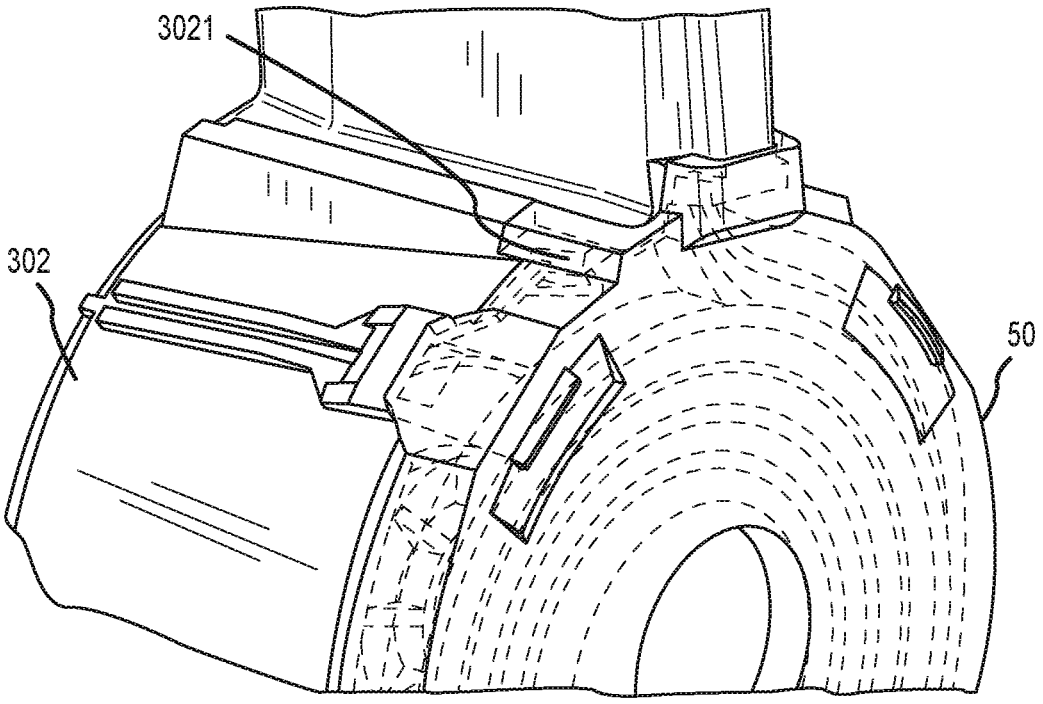
FIG. 17 is a back perspective view showing the details of the interface illustrated in FIG. 15.

Turning now to FIG. 15, a feed tower retention mechanism is now described. As seen, the feed tower 701 includes a pair of mounting ribs 7012 configured to interface with a pair of mounting slots 3022 in the drum body 302. The drum body 302 also has a pair of protrusions 3021 that are retained by the rear cover 50. Retaining clips 60 are further provided to maintain the front cover 10, the drum body 302, and the rear cover 50 in an assembled state. With a brief review of FIG. 16, it can be seen that the mounting ribs 7012 stop short of the rear cover 50 when the feed tower 701 is assembled to the drum body 302. FIG. 17 similarly exemplifies how the protrusions 3021 of the drum body 302 nest under the rear cover 50. By locking the feed tower in this manner, the present design exhibits much less potential for movement, as compared to currently-available designs. This also provides for reduced tolerance stacking problems, as well as improved strength and alignment as compared to currently-available designs.

Figure 18:
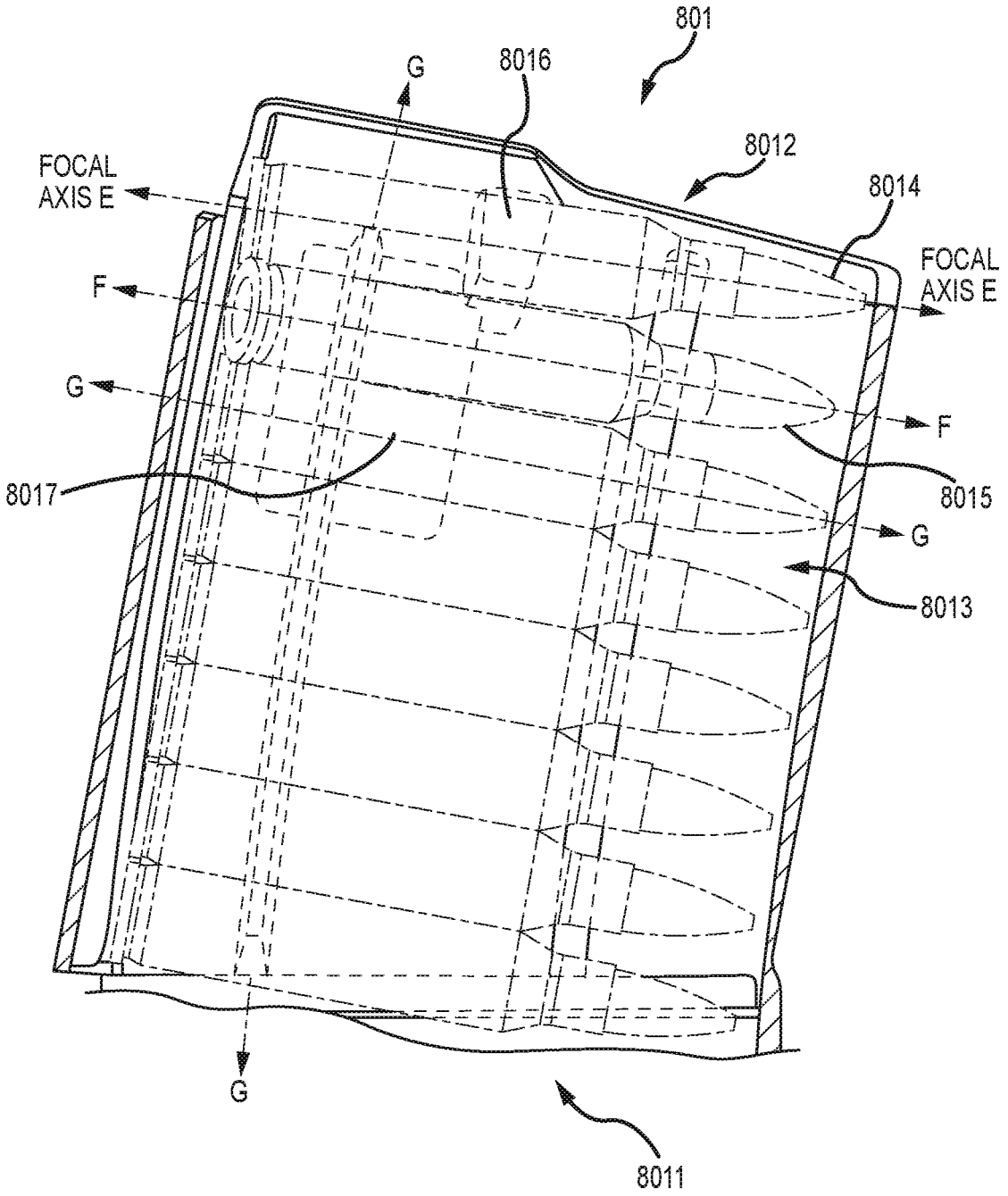
FIG. 18 is a side section view of another embodiment of a feed tower.
Figure 19:
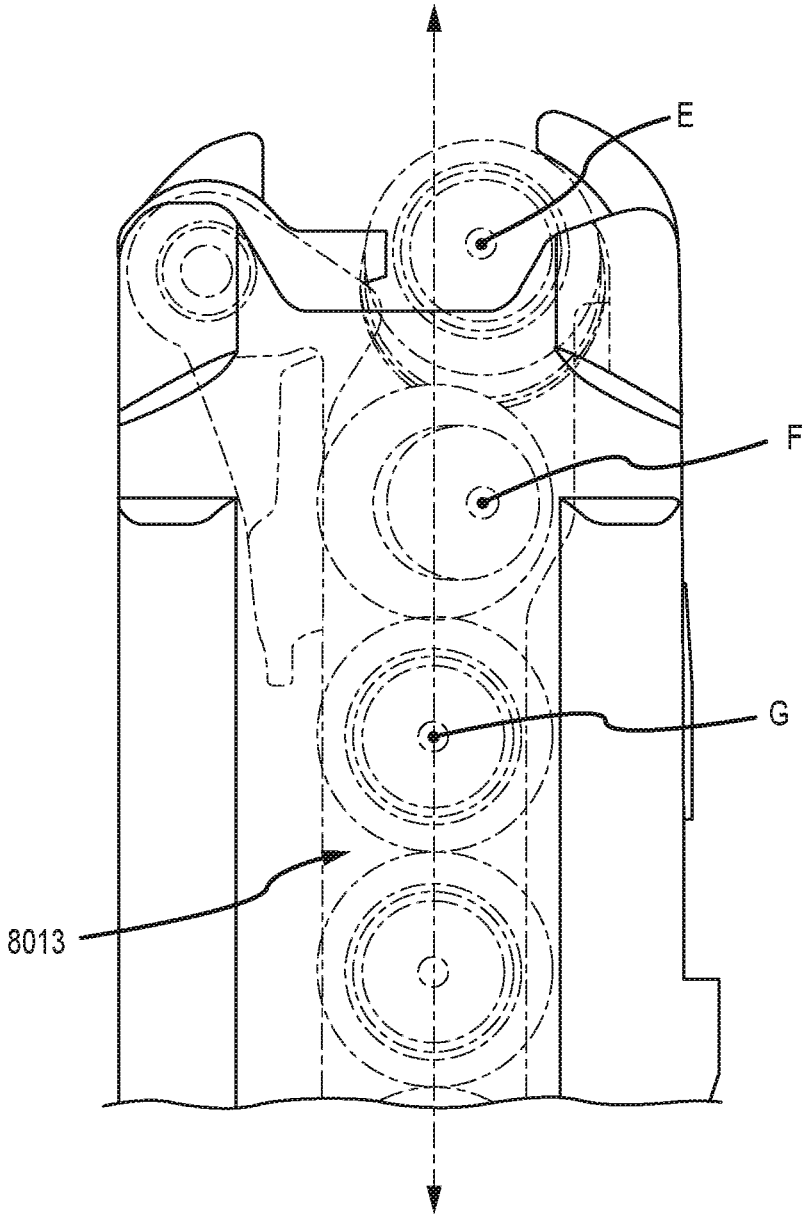
FIG. 19 is a front view of the feed tower illustrated in FIG. 18.

Turning now to FIGS. 18-19, an alternate embodiment of a feed mechanism 801 is now discussed. In this embodiment, the feed mechanism 801 includes an end portion 8011, a feed opening 8012 opposing the end portion 8011, and a track 8013.

The track 8013 is configured to guide one or more cartridges along a travel path between the end portion 8011 and the feed opening 8012. The track 8013 is further configured to cause a first cartridge 8014 of the one or more cartridges to define a focal axis E. The track 8013 also serves to position one of a first dummy cartridge, such as a leading follower dummy 407, and another cartridge 8015 of the one or more cartridges such that a central axis F of the one of a first dummy cartridge and another cartridge 8015 of the one or more cartridges does not converge with the focal axis E and is not parallel to the focal axis E.

The track 8013 may comprise an align element 8016 and a diverge element 8017, the align element 8016 configured to align a first cartridge to a focal axis E, the diverge element 8017 configured to cause a central axis F of one of a second cartridge and a dummy cartridge to diverge from the focal axis E. The align element 8016 may be a first distance from the feed opening 8012 and the diverge element 8017 may be a second distance from the feed opening 8012, the first distance less than the second distance.

It should be noted that, although the feed mechanism 801 is depicted in FIGS. 18-19 as a feed tower suitable for a drum magazine assembly 1 such as that depicted in FIG. 1, the feed mechanism 801 may also be a magazine, such as a stick type magazine assembly. The feed mechanism 801 embodied as a stick type magazine may be particularly suitable for very high capacity magazines, which, particularly at maximum loading capacity, begin to exhibit similar problems with nose-diving as seen in drum magazines. In some embodiments, the feed mechanism 801 may be configured to house cartridges having a caliber of 7 millimeters, or greater, or less, such as 4.7 millimeters. In some embodiments, the feed mechanism 801 may be configured to house cartridges having a caliber of 8.5 millimeters or greater. In some embodiments, the feed mechanism 801 may be configured to house cartridges having a caliber of 12.7 millimeters or greater. In some embodiments, the feed mechanism 801 may be configured to house cartridges having a caliber of 25 millimeters or greater.

Although the preceding discussion has focused on the problem of preventing cartridges from being fed in a nose-down position from a drum magazine, it should be understood that the feed mechanism 801 may also be suited for straight stick type magazines used with tapered cartridges. The feed mechanism 801 may also assist in feeding heavy cartridges or highly unbalanced cartridges, both of which exacerbate problematic friction and/or imbalanced spring forces.

Cartridges and/or systems that tend to feed in a base-down orientation may also benefit from the use of an embodiment of the feed mechanism 801. That is, because a fully-engaged base is desirable, if the base (or cartridge case head) is positioned too low relative to the bolt, the bolt will not strip the cartridge from the magazine. Therefore, a reverse version of the embodiment shown in FIGS. 18-19, in which the cartridge base or proximal portion is urged higher, may be used to prevent the cartridge base from diving more than is desirable. This reverse version may be achieved by, for example, using a diverge wall to cause a base portion of a cartridge, as opposed to the nose portion as shown in FIG. 19, to move out of alignment with the track.

The feed mechanism 801 or feed tower 701 may include a first side portion and a second side portion coupled together to define a track therebetween. In the embodiment shown in FIG. 18, the first side portion may include the align element 8016 and the second side portion may include the diverge element 8017. The end portion of the feed mechanism 701, 801 may include a mount configured for mounting the feed mechanism 701, 801 to a firearm magazine, with further details of the mount being more clearly exemplified and described with reference to FIGS. 15-17. The feed mechanism illustrated in FIGS. 18-19 may further include a cartridge gate and/or cartridge guide mount, as previously described with reference to FIGS. 12A-13B.

Figure 20:
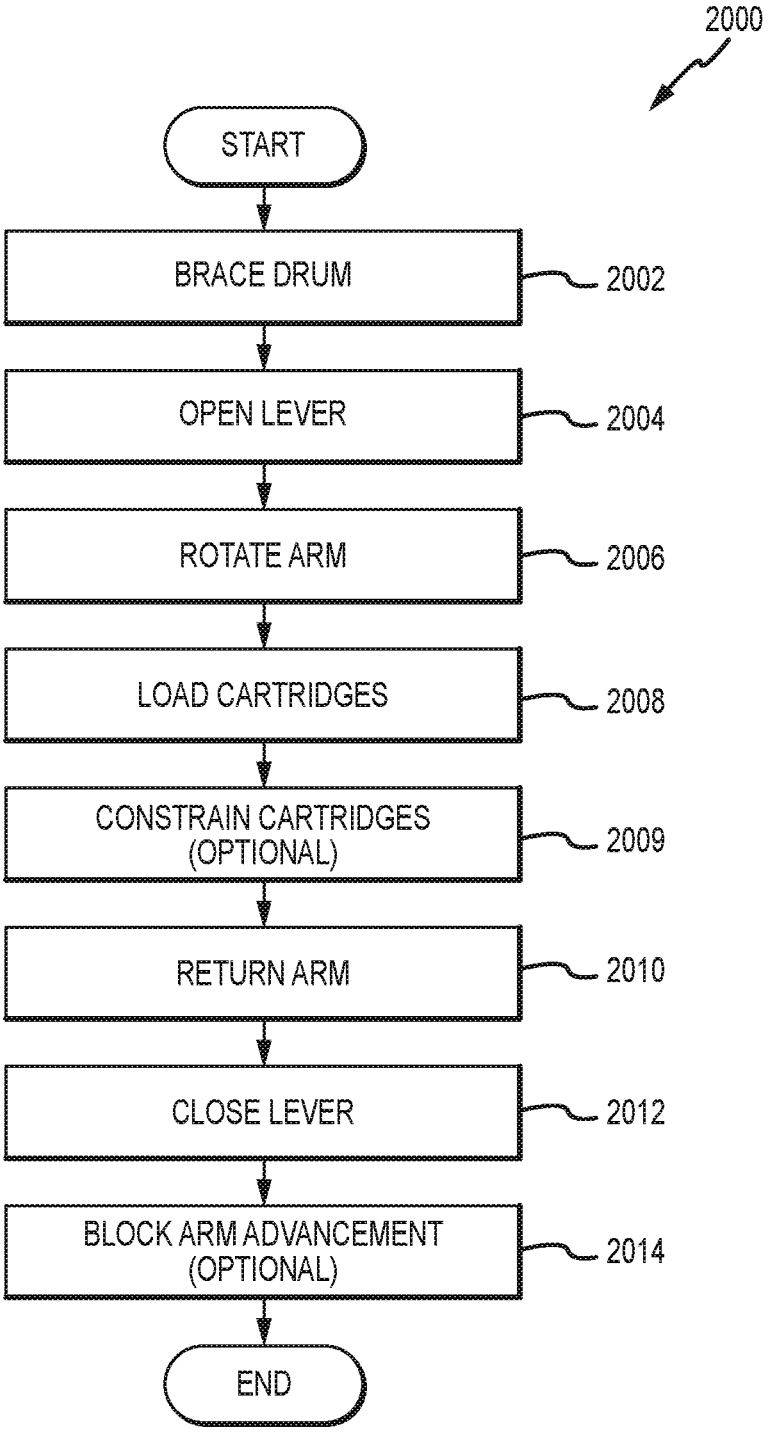
FIG. 20 is a flow diagram of a method according to an embodiment.
Figure 21:
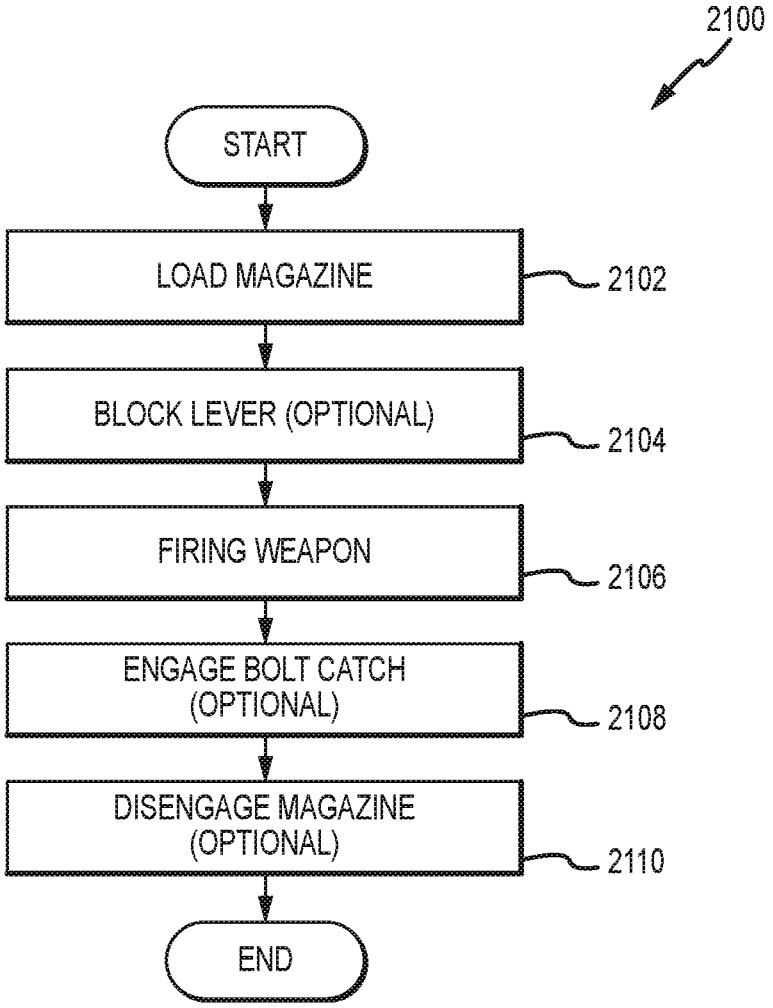
FIG. 21 is a flow diagram of another method according to an embodiment.

Turning now to FIGS. 20-21, methods of using a magazine assembly are now discussed. In FIG. 20 a method 2000 of loading a magazine is illustrated. The method 2000 includes bracing a drum magazine 2002, opening a lever 2004, rotating an arm 2006, loading at least one cartridge 2008, returning the arm 2010, and closing the lever 2012.

The method 2000 may be practiced with one or more of the embodiments described with reference to FIGS. 1-19.

Bracing a drum magazine 2002 may include bracing a drum magazine using a user's hand, torso, or other nearby object to maintain the drum magazine in a desired position and orientation.

Opening a lever 2004 may include rotating a lever about a distal point of an advancing mechanism or arm, so as to increase a moment arm to be applied to a spring for advancement. Opening a lever 2004 may also include opening a lever using a hand which is also used for bracing the drum magazine. Opening a lever 2004 may also include causing a lever, operatively coupled to a pawl, to engage a wheel in a manner previously described with reference to FIGS. 1-19. Opening a lever 2004 may include grasping the lever 104 at a grip and rotating the lever 104 about a pivot body 1044, so as to cause the lever 104 to disengage from a locking ridge 1021. Grasping may be achieved using a hand that is also used to brace the magazine 2002. The pawl 108 and the wheel 20 may be configured like those previously discussed with reference to FIGS. 1-19. It should be understood that opening a lever 2004 need not necessarily include rotating a lever about an axis, such as described with reference to FIGS. 1-19; instead, as just one example, opening a lever 2004 may include causing a lever to extend relative to a central pivot axis, to increase an advancing moment arm, such as by using a telescoping feature and motion.

Rotating the arm 2006 may include applying a force on the lever to cause the arm to rotate about a central axis.

Loading at least one cartridge 2008 includes placing at least one cartridge in the magazine while the arm is held in an advanced or rotated state. Loading at least one cartridge 2008 may include loading a plurality of cartridges into a magazine assembly for a weapon, which may be a drum magazine assembly 1 such as that described with reference to FIGS. 1-17, such that a focal point of each of the one or more cartridges substantially converges a point P at a distance D from the magazine assembly, regardless of where in the magazine assembly each of the cartridges is located. Loading at least one cartridge 2008 may include causing a magazine follower, which may be configured like the follower assembly 40 previously described with reference to FIG. 8, to travel through a drum magazine assembly 1 while maintaining a focal point of each dummy cartridge 405 at a point P a distance D from the drum magazine assembly 1. Loading at least one cartridge 2008 may be accomplished by applying pressure to displace a cartridge gate near a feed lip of a feed tower into a feed position. The feed position of the cartridge gate creates a recess for the cartridge to pass into the top portion of the feed tower. Loading at least one cartridge 2008 may further include allowing the cartridge gate to return from a feed position to a rest position. The rest position of the cartridge gate prevents cartridges from escaping the feed tower. The cartridge gate 705 and feed tower 701 may be configured and function like those previously discussed with reference to FIGS. 11-12C.

The method 2000 may also include holding the arm in an advanced or rotated state relative to a start position by applying a force to a lever using a hand, the hand being the same hand used for bracing the drum magazine.

Returning the arm 2010 includes allowing a biasing spring force to return the arm to a start position. Closing the lever 2012 includes allowing a biasing force to rotate the lever relative to the arm. Closing the lever 2012 may also include causing a pawl, operatively coupled to the lever, to disengage from a wheel.

The method 2000 may optionally include blocking arm advancement 2014. Blocking arm advancement 2014 may include causing an advancement lock feature to prevent advancement of the arm if the lever is not rotated. Blocking arm advancement 2014 may be achieved using, for example, the advancement lock feature having a groove 1042 and lever lock 1043 previously described in this document with reference to FIG. 3.

The method 2000 may also include constraining a cartridge 2009. Constraining a cartridge 2009 includes preventing the bullet tip and/or a majority of the back end of the cartridge from sliding against any portion of the magazine assembly. Constraining a cartridge 2009 may be accomplished using a spiral track 303 configured like the one previously discussed with reference to FIG. 7.

Turning now to FIG. 21, another method 2100 of using a drum magazine assembly is now discussed. The method 2100 includes loading a magazine 2102 into a weapon, firing the weapon 2106, and ejecting the magazine 2110. The method 2100 may also include blocking a lever 2104 and/or engaging a bolt catch 2108 in the weapon to lock the bolt to a rearward position after the last cartridge is fired. Blocking a lever 2104 and engaging a bolt catch 2108 may be achieved in the manner and/or using the components described with reference to FIGS. 1-19.

Loading a magazine 2102 includes installing a magazine assembly, having a feed mechanism, into a weapon. Loading a magazine 2102 may include installing a magazine assembly into a weapon having a closed bolt. Loading a magazine 2102 may include causing a closed bolt to push a first cartridge from a start position to a displaced position, and against a second cartridge or a leading follower dummy. Loading a magazine 2102 may further include preventing a third cartridge or a second follower dummy from retracting into the magazine assembly while the first cartridge is in the displaced position. Loading a magazine 2102 may also include causing the second cartridge or a leading follower dummy to move against a cartridge guide, thus causing the cartridge guide to retract away from a direct line of travel of cartridges in a feed tower. Loading a magazine 2102 may also include allowing the first cartridge to return from the displaced position to the start position. The feed tower 701, cartridge guide 702, and leading follower dummy 407 may be configured and function like those previously discussed with reference to FIGS. 8, 11, and 13A-C.

Blocking a lever 2104 includes causing the weapon to block the lever at a lever lock on the lever, thereby preventing the lever from being opened. Blocking a lever 2104 may be achieved using, for example, a lever 104 as described with reference to any one of FIGS. 1-19.

Firing the weapon 2106 may include allowing loaded cartridges to advance through a magazine and/or a feed mechanism as described with reference to any one of the preceding figures.

The method 2100 may also include engaging a bolt catch 2108. Engaging a bolt catch 2108 includes causing a bolt catch engagement feature, such as a tab 4061 on a leading portion of a follower assembly, to engage a bolt catch on a weapon after a final cartridge is fired, thus simplifying loading of a subsequent loaded magazine. Engaging a bolt catch 2108 may be achieved using components similar to those discussed with reference to FIGS. 8 and 14A-B.

The method 2100 may further include disengaging the magazine 2110 from a weapon, and may be achieved using any means, components, or actions known to those skilled in the art.

Figure 22:
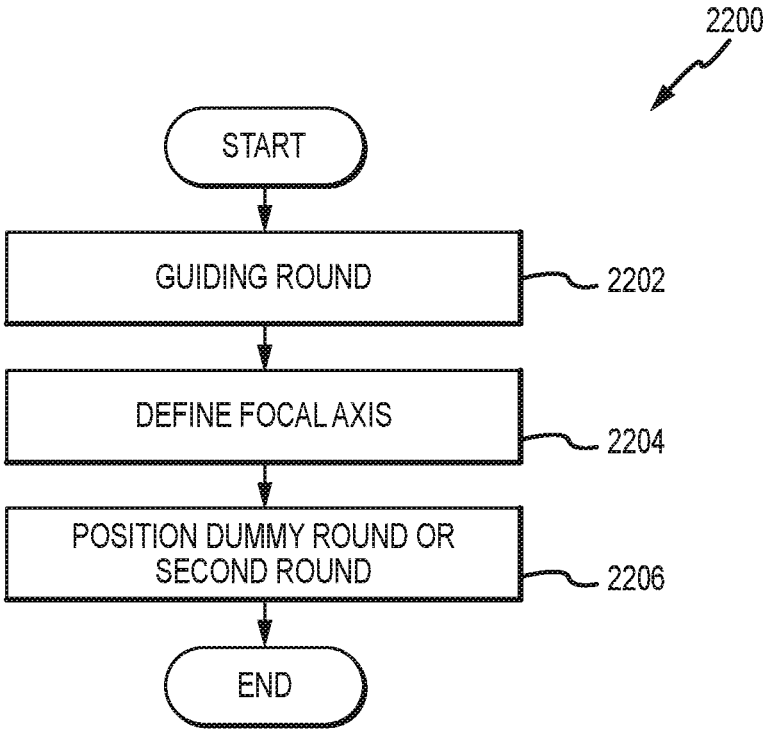
FIG. 22 is a flow diagram of another method according to an embodiment.

Turning now to FIG. 22, a method 2200 of using a feed mechanism for a firearm is now described. The method 2200 includes guiding a cartridge 2202, defining a focal axis 2204, and positioning a dummy cartridge or a second cartridge 2206. Guiding a cartridge 2202 includes guiding one or more cartridges along a travel path between an end portion and a feed opening of the feed mechanism. The feed mechanism may be similar to the feed mechanism 801 described with reference to FIGS. 18-19. Defining a focal axis 2204 includes causing a first of the one or more cartridges to define a focal axis, such as the focal axis E illustrated in FIG. 18. Positioning a dummy cartridge or a second cartridge 2206 includes positioning one of a first dummy cartridge and another of the one or more cartridges such that a central axis of the one of a first dummy cartridge and another of the one or more cartridges does not converge with the focal axis and is not parallel to the focal axis. More specifically, positioning 2206 may include positioning a dummy cartridge or a second cartridge such that the central axis does not converge with the focal axis E as illustrated in FIGS. 18-19.

The method 2200 may include causing the focal axis to extend distally above or below the central axis. The method 2200 may also include causing a central axis of one of a second dummy cartridge and a third cartridge to substantially converge with the focal axis, and/or mounting the feed mechanism to a firearm magazine and/or into a weapon.

The method 2200 may also include movably mounting at least one of a cartridge gate and a cartridge guide to the feed mechanism and/or causing a spring feeding force on a first end portion of a first cartridge to be greater than a spring feeding force on a second end portion of the first cartridge. In some embodiments, movably mounting may comprise pivotally mounting. In some embodiments, movably mounting may comprise translatably mounting.

Figure 23:
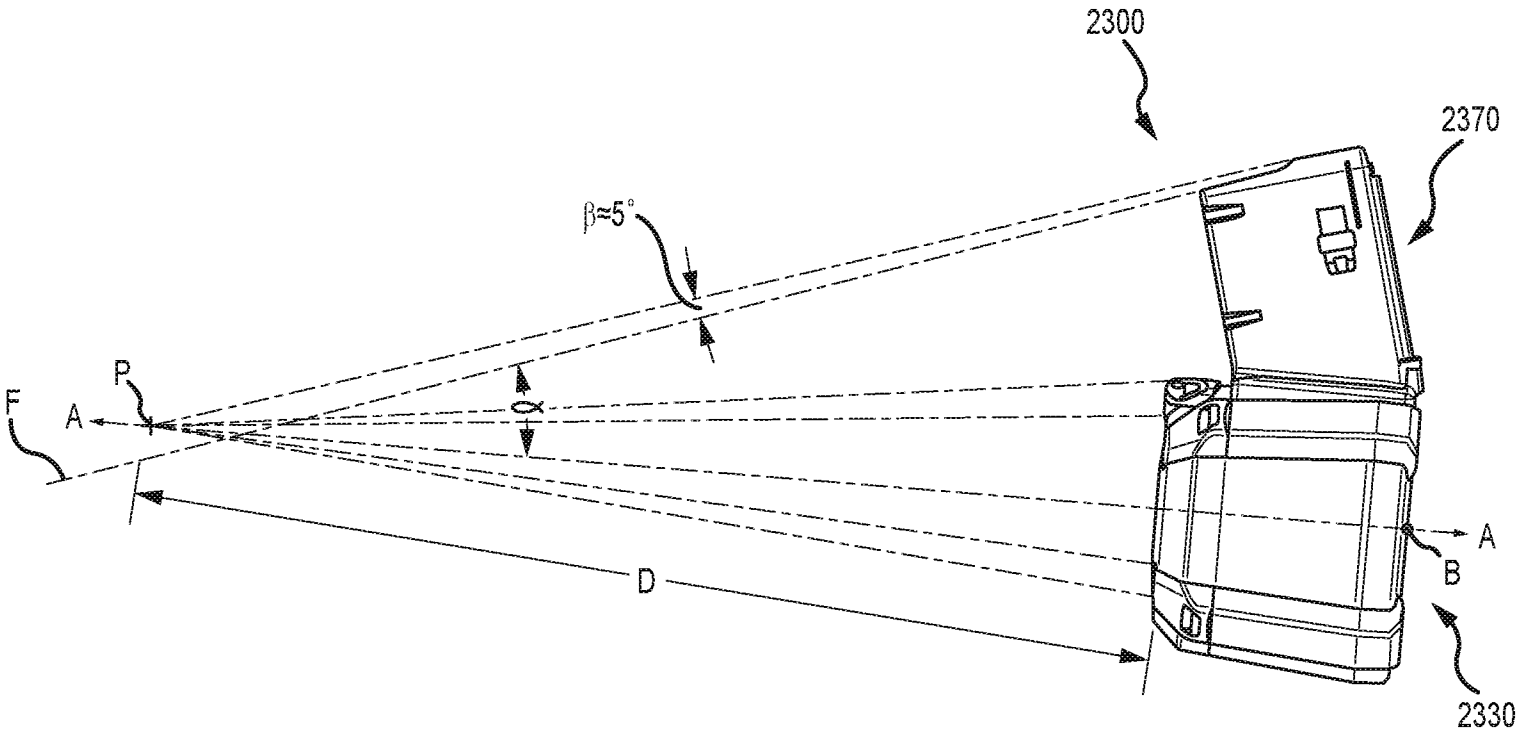
FIG. 23 is a perspective view of a drum magazine according to an embodiment.

Turning now to FIGS. 23-40, another embodiment of a drum magazine assembly 2300 is described. As illustrated in FIG. 23, in some embodiments, the assembly 2300 may have a feed tower assembly 2370 removably coupled to a drum assembly 2330, wherein the drum assembly 2330 is configured to constrain any cartridges therein such that the cartridges substantially point at a single focal point P a distance D from the drum assembly 2330. The feed tower assembly 2370 may be configured or shaped to cause a leading cartridge therein, that is, a cartridge in a position for feeding into a weapon, to have a focal axis F that is angled towards the drum assembly 2330 such that the focal axis of the leading cartridge extends below the focal point P (contrast with FIG. 2), or extends below the focal point P when viewed from the side as illustrated (that is, the focal axis of the leading cartridge need not necessarily intersect a line extending below point P, but may simply intersect a plane defined by axis A and axis B at a distance less than distance D from the assembly 2300. In some embodiments, the feed tower assembly 2370 may be configured to direct the leading cartridge to have a focal axis F that is at about an angle $\alpha$ relative to the center of the drum assembly 2330, with the angle $\alpha$ being less than the angle between the feed tower assembly and drum assembly illustrated in FIG. 2. In some embodiments, the angle $\alpha$ may be about 5 degrees less than an angle suitable for causing a focal axis of the leading cartridge to intersect with a focal point of cartridges in the drum assembly 2330 (compare FIG. 2 with FIG. 23). That is, an angle $\beta$ between a line from the leading cartridge to the point P and the focal axis F may be about 5 degrees in some embodiments. In some embodiments, the angle $\alpha$ between the leading cartridge and an axis through the point P and the center of the spindle 2343 may be about 15 degrees or less, in some embodiments between about 3 degrees and about 7 degrees, in some embodiments about 5 times the individual cartridge taper (e.g., where a cartridge case has a taper of about 1 degree, such as with a 5.56 millimeter cartridge case, the angle $\alpha$ may be about 5 degrees). In some embodiments, the angle $\alpha$ may be greater than 0 degrees and less than 7 degrees, and in some embodiments, the angle $\alpha$ may be greater than 0 degrees and up to 5 times the cartridge taper. Those skilled in the art will understand that the angle $\alpha$ will vary according to the number and type of cartridges being housed, as well as other design choices, including, without limitation, the cartridge type being housed, the center of mass of the cartridge(s), friction in the design of the assembly, and the capacity of the magazine.

Figure 24:
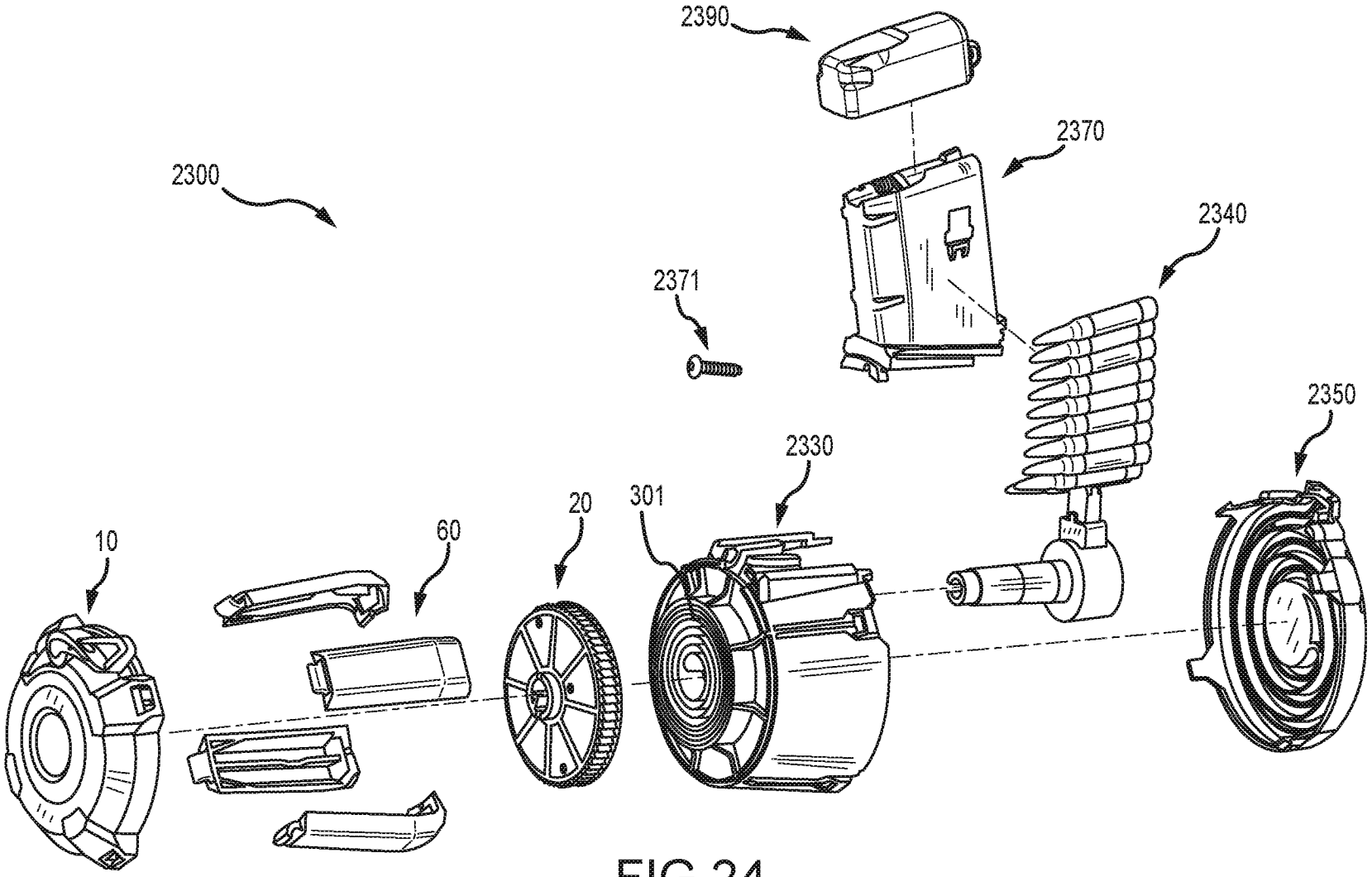
FIG. 24 is an exploded view of the drum magazine in FIG. 23.
Figure 25:
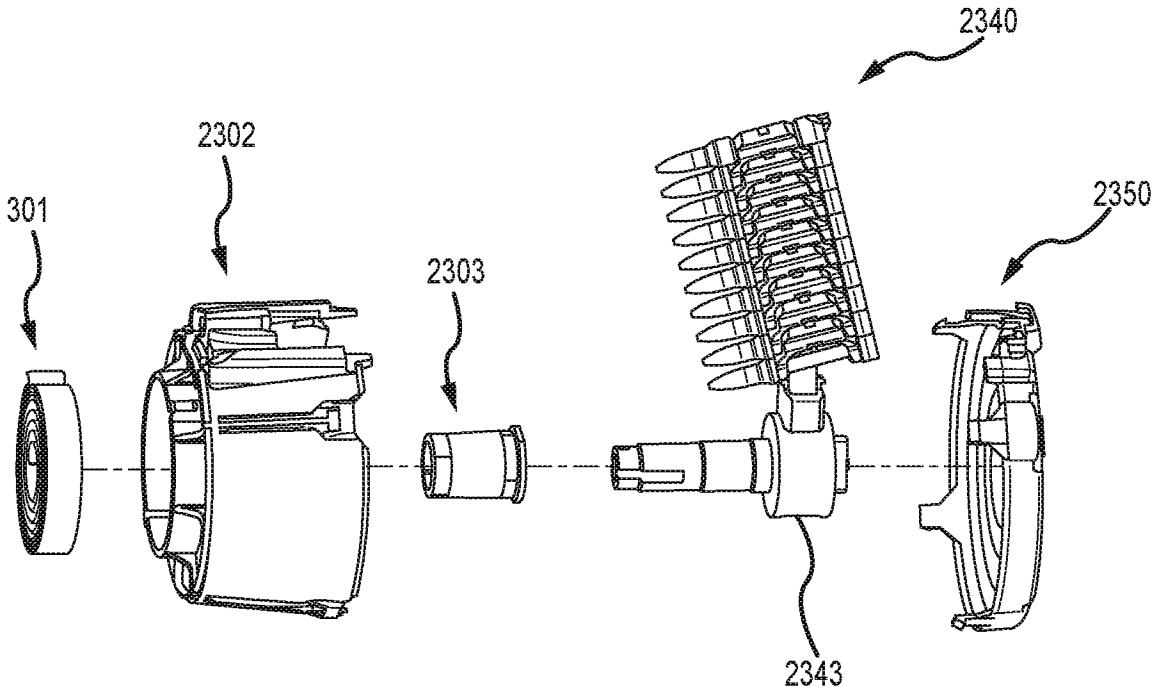
FIG. 25 is an exploded view of some components of the drum magazine in FIG. 23.

Continuing with FIG. 23, the angle $\alpha$ is selected in some embodiments so as to balance the pressure exerted by the spring 301 on the leading cartridge to prevent undesirable diving of the leading cartridge prior to or as it is being fed to the weapon (see also FIGS. 24-25). A number of related factors should be considered to prevent undesirable diving of the leading cartridge, including overall weakened spring pressure due to friction, spring pressure that is improperly balanced on the leading cartridge, causing the leading cartridge to tend to spin about the pitch axis (see FIG. 12A) of the leading cartridge, the angle $\alpha$ between the tower assembly 2370 and the drum assembly 2330, various tolerance stack-up considerations, and/or a deformed or deformable cartridge casing. In some embodiments, an angled tower assembly 2370 is provided to compensate for a nearly or generally straight feed tower as illustrated in FIG. 23, necessitated by the geometry of the firearm. That is, since the feed tower assembly 2370 diverges from the ideal focal point geometry, the assembly 2370 causes pressure on the rear of the cartridge(s) to increase, resulting in a nose-down presentation of the cartridge(s). Angling the tower assembly 2370 forward (compare FIG. 23 with FIG. 2) rebalances the cartridge pressure and forces the cartridge(s) to present properly.

Relatedly, if the follower assembly 2340 is selected so as to allow forces from the spring 301 to transfer to a rear portion of the cartridge, the cartridge is more likely to dive or spin about the pitch axis during feeding even without a front portion of the cartridge deforming. Applicants have therefore determined that an angle $\beta$ of between about 0 degrees and 15 degrees in some embodiments, or between about 0 degrees and about 7 degrees, between about 5 degrees and about 7 degrees, or 7 degrees may be suitable for ensuring enough force is placed on the front portion of the leading cartridge to prevent diving without inadvertently causing the leading cartridge to deform, thereby maximizing the feeding reliability.

Other factors that affect the selection of the angle α include is the limitations of the firearm itself, and the geometry into which the firearm forces the magazine 2300. That is, angling the tower assembly 2300 is, in some embodiments, a solution for correcting divergent geometry, and may be a primary design factor over other design factors such as the number and type of cartridges, friction, deformation of cartridges, etc.

Turning now to FIGS. 24-25, illustrating the drum magazine assembly 2300 and features thereof respectively, the drum magazine assembly 2300 may have some features that are substantially identical to the assembly 1, such as a cover 10, retaining clips 60, a wheel 20, and some features that are similar to the assembly 1, such as a drum assembly 2330, a follower assembly 2340, a rear cover assembly 2350, a feed tower assembly 2370 with a fastener 2371 such as a screw, and a protective cap 2390. It should be understood that, where a description of particular features or functions in the drum magazine assembly 2300 is omitted in this disclosure, the features or functions of the assembly 1 should be understood as applicable or suitable.

In some embodiments, the retaining clips 60 may be configured to allow for disassembly by a user using a basic tool that is typically expected to be available to a user in the field. The basic tool may in some embodiments be a flathead screwdriver, a knife, or, in some cases, a cartridge tip itself.

In some embodiments, the follower assembly 2340 may be provided with a spindle 2343 (see FIG. 25) that does not have teeth for engaging follower links (compare to spindle teeth 4031 in FIG. 9C), to decrease the overall amount of friction in the system. Relatedly, a bushing 2303 made from or coated by a suitably strong and lubricious material may be provided between the drum body 2302 and the spindle 2343 so as to further reduce friction without adversely impacting performance. In other words, the bushing 2303 can be made from or coated by a material that is more lubricious than other materials in the system 2300. In some embodiments, the drum body 2302, spindle 2343, and/or other components may be made of a less lubricious but more durable polymer and/or a reinforced polymer, while the bushing 2303 may be made of a more lubricious material, molybdenum disulfide-filled polymer (MDS) nylon, Acetal, PTFE, etc., to provide overall enhanced strength to the system 2300 while selectively reducing friction in specific areas and/or maintaining impact resistance.

Turning now to FIGS. 26-31, which illustrate various features of some embodiments, a feed tower assembly 2370 is provided. The feed tower assembly 2370 is similar to the feed tower assembly 70 or feed mechanism 801 previously disclosed herein, and includes a drum assembly interface 2372 and a feed tower body 2379 (see FIG. 26A) for guiding cartridges from the drum assembly 2330 (see FIG. 24) towards a feed position to the firearm, as well a cartridge guide 2377 and a cartridge gate 2378 that function substantially as described with reference to the feed tower assembly 70.

In contrast to the feed tower 701 or feed mechanism 801, the feed tower assembly 2370 may exclude a timed cartridge alignment. That is, the feed tower body 2379 may be configured to guide the cartridges in a linear or straight path through the feed tower body 2379, without the jog seen in feed tower 701 or feed mechanism 801. Said another way, the feed tower body 2379 may be configured to maintain the focal axes of cartridges therein substantially in a single plane when the cartridges are between the tower entry 2380 and the tower exit 2381 (see FIG. 29), using fore and aft guides 2376, 2375 and fore and aft rails 2374, 237, most clearly seen in FIGS. 30-31 (contrast with the align element 8016 and diverge element 8017 illustrated in FIG. 18).

Figure 29:
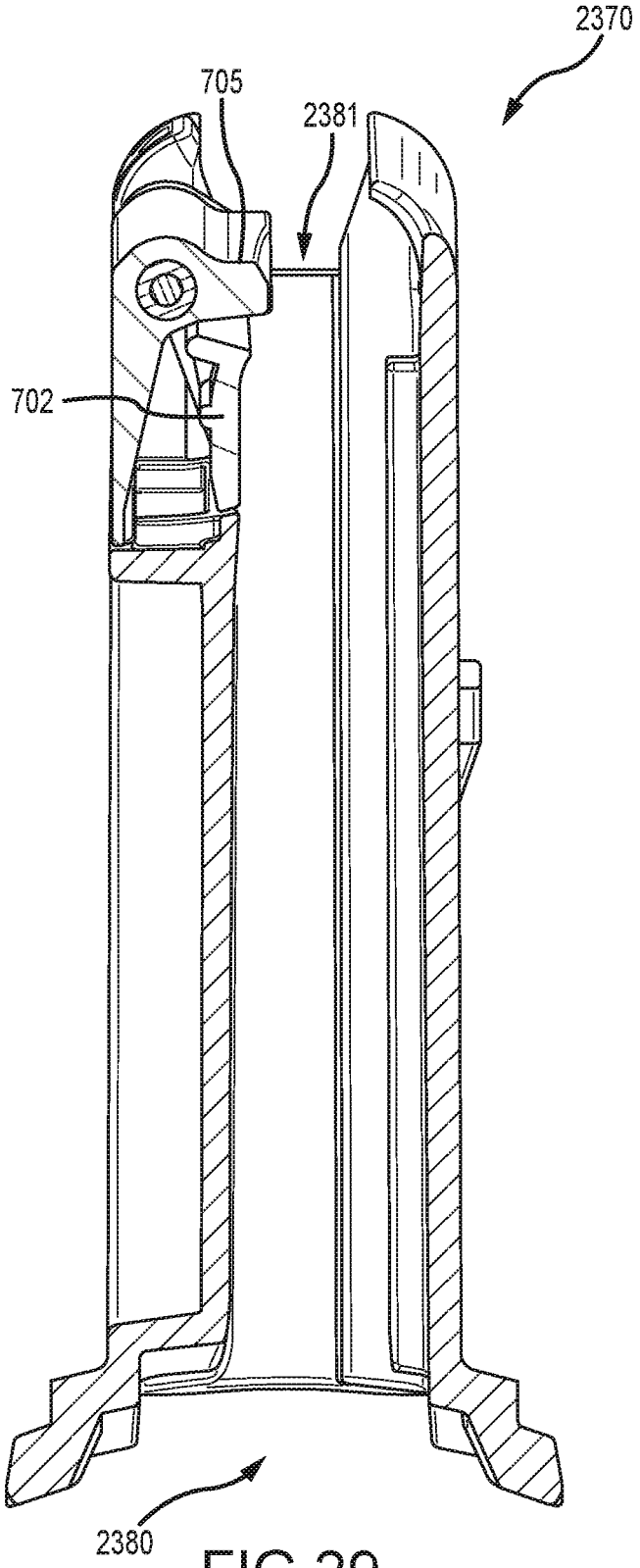
FIG. 29 is a front section view of the feed tower in FIG. 26.
Figure 30:
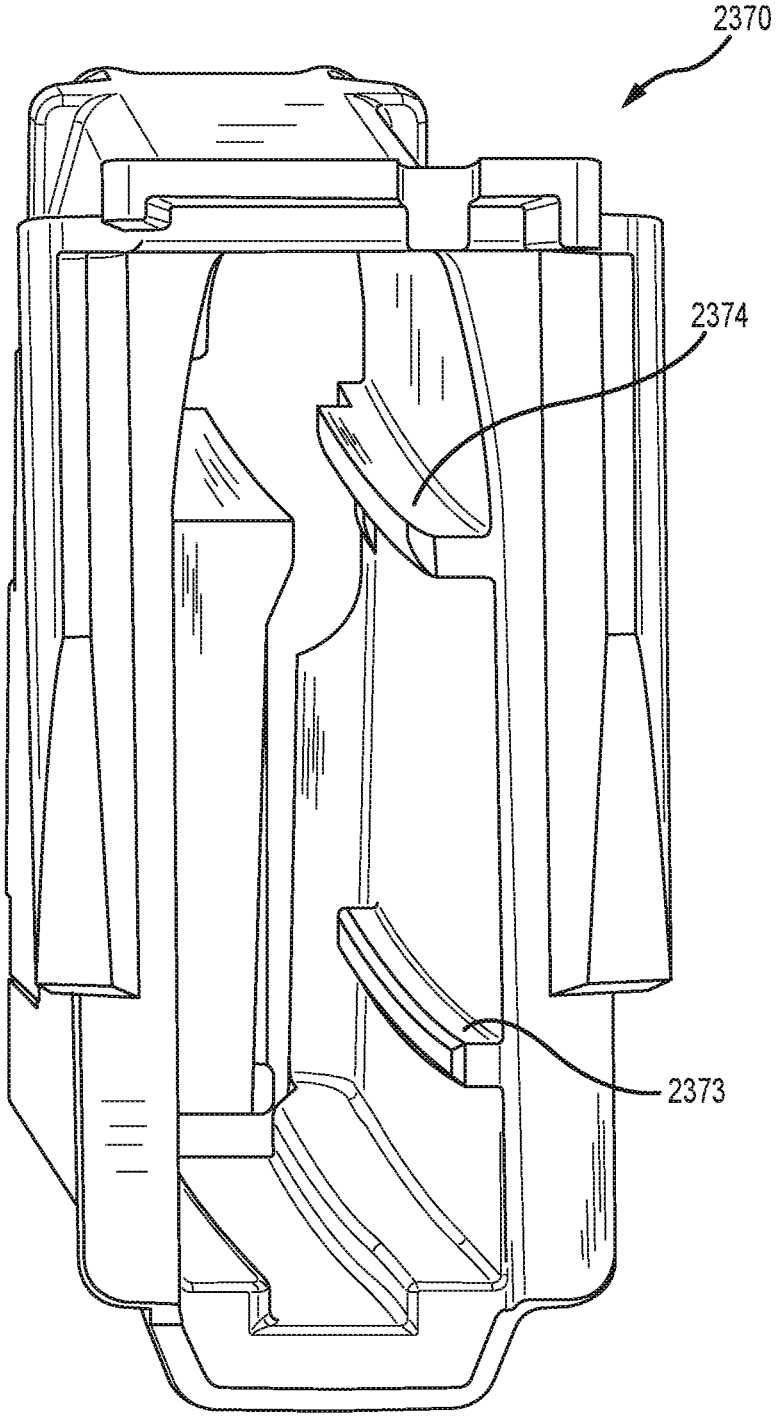
FIG. 30 is a bottom perspective view of the feed tower in FIG. 26.
Figure 31:
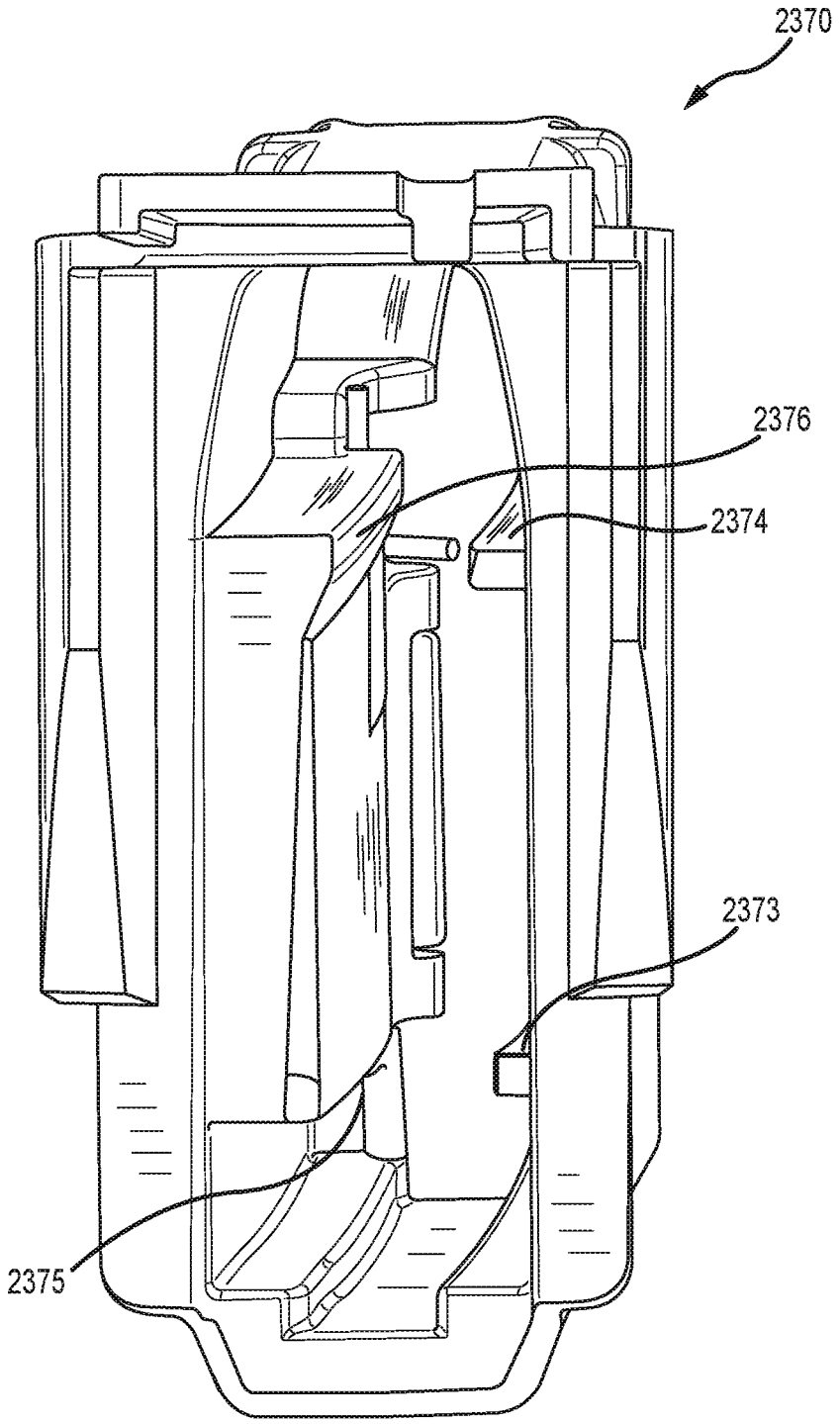
FIG. 31 is a bottom perspective view of the feed tower in FIG. 26.

Continuing with FIG. 29, the cartridge guide 702 and gate 705 can be embodied in any number of shapes or forms. For example, in some embodiments, the cartridge guide 702 may be configured to shift a leading cartridge (not illustrated towards a side of the feed tower assembly 2370 into a feed-ready position. In some embodiments, the gate 705 may be configured to perform this shifting function. In some embodiments, the gate 705 and guide 702 may be configured to perform this function together and/or each of the gate 705 and guide 702 may be configured to perform a portion of this shifting function. Of note, these embodiments of the gate 705 and guide 702 may be included in the feed tower assembly 70 illustrated in FIG. 11.

Figure 26:
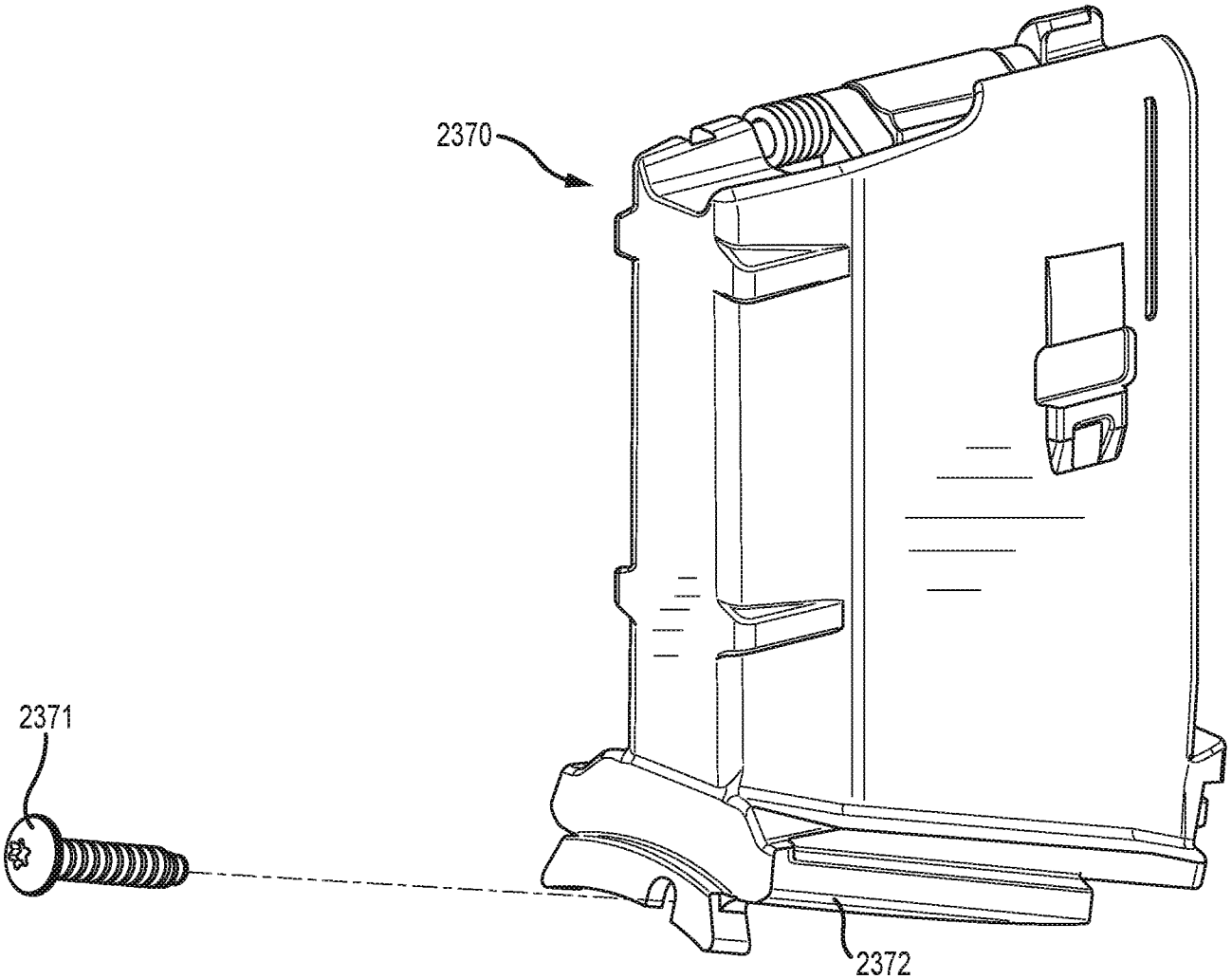
FIG. 26 is a perspective view of a feed tower according to some embodiments.
Figure 26A:
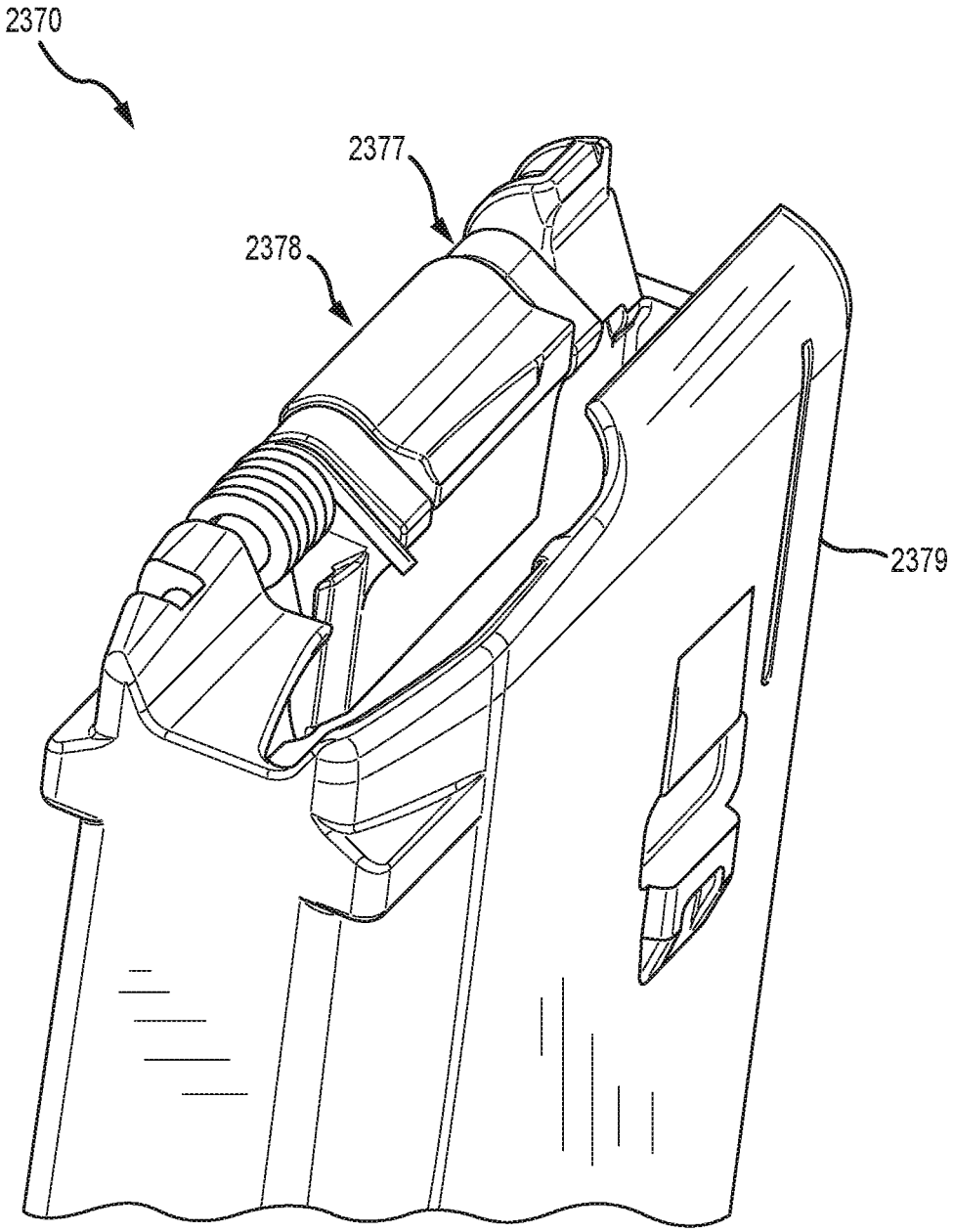
FIG. 26A is a detailed perspective view of some features of the feed tower illustrated in FIG. 26.
Figure 27:
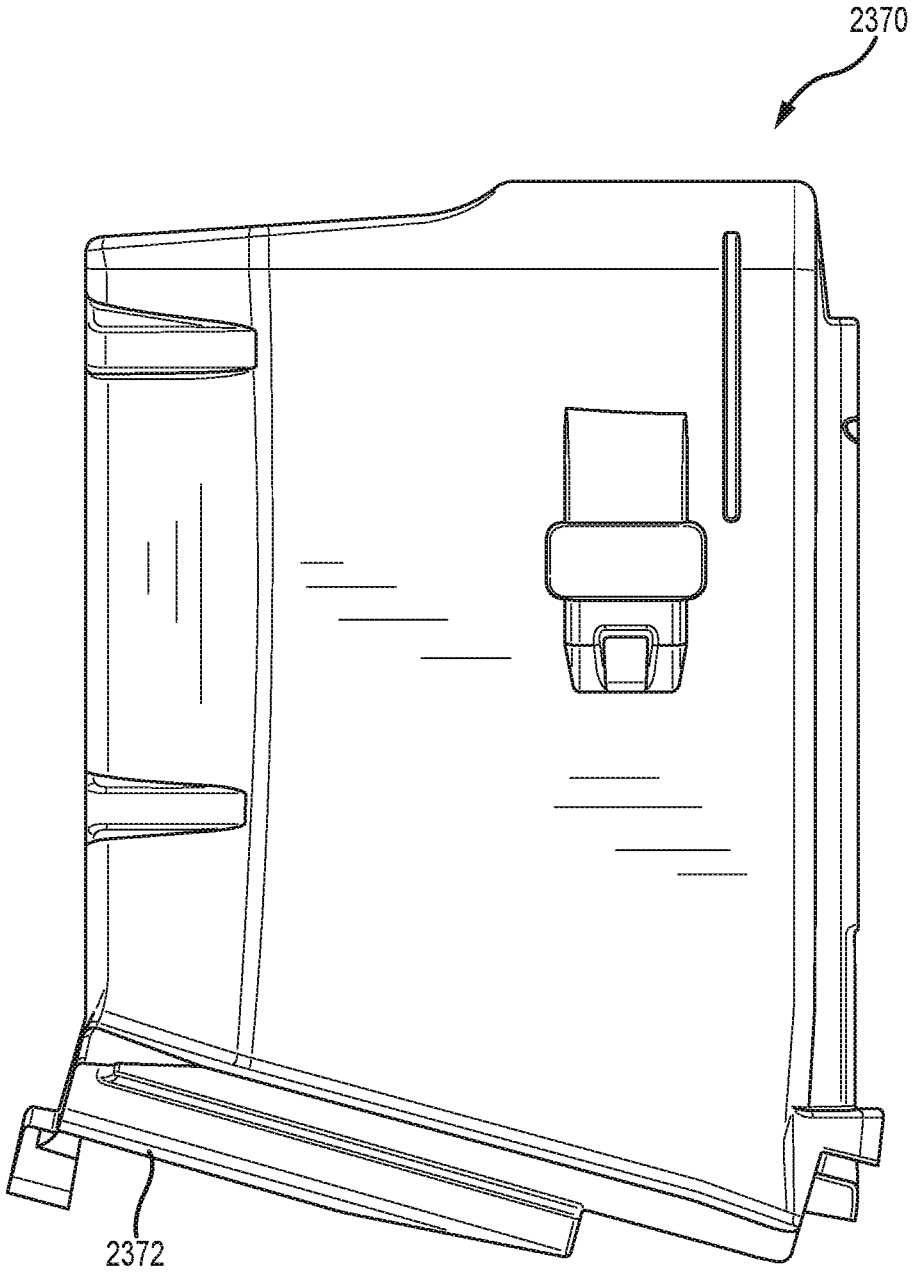
FIG. 27 is a side view of the feed tower in FIG. 26.
Figure 28:
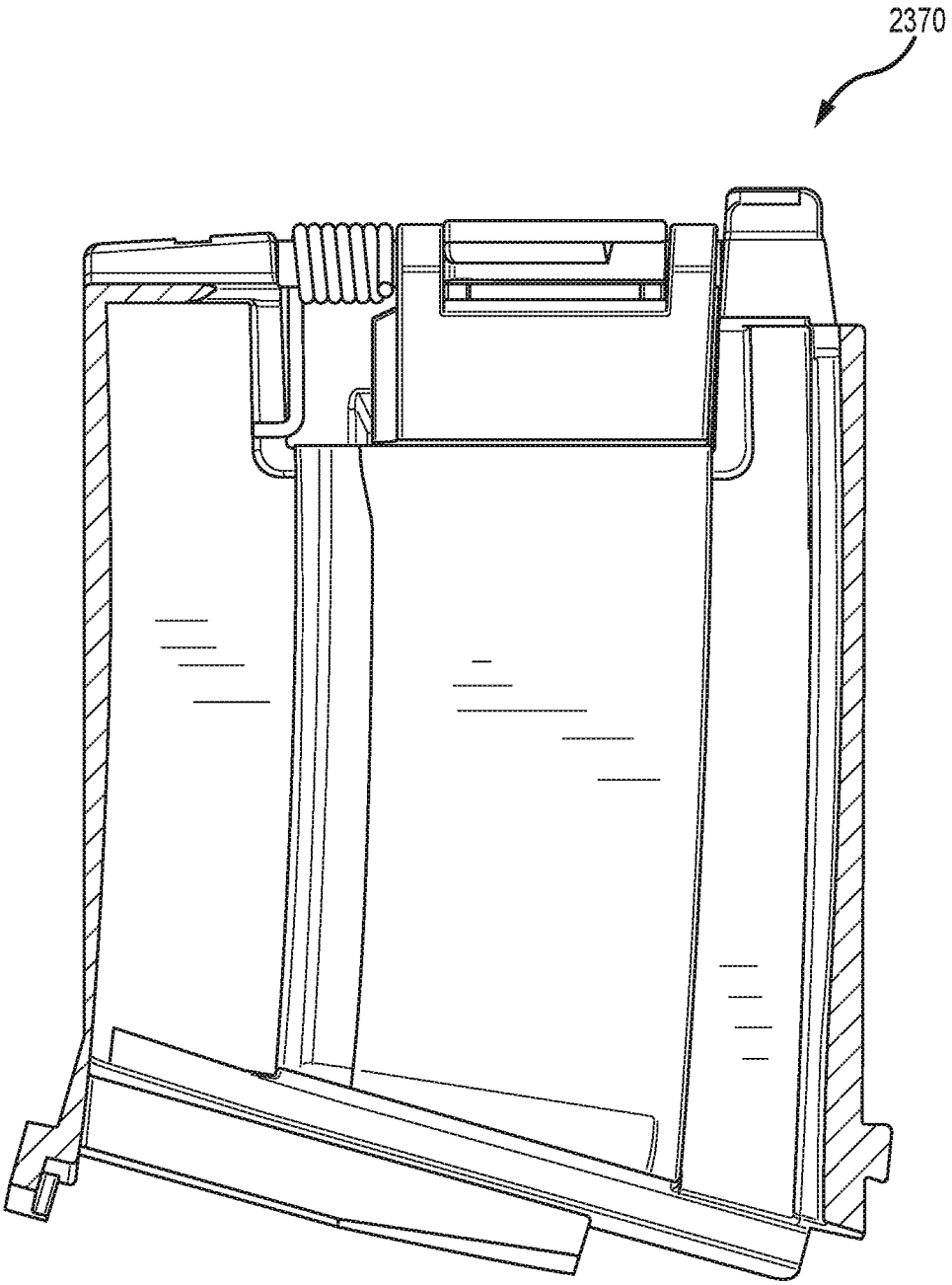
FIG. 28 is a side section view of the feed tower in FIG. 26.

With specific reference to FIG. 26A, and as previously described in reference to the feed tower 701, 801, aspects of the feed tower 2370 can be applied to box magazines as well as the herein described drum magazines. In particular, a feed mechanism such as a box magazine for a firearm may be provided, having the exit features and guides or rails 2376, 2375, 2374, 2373 as illustrated with the feed tower assembly 2370, without an interface 2372 to a drum assembly. That is, the feed tower assembly 2370 may include any floor (not illustrated) known in the art.

Figure 32:
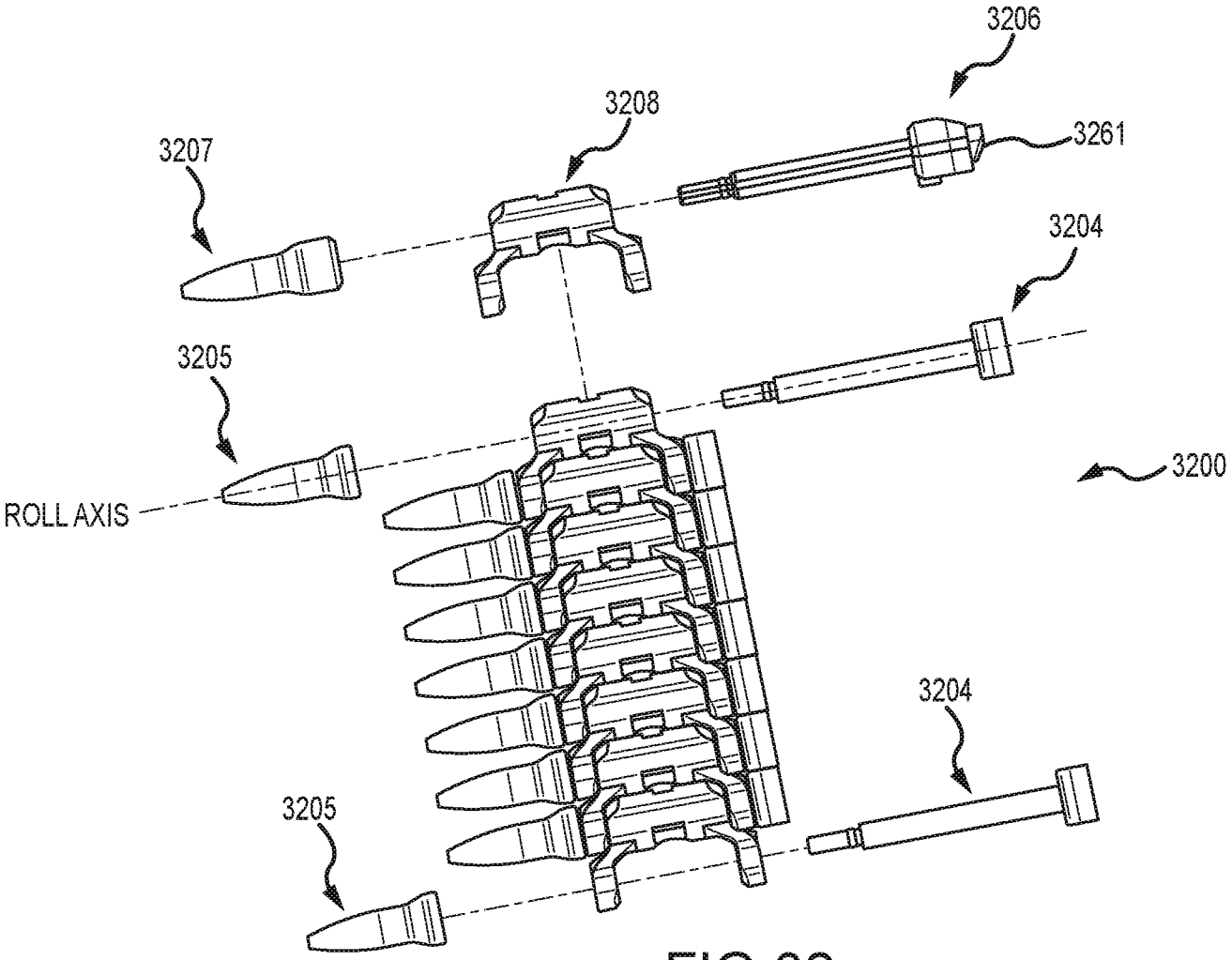
FIG. 32 is a side view illustrating some components of a follower assembly according to an embodiment.
Figure 33:
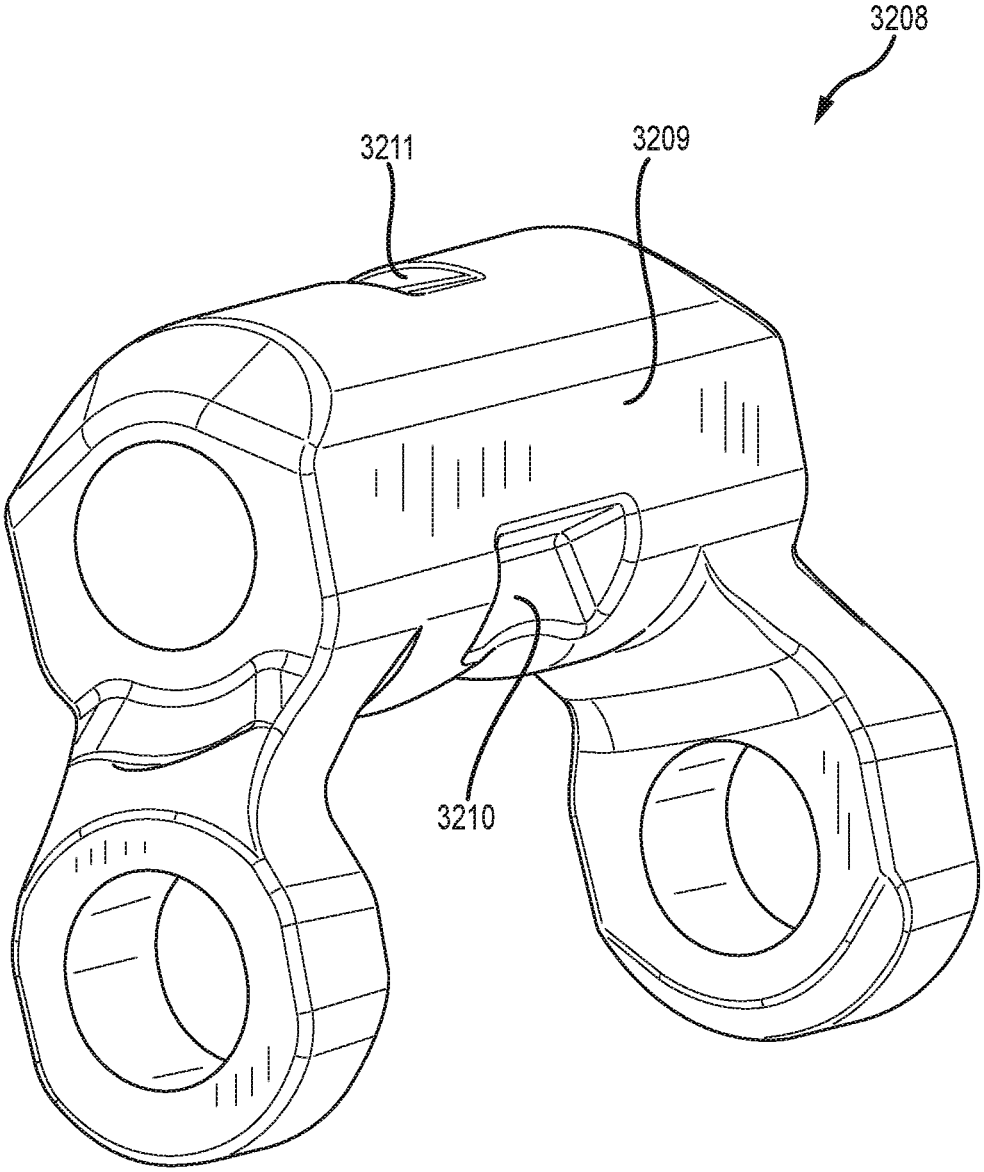
FIG. 33 is a perspective view of a link in the follower assembly illustrated in FIG. 32.
Figure 33A:
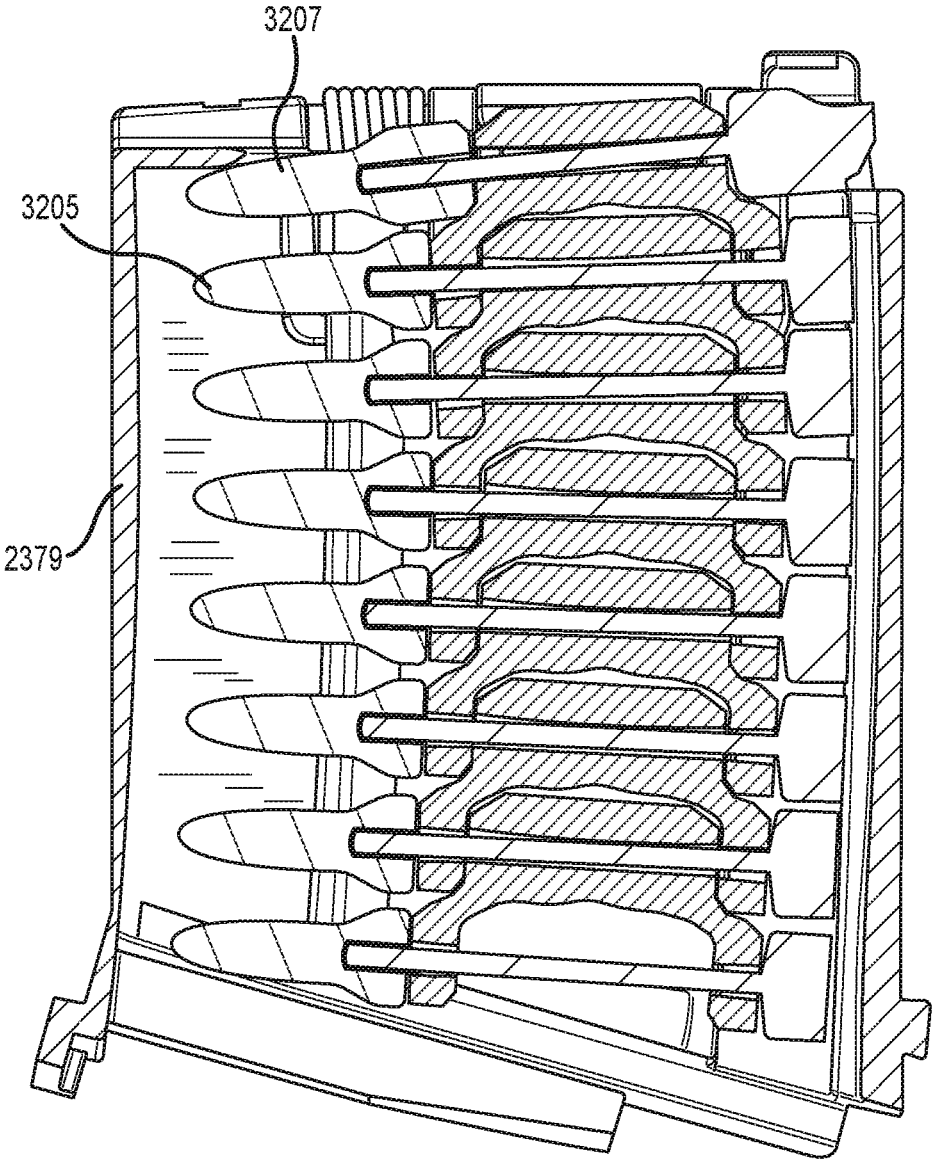
FIG. 33A is a side section view of portions of the follower assembly illustrated in FIG. 32 assembled in the feed tower in FIG. 26.
Figure 33B:
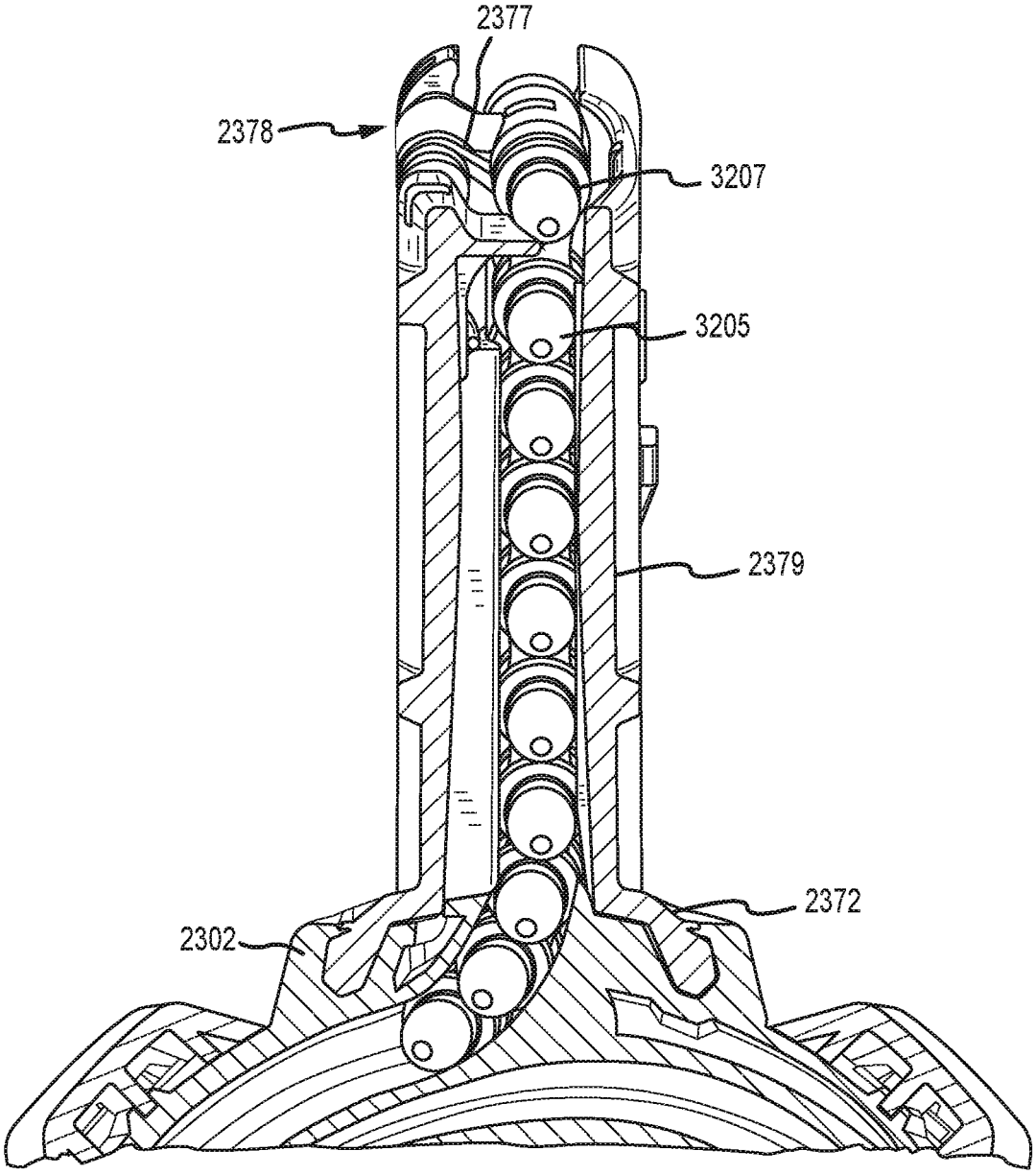
FIG. 33B is a front section view of the assembly in FIG. 33A.

Turning now to FIGS. 32-33, details of the follower assembly 3200 are described in further detail. The follower assembly 3200 comprises a plurality of dummy cartridges, each comprised of a dummy roller 3204 or leading dummy roller 3206 and a follower dummy 3205 or leading follower dummy 3207. A plurality of links 3208 may couple the dummy cartridges together, as illustrated in FIG. 32, and to the spindle 2343, as illustrated in FIG. 25. The follower assembly 3200 functions in a manner substantially similar to the follower assembly 40 illustrated in FIG. 8A. That is, the follower assembly 3200 may have one or a plurality of dummy cartridges that freely rotate relative to an associated link, such as by spinning about a roll axis of the respective dummy cartridge comprising the dummy roller 3204 and dummy 3205 (see FIG. 32). As in the embodiment illustrated in FIG. 8A, the follower assembly 3200 illustrated in FIG. 32 may include a leading dummy roller 3206 that does not spin relative to the leading link 3208 to provide a functioning bolt catch engagement feature 3261. However, as illustrated in FIG. 33, the links 3208 may be configured to further reduce friction and/or contact with the drum body 2302 (see also FIG. 33B) as compared to the links 408 illustrated in FIG. 8B. In some embodiments, the links 3208 may include a recessed surface 3209 configured to prevent friction between the links 3208 and the drum body 2302 or feed tower body 2379. As illustrated in FIG. 33, the links 3208 may also have a lower recess 3210 and/or an upper recess 3211 for providing clearance for other features in the interior of the magazine 2300.

Figure 34:
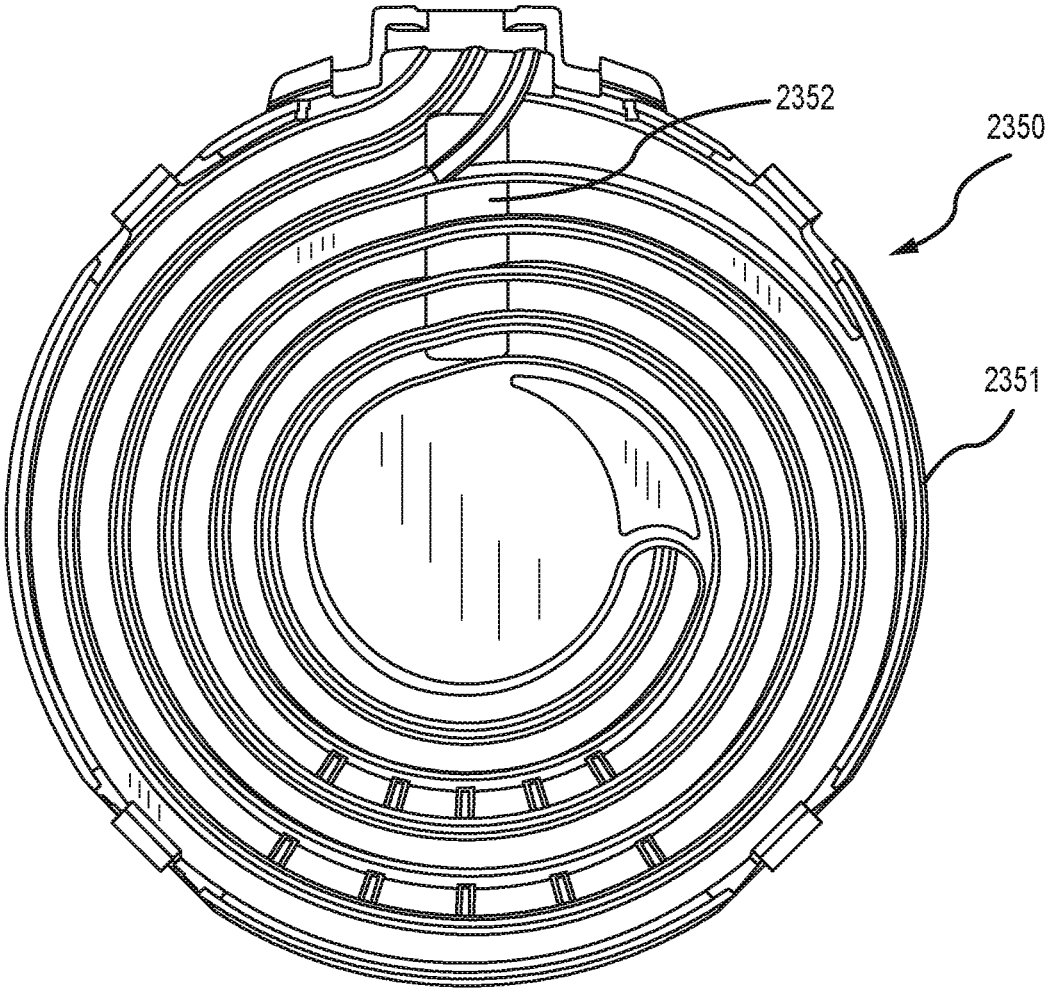
FIG. 34 is a front view of a rear cover of a drum magazine according to an embodiment.
Figure 35:
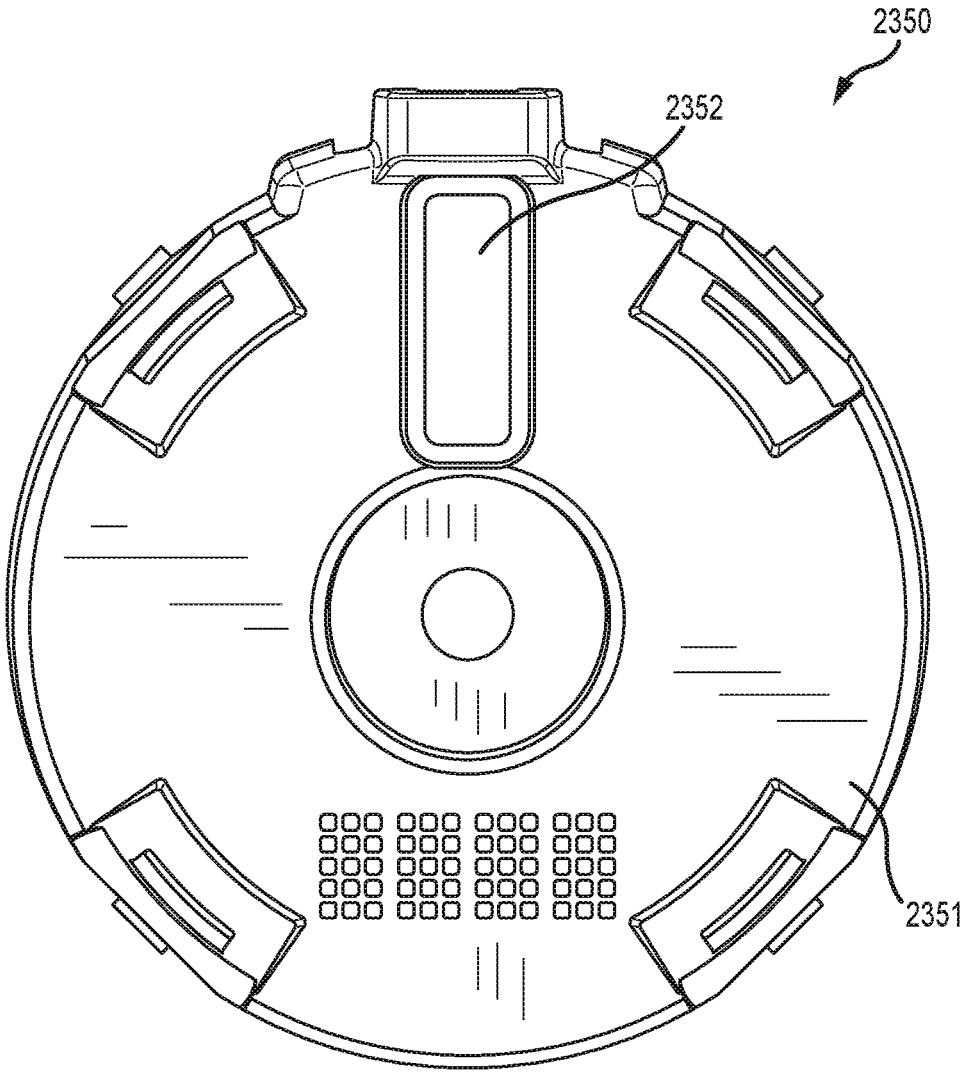
FIG. 35 is a rear view of the rear cover illustrated in FIG. 34.
Figure 36:
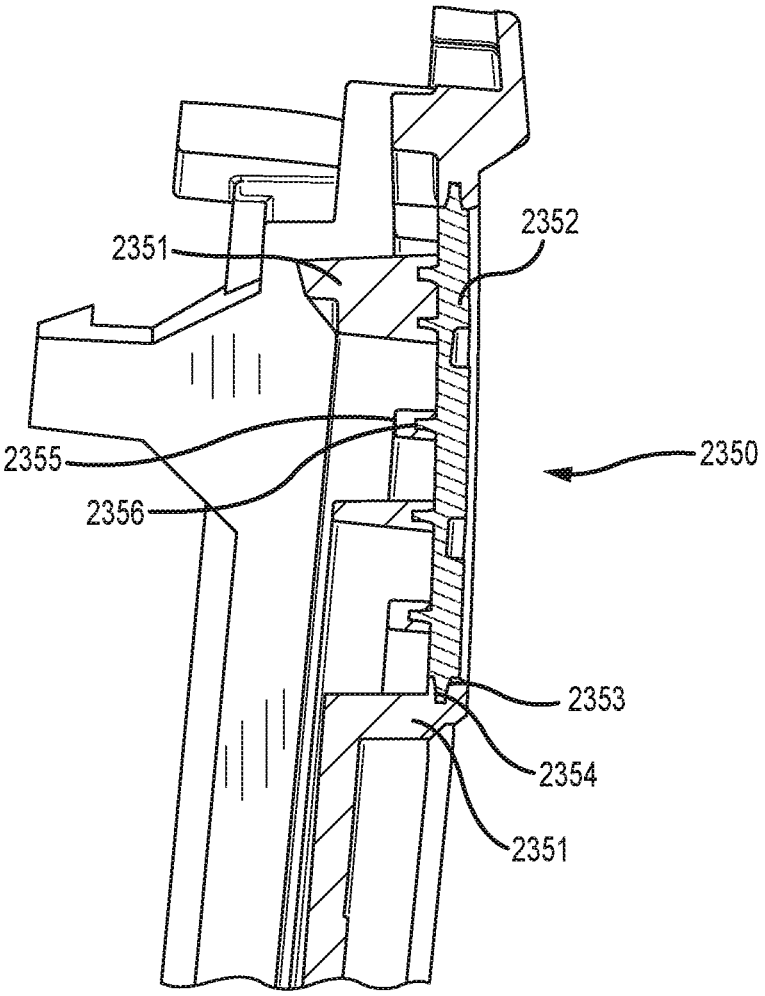
FIG. 36 is a side section view of the rear cover illustrated in FIG. 34.
Figure 37:
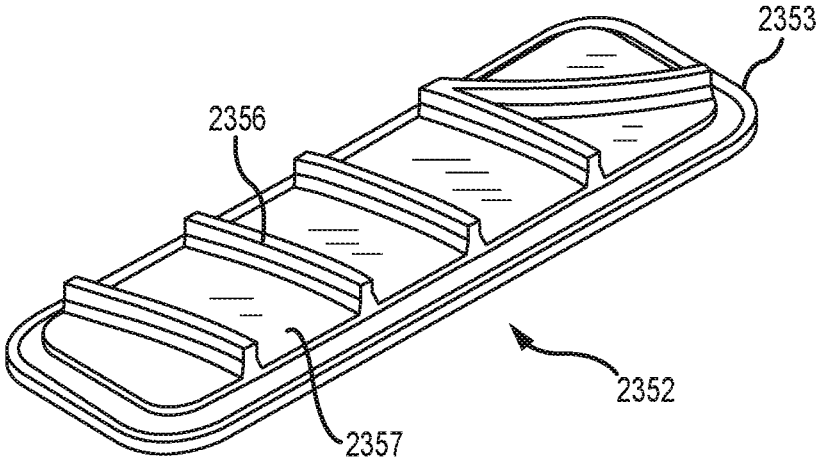
FIG. 37 is a perspective view of a viewing window according to an embodiment.

Turning now to FIGS. 34-36, details of a rear cover assembly 2350 are now described. In some embodiments, the rear cover assembly 2350 may include a rear cover 2351 and a clear window 2352 to provide a user with a visual indication of the number of cartridges remaining in the drum magazine assembly 2300. In some embodiments, the window 2352 may include a flange 2353 for engaging a recess 2354 in the rear cover 2351. See FIGS. 36-37 for various details of the window 2352 and the rear cover 2351. In some embodiments, the rear cover 2351 may be over-molded on the window 2352 or a portion of the window 2352 (e.g., over-molded on the flange 2353) to provide a smooth track surface on which cartridges or dummy cartridges may travel. That is, as illustrated in FIG. 36, the rear cover 2351 may have a track ridge 2355 that functions substantially as the track ridge 501, illustrated in FIGS. 7A-7C. The track ridge 2355 may be over-molded onto one or more protrusions 2356 in a viewing window 2352 and/or shaped to engage the protrusion(s) 2356 while maintaining a smooth path of travel for a cartridge or follower in the assembly 2300 (see FIG. 24).

Figure 38:
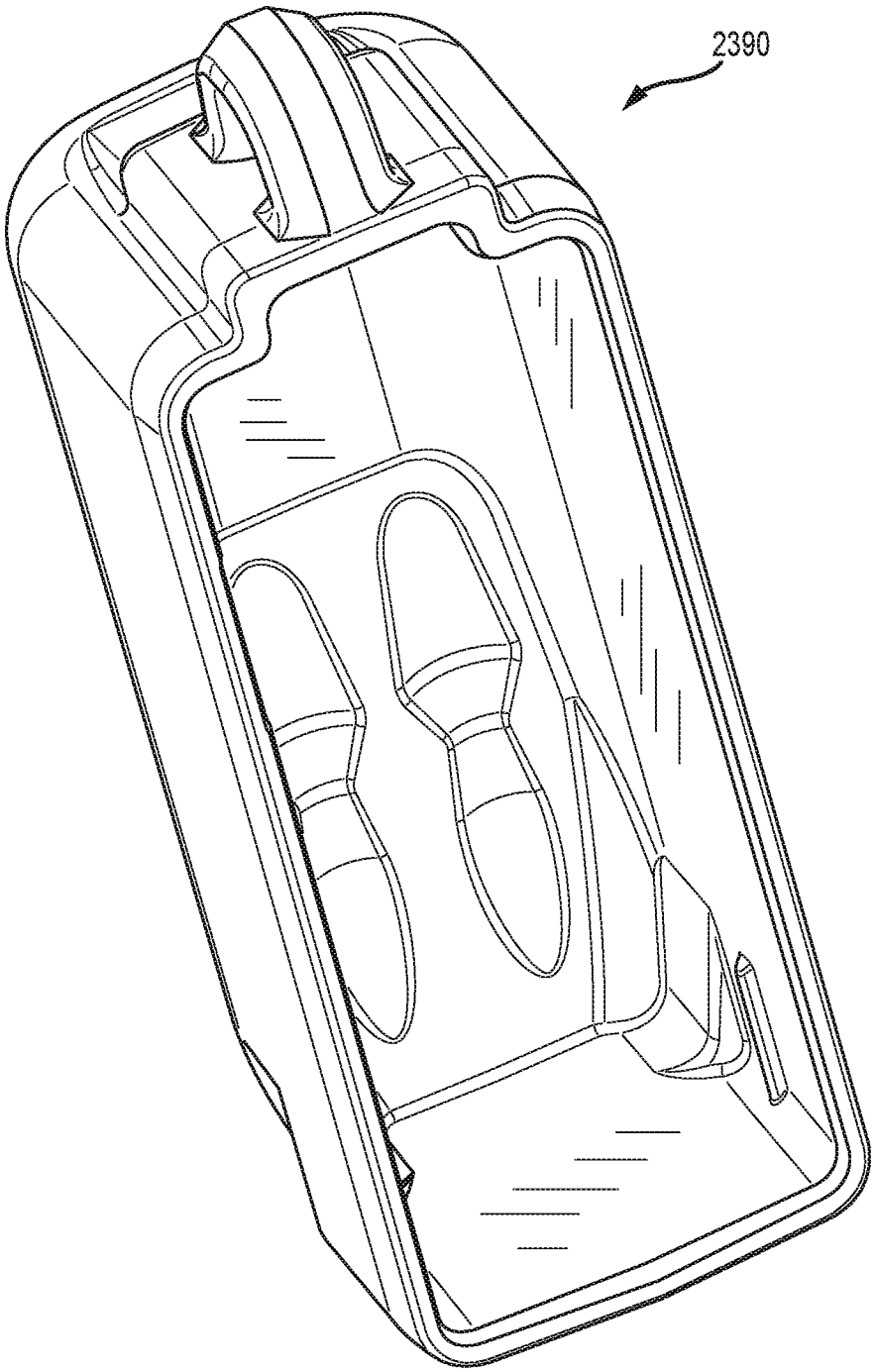
FIG. 38 is a bottom perspective view of a feed mechanism cap according to an embodiment.
Figure 39:
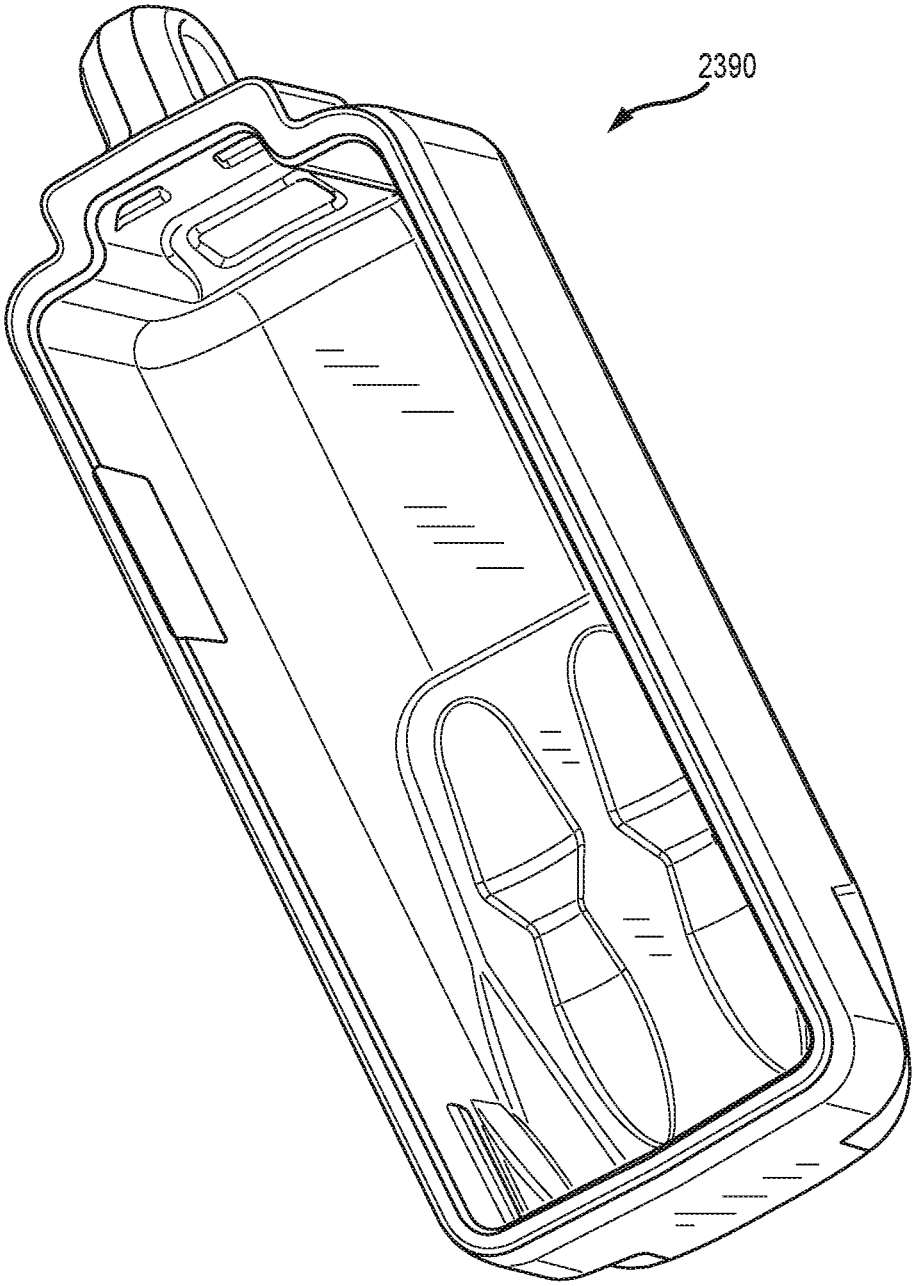
FIG. 39 is another bottom perspective view of the feed mechanism cap in FIG. 38.

Turning now to FIGS. 38-39, a protective cap 2390 may be provided to protect the exit portion or feed end of the feed tower assembly 2370 during transportation or storage of the drum magazine assembly 2300 or feed tower assembly 2370 (see e.g. FIG. 24).

Figure 40:
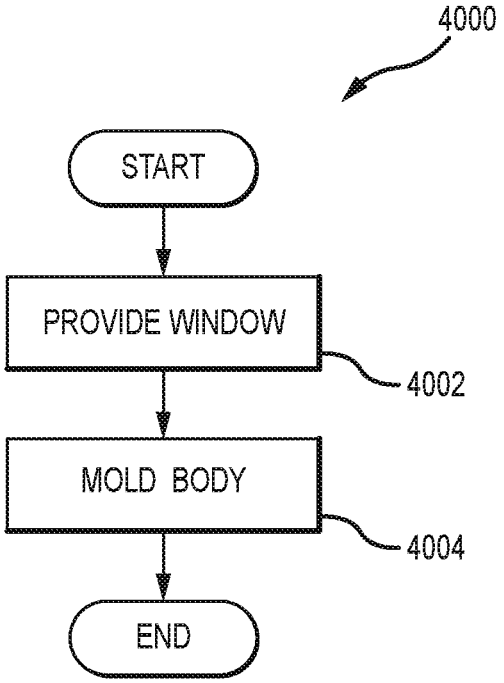
FIG. 40 is a flow diagram of another method according to an embodiment.

Turning now to FIG. 40, a method 4000 of manufacturing a rear cover assembly is now described. The method 4000 includes providing 4002 a window, such as the viewing window 2352 illustrated in FIG. 37, having at least one flange 2353 and at least one protrusion 2356. The flange 2353 may be a protrusion or ridge substantially parallel to a viewing pane 2357, and may provide enough surface area to which a recess 2354 (see e.g., FIG. 36) in the rear cover 2352 may reliably adhere. Relatedly, the protrusion 2356 may extend substantially perpendicularly from the viewing pane 2357. The method 4000 further includes molding 4004 a rear cover body onto the window in a configuration such that the protrusion extends towards an interior region of the rear cover body in an over-molding process, to provide a rear cover assembly, which may be substantially as illustrated in FIGS. 34-36. In some embodiments, the rear cover body may be made of a polymer, or a reinforced polymer, and/or the viewing window may be made of a clear polymer.

A number of embodiments disclosed herein are listed below. Group I embodiments define an arm, lever, pawl assembly, a system, and a method. Group II embodiments define a follower assembly, a system, and a method. Group III embodiments define a cartridge guide, a system, and a method. Group IV embodiments focus on a timed cartridge alignment. Group V embodiments focus on constraining cartridge tips.

Group I embodiments include the following:

Embodiment 1: a drum magazine assembly for a firearm, the drum magazine assembly comprising: a drum assembly comprising a wheel; a spindle assembly; a feed tower assembly; and an advancing mechanism to advance the wheel such that one or more cartridges of ammunition may be loaded after advancing the wheel, the advancing mechanism comprising an arm, a pawl, and a lever, wherein: the arm is configured to pivot about a first pivot axis to drive the pawl about the first pivot axis, the first pivot axis defined by the spindle assembly; the pawl is configured to pivot about a second pivot axis between a free position and an engage position, the second pivot axis defined by a distal section of the arm; the pawl is further configured to selectively engage the wheel when the pawl is in the engage position; the lever is configured to pivot the pawl about the second pivot axis; the lever is further configured to move relative to the second pivot axis between a closed position and an open position.

Embodiment 2: the drum magazine assembly of embodiment 1, wherein: the lever is configured to bias the pawl towards the free position when the lever is in the closed position; and the lever is configured to bias the pawl towards the engage position when the lever is in the open position.

Embodiment 3: the drum magazine assembly of embodiment 1, wherein: the lever comprises a pawl pin and spring to bias the pawl towards the free position when the lever is in the closed position, and to bias the pawl towards the engage position when the lever is in an open position.

Embodiment 4: the drum magazine assembly of embodiment 1, wherein: the lever comprises an advancement lock to prevent the pawl from engaging the wheel when the lever is in the closed position.

Embodiment 5: the drum magazine assembly of embodiment 4, wherein: the advancement lock comprises configured clearance groove to provide a clearance to selectively allow advancement of the wheel when the lever is in the open position.

Embodiment 6: the drum magazine assembly of embodiment 5, wherein: the lever comprises a lever lock configured to prevent the lever from being moved from the closed position to the open position when the drum magazine assembly is installed in a weapon.

Embodiment 7: the drum magazine assembly of embodiment 1, further comprising: an arm return spring configured to return the arm to a start position after an advancing motion.

Embodiment 8: the drum magazine assembly of embodiment 1, wherein: the advancing mechanism is configured to advance the wheel such that two or more cartridges of ammunition may be loaded after advancing the wheel.

Embodiment 9: an advancing mechanism for a drum magazine assembly, the advancing mechanism comprising an arm, a pawl, and a lever, wherein: the advancing mechanism is configured to advance a wheel of a drum magazine assembly such at least one cartridge of ammunition may be loaded after advancing the wheel; the arm is configured to pivot about a first pivot axis, the first pivot axis defined by a spindle of a drum magazine assembly, the arm further configured to drive the pawl; the pawl is configured to pivot about a second pivot axis between a free position and an engage position, the second pivot axis defined by a distal section of the arm, to selectively engage a wheel of a drum magazine assembly when the pawl is in the engage position; the lever is configured to pivot the pawl about the second pivot axis, the lever further configured to move relative to the second pivot axis between a closed position and an open position.

Embodiment 10: the advancing mechanism of embodiment 9, wherein: the lever biases the pawl towards the free position when the lever is in the closed position; and the lever biases the pawl towards the engage position when the lever is in an open position.

Embodiment 11: the advancing mechanism of embodiment 10, wherein: the lever comprises a pawl pin and spring to bias the pawl towards the free position when the lever is in the closed position, and to bias the pawl towards the engage position when the lever is in an open position.

Embodiment 12: the advancing mechanism of embodiment 9, wherein: the advancing mechanism is configured to advance a wheel of a drum magazine assembly such that two or more cartridges of ammunition may be loaded after advancing the wheel.

Embodiment 13: the advancing mechanism of embodiment 9, wherein: the lever comprises an advancement lock to prevent the lever from driving the wheel when the lever is in the closed position.

Embodiment 14: the advancing mechanism of embodiment 13, wherein: the advancement lock comprises a clearance groove to provide a clearance for allowing the lever to advance when the lever is in the open position.

Embodiment 15: the advancing mechanism of embodiment 9, wherein: the lever comprises a lever lock configured to prevent the lever from being moved from the closed position to the open position when the advancing mechanism is installed in a drum magazine assembly installed in a weapon.

Embodiment 16: the advancing mechanism of embodiment 9, wherein: the advancing mechanism is configured to advance a wheel having teeth arranged about a distal circumference of the wheel.

Embodiment 17: the advancing mechanism of embodiment 16, further comprising: an arm return spring configured to return the arm to a start position after an advancing motion in the drum magazine assembly.

Embodiment 18: a method of loading a drum magazine assembly, comprising: advancing a wheel about a first pivot axis, wherein advancing comprises moving a lever relative to a second pivot axis from a closed position to an open position; causing the lever to pivot a pawl about the second pivot axis and selectively engage the wheel; causing the lever to engage an arm to drive the pawl and wheel about the first pivot axis; retracting a follower assembly; and inserting one or more cartridges of ammunition into the drum magazine assembly.

Embodiment 19: the method of embodiment 18, further comprising: engaging a lever lock to prevent an advancing motion.

Embodiment 20: the method of embodiment 18, further comprising: bracing the drum magazine assembly; wherein advancing and bracing are performed using a single hand.

Group II embodiments include the following:

Embodiment 1: a drum magazine assembly comprising: a follower assembly; a drum body; a spring assembly; and a feed tower assembly; wherein the follower assembly is configured to bias cartridges towards an exit of the feed tower assembly; and the follower assembly comprises a plurality of dummy cartridges, the plurality of dummy cartridges comprising a leading dummy cartridge and a last dummy cartridge, and a plurality of links comprising a leading link and a last link; and wherein the last dummy cartridge is configured to rotate relative to the last link and the leading link, and the leading dummy cartridge comprises a bolt catch engagement feature.

Embodiment 2: the drum magazine assembly of embodiment 1, further comprising: at least one middle dummy cartridge configured to rotate relative to the last link and the leading link.

Embodiment 3: the drum magazine assembly of embodiment 1, wherein: the follower assembly comprises an extended configuration and a retracted configuration; and the drum body, is configured to maintain a focal point of the plurality of dummy cartridges substantially converged at a predetermined focal distance from the follower assembly when the follower assembly is in the extended configuration.

Embodiment 4: the drum magazine assembly of embodiment 1, wherein: the follower assembly comprises an extended configuration and a retracted configuration; and the drum body and the feed tower assembly are configured to maintain a focal point of the plurality of dummy cartridges substantially converged at a predetermined focal distance from the drum body when the follower assembly is in the retracted configuration and the extended configuration.

Embodiment 5: the drum magazine assembly of embodiment 1; wherein an outermost portion of the spring is fixed relative to the drum body; and an innermost portion of the spring is free to rotate relative to the drum body.

Embodiment 6: a follower assembly for a firearm drum magazine, the follower assembly comprising: a plurality of dummy cartridges comprising a leading dummy cartridge and a last dummy cartridge; and a plurality of links comprising a leading link and a last link; wherein the last dummy cartridge is configured to rotate relative to the last link and the leading link.

Embodiment 7: the follower assembly of embodiment 6, further comprising: at least one middle dummy cartridge configured to rotate relative to the last link and the leading link.

Embodiment 8: the follower assembly of embodiment 7, wherein: the middle dummy cartridge and the last dummy cartridge are configured to rotate relative to each other and the leading dummy cartridge.

Embodiment 9: the follower assembly of embodiment 6, wherein: the leading dummy cartridge is configured to not rotate relative to the leading link.

Embodiment 10: the follower assembly of embodiment 6, wherein: the follower assembly comprises an extended configuration and a retracted configuration; and the plurality of links is configured to maintain a focal point of the plurality of dummy cartridges converged at a predetermined focal distance from the follower assembly when the follower assembly is in the extended configuration.

Embodiment 11: the follower assembly of embodiment 10, wherein: the plurality of links is configured to maintain the focal point of the plurality of dummy cartridges substantially converged at the predetermined focal distance from the follower assembly when the follower assembly is in the retracted configuration.

Embodiment 12: the follower assembly of embodiment 6, wherein: the plurality of links is configured to maintain a predetermined separation distance between the first dummy cartridge and the last dummy cartridge.

Embodiment 13: the follower assembly of embodiment 6, wherein: the plurality of links forms a kinematic chain independent of the plurality of dummy cartridges.

Embodiment 14: the follower assembly of embodiment 6, wherein: a portion of the leading dummy cartridge extends through at least a portion of a passage in the leading link.

Embodiment 15: the follower assembly of embodiment 14, further comprising: at least one middle dummy cartridge configured to rotate relative to the last link and the leading link; and wherein: a portion of the middle dummy cartridge extends through at least a portion of a passage in the leading link, and a portion of the middle dummy cartridge extends through at least a portion of a passage in the last link.

Embodiment 16: the follower assembly of embodiment 15, wherein: a portion of the last dummy cartridge extends through at least a portion of a passage in the last link.

Embodiment 17: the follower assembly of embodiment 6, wherein: the follower assembly comprises a spindle configured to drive at least one of the links and not to abut the plurality of dummy cartridges when the follower assembly is in the retracted configuration.

Embodiment 18: the follower assembly of embodiment 6, wherein: the leading dummy cartridge comprises a bolt catch engagement feature.

Embodiment 19: a method of controlling the movement of a cartridge in a drum magazine assembly, the method comprising: causing a follower assembly to bias the cartridge towards an exit in the drum magazine assembly, the follower assembly comprising a plurality of dummy cartridges having a leading dummy cartridge and a last dummy cartridge; moving the follower assembly from a retracted configuration within a drum body of the drum magazine assembly to an extended configuration within a drum body of the drum magazine assembly while allowing the last dummy cartridge to rotate relative to a body of the drum magazine assembly.

Embodiment 20: the method of embodiment 19; further comprising: causing a follower assembly to bias the cartridge towards an exit in the drum magazine assembly, the follower assembly comprising at least one middle dummy cartridge; and moving the follower assembly from the retracted configuration to the extended configuration while allowing the middle dummy cartridge to rotate relative to the body of the drum magazine assembly.

Embodiment 21: the method of embodiment 19; further comprising: maintaining a focal point of the plurality of dummy cartridges substantially converged at a predetermined focal distance from the drum magazine assembly when the follower assembly is moved between the retracted configuration and the extended configuration.

Embodiment 22: the method of embodiment 19; further comprising: expending a cartridge from the drum magazine assembly; and engaging a bolt catch.

Embodiment 23: the method of embodiment 19; further comprising: forming a kinematic chain independent of the plurality of dummy cartridges, and transferring a spring force from a spring to a loaded cartridge through the kinematic chain.

Embodiment 24: the method of embodiment 20; further comprising: forming a kinematic chain independent of the middle dummy cartridge and the last dummy cartridge, and transferring a spring force from a spring to a bolt catch engagement feature through the kinematic chain.

The method of embodiment 19; further comprising: causing a follower assembly to bias the loaded cartridge towards an exit in the drum magazine assembly, the follower assembly comprising at least one middle dummy cartridge coupled to the leading dummy cartridge by a link; and moving the follower assembly from the retracted configuration to the extended configuration while allowing the middle dummy cartridge to rotate relative to the link.

Group III embodiments include the following:

Embodiment 1: a feed mechanism for a firearm magazine, comprising: a feed housing having a track configured to constrain a cartridge in a first travel path as the cartridge is moved through the feed housing, an exit through which a cartridge may be chambered in a firearm; wherein the feed mechanism is configured to constrain the focal point of a cartridge approximately converged at a first point a predetermined distance from the feed tower assembly as the cartridge is moved along the first travel path.

Embodiment 2: the feed mechanism of embodiment 1; comprising: a guide, the guide having a wall position and a retracted position relative to the feed tower; wherein the guide is configured to guide cartridges as they move along the track towards the exit when the guide is in the wall position; the guide is further configured to move into the retracted position when a retract force is applied to the guide, the retracted position providing a track recess.

Embodiment 3: the feed mechanism of embodiment 2, wherein: the guide is biased towards the wall position.

Embodiment 4: the feed mechanism of embodiment 2, wherein: the guide is configured to move to the retracted position when a first cartridge is forcibly moved from a chamber-ready position into the feed tower assembly, and to seat one of a second cartridge and a dummy cartridge, until the first cartridge is returned to the chamber-ready position.

Embodiment 5: the feed mechanism of embodiment 2, wherein: the guide is biased towards the wall position.

Embodiment 6: the feed mechanism of embodiment 2, wherein: the guide comprises a bend configured to bias a cartridge towards a feed lip in the feed tower as the cartridge travels through the track towards the exit.

Embodiment 7: the feed mechanism of embodiment 1, further comprising: a gate, the gate having a rest position and a load position, the gate configured to prevent a cartridge from unintentionally escaping the exit of the feed tower when the gate is in the rest position, the gate further configured to move into the load position when a load force is applied.

Embodiment 8: the feed mechanism of embodiment 7, wherein the gate is configured to move into the load position when a cartridge is being inserted into the feed tower through the exit.

Embodiment 9: the feed mechanism of embodiment 7, wherein the gate is further configured to engage a firearm when the feed mechanism is installed in a firearm, and to maintain the rest position until the feed mechanism is removed from the firearm.

Embodiment 10: the feed mechanism of embodiment 9, wherein the gate comprises a gate lock to engage a firearm when the feed mechanism is installed in a firearm.

Embodiment 11: the feed mechanism of embodiment 7, wherein: the gate is biased towards the rest position.

Embodiment 12: the feed mechanism of embodiment 1, further comprising: a gate-guide mount for at least one of a gate and a guide.

Embodiment 13: the feed mechanism of embodiment 1, wherein: the track is configured to constrain a second cartridge in a second travel path as the second cartridge is moved through the feed mechanism; and the feed mechanism is configured to cause the focal point of the second cartridge to diverge from the focal point of a first cartridge as the second cartridge is moved along the second travel path.

Embodiment 14: the feed mechanism of embodiment 1, further comprising: engagement ribs for interfacing with a drum body of a drum magazine and one of a front cover and a rear cover of the drum magazine; wherein the engagement ribs do not interface with the other of a front cover and a rear cover of the drum magazine.

Embodiment 15: a firearm magazine assembly comprising: a feed tower assembly, the feed tower assembly comprising a feed tower having a track configured to constrain a cartridge in a first travel path as the cartridge is moved through the feed tower, an exit through which a cartridge may be chambered in a firearm, and a mounting portion; and a body assembly having a track configured to constrain a cartridge in a second travel path as the cartridge is moved through the body assembly; wherein the body assembly is configured to constrain the focal point of a cartridge substantially at a single point as the cartridge is moved along the second travel path; and the track in the feed tower is configured to constrain a focal axis of the cartridge in a single plane as the cartridge is moved along the first travel path.

Embodiment 16: the firearm magazine assembly of embodiment 15, wherein: the feed tower is configured to cause the focal point of a cartridge to diverge from the plane as the cartridge is moved along a third travel path within the feed tower.

Embodiment 17: a method of using a feed mechanism for a firearm magazine, the method comprising: installing a feed mechanism having a first cartridge in a chamber-ready position into a firearm having a closed bolt; and seating one of a second cartridge and a dummy cartridge.

Embodiment 18: the method of embodiment 17, further comprising: retracting the bolt; returning the first cartridge to the chamber-ready position; and returning the one of the second cartridge and the dummy cartridge to the track.

Embodiment 19: the method of embodiment 17; comprising: using a gate to prevent a loaded cartridge from unintentionally escaping the exit of the feed mechanism; and applying a load force to the gate, to move the gate from a feed position into a load position.

Embodiment 20: the method of embodiment 17; comprising: applying a spring force on a cartridge as the cartridge is moved into a chamber-ready position, wherein the spring force on the frontward portion of the cartridge is equal to or greater than the spring force on the rearward portion of the cartridge.

Embodiment 21: the method of embodiment 17; comprising: causing the feed mechanism to lockingly engage a drum body of a drum magazine; causing the feed mechanism to lockingly engage one of a front cover and a rear cover of the drum magazine; and preventing the feed mechanism from lockingly engaging with the other of a front cover and a rear cover of the drum magazine.

Group IV Embodiments include the following:

Embodiment 1: a feed mechanism for a firearm, the feed mechanism comprising: a feed opening; a track configured to guide one or more cartridges along a travel path towards the feed opening, the track comprising a timed cartridge alignment element to cause a first of the one or more cartridges to define a focal axis, and to position one of a first dummy cartridge and another of the one or more cartridges such that a central axis of the one of a first dummy cartridge and another of the one or more cartridges does not converge with the focal axis and is not parallel to the focal axis.

Embodiment 2: the feed mechanism of embodiment 1, wherein: the timed cartridge alignment element is configured to cause the focal axis to extend distally above the central axis.

Embodiment 3: the feed mechanism of embodiment 1, wherein: the timed cartridge alignment element is configured to cause the focal axis to extend distally below the central axis.

Embodiment 4: the feed mechanism of embodiment 1, wherein: the timed cartridge alignment element is configured to cause a central axis of one of a second dummy cartridge and a third cartridge to converge with the focal axis.

Embodiment 5: the feed mechanism of embodiment 4, wherein: the track comprises a concave curve configured to cause a central axis of one of a second dummy cartridge and a third cartridge to converge with the focal axis.

Embodiment 6: the feed mechanism of embodiment 1, wherein: the timed cartridge alignment element comprises an align element and a diverge element, the align element configured to align a first cartridge to a focal axis, the diverge element configured to cause a central axis of one of a second cartridge and a dummy cartridge to diverge from the focal axis.

Embodiment 7: the feed mechanism of embodiment 6, wherein: the align element is a first distance from the feed opening and the diverge element is a second distance from the feed opening, the first distance less than the second distance.

Embodiment 8: the feed mechanism of embodiment 7, further comprising: a first side portion; and a second side portion; wherein the first side portion comprises the align element and the second side portion comprises the diverge element.

Embodiment 9: the feed mechanism of embodiment 8; wherein: the first side portion and the second side portion are coupled together to define the track therebetween.

Embodiment 10: the feed mechanism of embodiment 1, wherein the end portion comprises a mounting portion configured for mounting the feed mechanism to a firearm magazine.

Embodiment 11: the feed mechanism of embodiment 1, wherein the feed mechanism is a stick type magazine.

Embodiment 12: the feed mechanism of embodiment 11, wherein the feed mechanism is configured to house cartridges having a caliber of 7 millimeters or greater.

Embodiment 13: the feed mechanism of embodiment 1, further comprising: a mount for movably mounting at least one of a cartridge gate and a cartridge guide.

Embodiment 14: the feed mechanism of embodiment 13, wherein: the track comprises a recess, the recess configured to be selectively blocked by a cartridge guide.

Embodiment 15: a method of using a feed mechanism for a firearm, the method comprising: guiding one or more cartridges along a travel path between an end portion and a feed opening of the feed mechanism; causing a first of the one or more cartridges to define a focal axis; positioning one of a first dummy cartridge and another of the one or more cartridges such that a central axis of the one of a first dummy cartridge and another of the one or more cartridges does not converge with the focal axis and is not parallel to the focal axis.

Embodiment 16: the method of embodiment 15, further comprising: causing the focal axis to extend distally above the central axis.

Embodiment 17: the method of embodiment 15, further comprising: causing the focal axis to extend distally below the central axis.

Embodiment 18: The method of embodiment 15, further comprising: causing a central axis of one of a second dummy cartridge and a third cartridge to substantially converge with the focal axis.

Embodiment 19: the method of embodiment 15, further comprising: mounting the feed mechanism to a drum magazine.

Embodiment 20: the method of embodiment 15, further comprising: movably mounting at least one of a cartridge gate and a cartridge guide to the feed mechanism.

Group V embodiments include the following:

Embodiment 1: a magazine assembly for a firearm, comprising: a magazine housing defining a track; and a follower assembly; wherein the magazine housing is configured to constrain a cartridge as the cartridge is moved within the magazine assembly such that majority of a proximal surface area of the cartridge does not contact the magazine housing, and a distal tip of the cartridge does not contact the magazine housing.

Embodiment 2: the magazine assembly of embodiment 1, wherein: the magazine is a drum magazine; and the magazine housing comprises a drum body and a rear cover.

Embodiment 3: the magazine assembly of embodiment 2, wherein: the drum body and the rear cover are coupled together to define a track therebetween, and to constrain a cartridge therebetween.

Embodiment 4: the magazine assembly of embodiment 1, further comprising: a track ridge for abutting a proximal surface of a loaded cartridge.

Embodiment 5: the magazine assembly of embodiment 4, wherein: the track ridge is configured to abut a minority of a proximal surface area of the loaded cartridge.

Embodiment 6: the magazine assembly of embodiment 1, wherein: the magazine housing comprises a proximal abutting side for constraining a focal point of the cartridge.

Embodiment 7: the magazine assembly of embodiment 1, wherein: the magazine housing comprises a distal abutment to abut a case of a loaded cartridge.

Embodiment 8: the magazine assembly of embodiment 7, wherein: the distal abutment is configured to prevent a tip of the cartridge from striking the magazine housing.

Embodiment 9: the magazine assembly of embodiment 8, wherein: the distal abutment is configured to constrain a focal point of the cartridge.

Embodiment 10: the magazine assembly of embodiment 1, further comprising: a viewing window.

Embodiment 11: the magazine assembly of embodiment 10, further comprising: at least one of a transparent cover over the viewing window and a semi-transparent cover over the viewing window.

Embodiment 12: the magazine assembly of embodiment 1, wherein: at least a portion of the magazine housing comprises at least one of a transparent material and a semi-transparent material.

Embodiment 13: the magazine assembly of embodiment 1, further comprising: a spiral track, the spiral track winding about a central axis at a discontinuously increasing rate.

Embodiment 14: the magazine assembly of embodiment 1, further comprising: a spiral track, the spiral track winding about a central axis at a continuously increasing rate.

Embodiment 15: the magazine assembly of embodiment 1, further comprising: a spiral track; wherein the spiral track has portions winding about a central axis at a discontinuously increasing rate; and the spiral track has portions winding about the central axis at a constant radius.

Embodiment 16: a method of constraining a cartridge in a magazine assembly for a firearm, comprising: constraining the cartridge such that: a majority of a proximal surface area of the cartridge does not contact a magazine housing; and a distal tip of the cartridge does not contact the magazine housing.

Embodiment 17: the method of embodiment 16, further comprising: constraining the cartridge in a magazine having a housing defining a track.

Embodiment 18: the method of embodiment 16, further comprising: causing a track ridge to abut a proximal surface of the cartridge.

Embodiment 19: the magazine method of embodiment 18, further comprising: supporting a minority of a proximal surface area of the cartridge.

Embodiment 20: the method of embodiment 18, further comprising: constraining a focal point of the cartridge by abutting a case of the cartridge.

Embodiment 21: the method of embodiment 16, further comprising: abutting a distal portion of a case of the cartridge.

Each of the various elements disclosed herein may be achieved in a variety of manners. This disclosure should be understood to encompass each such variation, be it a variation of an embodiment of any apparatus embodiment, a method or process embodiment, or even merely a variation of any element of these. Particularly, it should be understood that the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this invention is entitled.

As but one example, it should be understood that all action may be expressed as a means for taking that action or as an element which causes that action. Similarly, each physical element disclosed should be understood to encompass a disclosure of the action which that physical element facilitates. Regarding this last aspect, the disclosure of a "lock mechanism" should be understood to encompass disclosure of the act of "locking"—whether explicitly discussed or not—and, conversely, were there only disclosure of the act of "locking", such a disclosure should be understood to encompass disclosure of a "lock mechanism". Such changes and alternative terms are to be understood to be explicitly included in the description.

In conclusion, the present disclosure illustrates, among other things, a system and method for using a drum magazine assembly. Those skilled in the art can readily recognize that numerous variations and substitutions may be made in any embodiment, its use and its configuration to achieve substantially the same results as achieved by the embodiments described herein. Many variations, modifications and alternative constructions fall within the scope and spirit of the claims, which define the invention.

What is claimed is:

1. A drum magazine assembly for a firearm, the drum magazine assembly comprising:

a drum assembly comprising a wheel having a first pivot axis;

a spindle assembly;

a feed tower assembly; and an advancing mechanism to advance the wheel such that one or more cartridges of ammunition may be loaded after advancing the wheel, the advancing mechanism comprising an arm, a pawl, and a lever;

the pawl is configured to pivot about a second pivot axis between a free position and an engaged position, the second pivot axis defined by a distal section of the arm and is parallel to the first pivot axis;

the pawl is further configured to selectively engage the wheel when the pawl is in the engaged position.

2. The drum magazine assembly of claim 1, wherein the lever is configured to pivot the pawl about the second pivot axis.

3. The drum magazine assembly of claim 1, wherein the lever is configured to pivot about the second pivot axis.

4. The drum magazine assembly of claim 3, wherein the grip is configured to allow a user to grasp and rotate the lever relative to the arm.

5. The advancing mechanism of claim 1, wherein:

the pawl is configured to engage a tooth at the distal region of the wheel.

6. The drum magazine assembly for a firearm of claim 1, further comprising:

a rear cover, wherein the rear cover is configured with a recess; and a clear window comprising a flange for engaging the recess.

7. The drum magazine assembly for a firearm of claim 6, wherein a track ridge is over-molded onto a plurality of secondary protrusions in the viewing window.

8. The drum magazine assembly for a firearm of claim 6, wherein the rear cover is over-molded onto the flange.

9. The drum magazine assembly for a firearm of claim 1, wherein the advancing mechanism is configured to advance a wheel of a drum magazine assembly such that two or more cartridges of ammunition may be loaded after advancing the wheel.

10. The drum magazine assembly for a firearm of claim 1, wherein the advancing mechanism is configured to advance a wheel having teeth arranged about a distal circumference of the wheel.

11. The drum magazine assembly for a firearm of claim 10, further comprising: an arm return spring configured to return the arm to a start position after an advancing motion in the drum magazine assembly.

12. The drum magazine assembly for a firearm of claim 1, wherein the pawl pin assembly is further configured to push against a second side of the notch, allowing the pawl to advance over the teeth of the wheel or engage the teeth in a ratcheting configuration when the lever is in an open position.

13. The drum magazine assembly of claim 1, wherein the lever is configured to pivot about the second pivot axis, and the pawl is configured to pivot about a third pivot axis defined by a distal section of the arm.

14. The drum magazine assembly of claim 1, wherein the second and third pivot axes are coextensive.

15. The drum magazine assembly of claim 1, wherein the pawl is configured to be biased towards the free position when the lever is in a closed position, and the pawl is configured to be biased to the engaged position when the lever is in an open position.

16. The drum magazine assembly of claim 1, wherein the pawl is configured to advance over teeth of the wheel or engage the teeth of the wheel in a ratcheting configuration.

17. A firearm drum magazine comprising:

a drum comprising a wheel having a first pivot axis;

a feed tower; and an arm, a pawl, and a lever, wherein, the arm, the pawl, and the lever are interconnected and configured to advance the wheel when the lever is rotated around the first pivot axis, and the lever is configured to pivot the pawl about a second pivot axis between a free and an advance position.

18. The firearm drum magazine of claim 17, wherein the wheel comprises teeth extending radially from a distal portion of the wheel and the second pivot axis is arranged substantially toward a distal end of the arm.

19. The firearm drum magazine of claim 17, wherein the first and second pivot axes are parallel.

* * * * *